US012173443B2

(12) United States Patent
Monsrud et al.

(10) Patent No.: US 12,173,443 B2
(45) Date of Patent: Dec. 24, 2024

(54) METHODS FOR CONTROLLING A WATER REUSE SYSTEM IN A WASH MACHINE

(71) Applicant: ECOLAB USA INC., Saint Paul, MN (US)

(72) Inventors: Lee Monsrud, Saint Paul, MN (US); Kaustav Ghosh, Saint Paul, MN (US); Barry R. Taylor, Saint Paul, MN (US); Loan Paulson-Vu, Saint Paul, MN (US); Brock Mueggenborg, Saint Paul, MN (US)

(73) Assignee: ECOLAB USA INC., Saint Paul, MN (US)

( * ) Notice: Subject to any disclaimer, the term of this patent is extended or adjusted under 35 U.S.C. 154(b) by 0 days.

(21) Appl. No.: 18/046,803

(22) Filed: Oct. 14, 2022

(65) Prior Publication Data

US 2023/0083778 A1 Mar. 16, 2023

Related U.S. Application Data

(62) Division of application No. 16/778,630, filed on Jan. 31, 2020, now Pat. No. 11,525,200.
(Continued)

(51) Int. Cl.
*D06F 33/46* (2020.01)
*D06F 33/34* (2020.01)
(Continued)

(52) U.S. Cl.
CPC ..... *D06F 33/46* (2020.02); *D06F 33/34* (2020.02); *D06F 34/22* (2020.02); *D06F 34/24* (2020.02);
(Continued)

(58) Field of Classification Search
CPC ..... D06F 39/02; D06F 39/006; D06F 33/46; D06F 39/20
See application file for complete search history.

(56) References Cited

U.S. PATENT DOCUMENTS 1,403,263 A 1/1922 Mueller et al.
1,915,162 A 6/1933 Klaiber
(Continued)

FOREIGN PATENT DOCUMENTS

CN 2393865 Y 8/2000
CN 2482384 Y 3/2002
(Continued)

OTHER PUBLICATIONS

CN103556435A Machine Translation (Year: 2014).*
(Continued)

*Primary Examiner* — Spencer E. Bell
(74) *Attorney, Agent, or Firm* — McKee, Voorhees & Sease, PLC

(57) ABSTRACT

A water reuse system and controller for controlling water levels, temperature, and quality in the rinse water reuse system and methods of using the same, in order to optimize water usage. More particularly, the application pertains to a controller and methods of using the controller to regulate water levels and water quality in a water reuse system. As part of detailing the controller and methods of using the same, an apparatus for a water reuse system is also provided.

10 Claims, 21 Drawing Sheets

Related U.S. Application Data

(60) Provisional application No. 62/799,440, filed on Jan. 31, 2019.

(51) Int. Cl.

| | |
|---|---|
| ***D06F 34/22*** | (2020.01) |
| ***D06F 34/24*** | (2020.01) |
| ***D06F 39/02*** | (2006.01) |
| ***D06F 39/08*** | (2006.01) |
| ***D06F 39/20*** | (2024.01) |
| ***D06F 103/16*** | (2020.01) |
| ***D06F 103/20*** | (2020.01) |
| ***D06F 105/04*** | (2020.01) |
| ***D06F 105/06*** | (2020.01) |

(52) U.S. Cl.

CPC ..... *D06F 39/02* (2013.01); *D06F 39/085* (2013.01); *D06F 39/20* (2024.01); *D06F 2103/16* (2020.02); *D06F 2103/20* (2020.02); *D06F 2105/04* (2020.02); *D06F 2105/06* (2020.02)

(56) References Cited

U.S. PATENT DOCUMENTS

| | | | | |
|---|---|---|---|---|
| 2,498,885 | A | 2/1950 | Geldhof | |
| 2,883,843 | A | 4/1959 | Bochan | |
| 3,197,980 | A | 8/1965 | Marple | |
| 3,222,896 | A | 12/1965 | Livingston | |
| 3,841,116 | A | 10/1974 | Klein et al. | |
| 4,062,205 | A | 12/1977 | Morey et al. | |
| 4,132,524 | A | 1/1979 | Hasselschwert | |
| 4,156,621 | A | 5/1979 | Andrews et al. | |
| 4,565,019 | A | 1/1986 | Cavalli | |
| 4,777,682 | A | 10/1988 | Dreher et al. | |
| 4,784,666 | A | 11/1988 | Brenner et al. | |
| 4,821,537 | A | 4/1989 | Zinkann et al. | |
| 4,832,752 | A | 5/1989 | Nezworski | |
| 4,886,081 | A | 12/1989 | Blaul | |
| 4,889,644 | A | 12/1989 | Amberg et al. | |
| 4,986,093 | A | 1/1991 | Pastryk et al. | |
| 5,063,697 | A | 11/1991 | Valente et al. | |
| 5,138,778 | A | 8/1992 | Brandolini | |
| 5,191,669 | A | 3/1993 | Euler et al. | |
| 5,233,718 | A | 8/1993 | Hardaway et al. | |
| 5,249,441 | A | 10/1993 | Pastryk et al. | |
| 5,285,665 | A | 2/1994 | Hetrick, Jr. | |
| 5,307,650 | A | 5/1994 | Mertz | |
| 5,307,651 | A | 5/1994 | Felzer | |
| 5,307,654 | A | 5/1994 | Ling | |
| 5,501,792 | A * | 3/1996 | Carroll, Jr. ..... | D06F 39/006 210/167.01 |
| 5,758,377 | A | 6/1998 | Cimetta et al. | |
| 5,829,459 | A | 11/1998 | Milocco et al. | |
| 5,868,937 | A | 2/1999 | Back et al. | |
| 5,937,677 | A | 8/1999 | Lee | |
| 6,640,472 | B1 | 11/2003 | Wu | |
| 6,727,216 | B1 | 4/2004 | Waeschenbach et al. | |
| 7,000,437 | B2 | 2/2006 | Raney et al. | |
| 7,323,014 | B2 | 1/2008 | Deak et al. | |
| 7,323,015 | B2 | 1/2008 | Cottard et al. | |
| 7,455,067 | B1 | 11/2008 | Cotton | |
| 7,677,062 | B2 | 3/2010 | Zaccone et al. | |
| 7,707,859 | B2 | 5/2010 | Wong et al. | |
| 7,713,358 | B2 | 5/2010 | Pardini | |
| 7,713,359 | B2 | 5/2010 | Jinbäck | |
| 7,927,494 | B2 | 4/2011 | Ikematsu et al. | |
| 7,950,254 | B2 | 5/2011 | Gray et al. | |
| 8,157,923 | B1 | 4/2012 | Mohrbacher, Jr. et al. | |
| 8,312,582 | B2 | 11/2012 | Oak et al. | |
| 8,919,154 | B2 | 12/2014 | Kim et al. | |
| 9,169,592 | B2 | 10/2015 | Kim et al. | |
| 9,312,582 | B2 | 4/2016 | Meyer et al. | |
| 9,334,600 | B2 | 5/2016 | Pollett et al. | |
| 9,388,369 | B2 | 7/2016 | Peters et al. | |
| 9,451,866 | B2 | 9/2016 | Franco et al. | |
| 9,661,980 | B2 | 5/2017 | Carr et al. | |
| 9,719,203 | B2 | 8/2017 | Maiero | |
| 10,537,921 | B2 | 1/2020 | Choe | |
| 2005/0028295 | A1 | 2/2005 | Jeon et al. | |
| 2005/0034251 | A1 | 2/2005 | Oh et al. | |
| 2006/0058469 | A1 | 3/2006 | Akatsuka et al. | |
| 2006/0117811 | A1 | 6/2006 | Kinnetz | |
| 2007/0157396 | A1 | 7/2007 | Won et al. | |
| 2009/0077755 | A1 | 3/2009 | Park et al. | |
| 2009/0106911 | A1 | 4/2009 | Kim | |
| 2011/0083699 | A1 | 4/2011 | Rosenbauer | |
| 2012/0011663 | A1 | 1/2012 | Hanau et al. | |
| 2012/0018375 | A1 | 1/2012 | Scheu et al. | |
| 2012/0060300 | A1 | 3/2012 | Kim et al. | |
| 2012/0103364 | A1 | 5/2012 | Monsrud et al. | |
| 2012/0137447 | A1 | 6/2012 | Aykroyd et al. | |
| 2012/0137449 | A1 | 6/2012 | Ransom et al. | |
| 2013/0092704 | A1 * | 4/2013 | Tincher ..... | F04B 49/065 417/474 |
| 2013/0167304 | A1 | 7/2013 | Kim | |
| 2014/0053611 | A1 | 2/2014 | Klos et al. | |
| 2014/0060300 | A1 | 3/2014 | Kurcherov et al. | |
| 2014/0224286 | A1 | 8/2014 | Lee et al. | |
| 2014/0283312 | A1 * | 9/2014 | Bocchino ..... | D06F 39/006 68/12.01 |
| 2014/0299677 | A1 | 10/2014 | Bashar | |
| 2015/0047128 | A1 | 2/2015 | Goshgarian et al. | |
| 2015/0317488 | A1 | 11/2015 | Dogu et al. | |
| 2016/0090683 | A1 | 3/2016 | Lyu | |
| 2016/0220091 | A1 | 8/2016 | Hansson | |
| 2017/0014490 | A1 | 1/2017 | Rodriguez et al. | |
| 2017/0038158 | A1 * | 2/2017 | Milton ..... | F28D 7/106 |
| 2017/0073878 | A1 | 3/2017 | Xu et al. | |
| 2017/0209016 | A1 | 7/2017 | Leuchten et al. | |
| 2018/0044845 | A1 | 2/2018 | Bocchino | |
| 2018/0135229 | A1 | 5/2018 | Leibman et al. | |
| 2019/0136438 | A1 | 5/2019 | Lee et al. | |
| 2019/0203405 | A1 | 7/2019 | Lee et al. | |
| 2019/0382943 | A1 | 12/2019 | VanderZwaag | |
| 2021/0172156 | A1 * | 6/2021 | Maxant ..... | E03B 1/041 |

FOREIGN PATENT DOCUMENTS

| | | | | |
|---|---|---|---|---|
| CN | 1175137 | C | 11/2004 | |
| CN | 1195104 | C | 3/2005 | |
| CN | 2903753 | Y | 5/2007 | |
| CN | 201099627 | Y | 8/2008 | |
| CN | 201195800 | Y | 2/2009 | |
| CN | 201339125 | Y | 11/2009 | |
| CN | 100577904 | C | 1/2010 | |
| CN | 101748581 | A | 6/2010 | |
| CN | 201762800 | U | 3/2011 | |
| CN | 201777918 | U | 3/2011 | |
| CN | 201842976 | U | 5/2011 | |
| CN | 201952647 | U | 8/2011 | |
| CN | 201959724 | U | 9/2011 | |
| CN | 101914941 | B | 10/2011 | |
| CN | 202095480 | U | 1/2012 | |
| CN | 202112220 | U | 1/2012 | |
| CN | 102378837 | A | 3/2012 | |
| CN | 202499771 | U | 10/2012 | |
| CN | 202576116 | U | 12/2012 | |
| CN | 202936264 | U | 5/2013 | |
| CN | 202936279 | U | 5/2013 | |
| CN | 102442275 | B | 6/2013 | |
| CN | 203012850 | U | 6/2013 | |
| CN | 203090761 | U | 7/2013 | |
| CN | 203128352 | U | 8/2013 | |
| CN | 203174370 | U | 9/2013 | |
| CN | 203238077 | U | 10/2013 | |
| CN | 203320131 | U | 12/2013 | |
| CN | 102372341 | B | 2/2014 | |
| CN | 103556435 | A * | 2/2014 | ..... D06F 35/006 |
| CN | 203447988 | U | 2/2014 | |
| CN | 203451866 | U | 2/2014 | |
| CN | 203498183 | U | 3/2014 | |
| CN | 203593680 | U | 5/2014 | |

(56) References Cited

FOREIGN PATENT DOCUMENTS

| | | | |
|---|---|---|---|
| CN | 104047156 | A | 9/2014 |
| CN | 203864651 | U | 10/2014 |
| CN | 104150627 | A | 11/2014 |
| CN | 102643564 | B | 12/2014 |
| CN | 204112421 | U | 1/2015 |
| CN | 103482780 | B | 2/2015 |
| CN | 204224341 | U | 3/2015 |
| CN | 204224342 | U | 3/2015 |
| CN | 104480673 | A | 4/2015 |
| CN | 104562610 | A | 4/2015 |
| CN | 204251449 | U | 4/2015 |
| CN | 104591339 | A | 5/2015 |
| CN | 104650254 | A | 5/2015 |
| CN | 103553233 | B | 6/2015 |
| CN | 204779735 | U | 11/2015 |
| CN | 105110415 | A | 12/2015 |
| CN | 103936215 | B | 1/2016 |
| CN | 105236643 | A | 1/2016 |
| CN | 105266740 | A | 1/2016 |
| CN | 105347534 | A | 2/2016 |
| CN | 104047145 | B | 3/2016 |
| CN | 104358290 | B | 3/2016 |
| CN | 105540940 | A | 5/2016 |
| CN | 105621752 | A | 6/2016 |
| CN | 205347027 | U | 6/2016 |
| CN | 104801251 | B | 9/2016 |
| CN | 106377211 | A | 2/2017 |
| CN | 107475987 | A | 12/2017 |
| CN | 105274782 | B | 3/2018 |
| CN | 107794711 | A | 3/2018 |
| CN | 108342875 | A | 7/2018 |
| CN | 109082832 | A | 12/2018 |
| CN | 109112763 | A | 1/2019 |
| CN | 109338678 | A | 2/2019 |
| CN | 109759406 | A | 5/2019 |
| DE | 2422092 | A1 | 11/1975 |
| DE | 3224389 | A1 | 4/1983 |
| DE | 4236873 | A1 | 5/1994 |
| DE | 4243605 | C2 | 1/1998 |
| DE | 19654619 | A1 | 6/1998 |
| DE | 102009029186 | A1 | 3/2011 |
| DE | 102013224524 | A1 | 6/2015 |
| EA | 201171202 | A1 | 4/2012 |
| EP | 0236282 | A1 | 9/1987 |
| EP | 0350536 | B1 | 1/1990 |
| EP | 0467028 | B1 | 1/1992 |
| EP | 0578006 | A1 * | 1/1994 |
| EP | 0518806 | B1 | 11/1994 |
| EP | 2049724 | B1 | 10/2009 |
| EP | 2292138 | A1 | 3/2011 |
| EP | 2402289 | A1 | 1/2012 |
| EP | 2534996 | A1 | 12/2012 |
| EP | 2568074 | B1 | 3/2013 |
| EP | 2478145 | B1 | 5/2013 |
| EP | 2719814 | A1 | 4/2014 |
| EP | 2510865 | B1 | 12/2014 |
| EP | 2684503 | B1 | 9/2015 |
| EP | 3172370 | B1 | 1/2020 |
| FR | 2417967 | A1 | 9/1979 |
| FR | 2632331 | B1 | 5/1991 |
| GB | 2255709 | A | 11/1992 |
| IN | 202543652 | U | 11/2012 |
| JP | 8131141 | A | 5/1996 |
| JP | 10137703 | A | 5/1998 |
| JP | 111156080 | A | 6/1999 |
| JP | 200084291 | A | 3/2000 |
| JP | 3131141 | B2 | 1/2001 |
| JP | 2001113090 | A | 4/2001 |
| JP | 2002119794 | A | 4/2002 |
| JP | 3379816 | B2 | 2/2003 |
| JP | 2003144793 | A | 5/2003 |
| JP | 2006207328 | A | 8/2006 |
| JP | 2007283180 | A | 11/2007 |
| JP | 4498981 | B2 | 7/2010 |
| JP | 2010156117 | A | 7/2010 |
| JP | 4540446 | B2 | 9/2010 |
| JP | 2011036311 | A | 2/2011 |
| JP | 4767021 | B2 | 9/2011 |
| JP | 2012077439 | A | 4/2012 |
| JP | 5097577 | B2 | 12/2012 |
| JP | 5516290 | B2 | 6/2014 |
| JP | 5576060 | B2 | 8/2014 |
| JP | 5616771 | B2 | 10/2014 |
| JP | 5739595 | B1 | 6/2015 |
| JP | 2015192972 | A | 11/2015 |
| JP | 2015192975 | A | 11/2015 |
| JP | 2015202329 | A | 11/2015 |
| KR | 20010107000 | A | 12/2001 |
| KR | 100425794 | B1 | 3/2004 |
| KR | 20040060891 | A | 7/2004 |
| KR | 20040060897 | A | 7/2004 |
| KR | 100481376 | B1 | 3/2005 |
| KR | 100565479 | B1 | 3/2006 |
| KR | 20060023017 | A | 3/2006 |
| KR | 100569828 | B1 | 4/2006 |
| KR | 100701934 | B1 | 3/2007 |
| KR | 20130077099 | A | 7/2013 |
| KR | 20140059481 | A | 5/2014 |
| SU | 494342 | A1 | 12/1975 |
| WO | 0159057 | A1 | 8/2001 |
| WO | 2009141218 | A1 | 11/2009 |
| WO | 2010115683 | A1 | 10/2010 |
| WO | 2011121436 | A1 | 10/2011 |
| WO | 2013167917 | A1 | 11/2013 |
| WO | 2014038826 | A1 | 3/2014 |
| WO | 2014205980 | A1 | 12/2014 |
| WO | 2014205988 | A1 | 12/2014 |
| WO | 2015078653 | A1 | 6/2015 |
| WO | 2015158977 | A1 | 10/2015 |
| WO | 2016170726 | A1 | 10/2016 |

OTHER PUBLICATIONS

"Filtration technology allows washing machines to reuse 95% of laundry wastewater", http://www.treehugger.com/clean-technology/filtration-technology-allows-washing-machines-reuse-95-laundry-wastewater.html, Markham, Derek, written on Nov. 25, 2015, 14 pages, accessed by client Sep. 17, 2018.

"This Washing Machine Recycles So Efficiently It Can Re-Use The Same Water For Months", https://www.fastcompany.com/3054082/this-washing-machine-so-efficiently-it-can-re-use-the-same-water-for-months, written Dec. 2, 2015 by Charlie Sorrel, 13 pages, accessed by client Sep. 17, 2018.

"What Do the Pre-Soak & Pre-Wash Cycles Do on My Kenmore Heavy Duty Series 70 Washing Machine?", by Jon Stefansson, 5 pages, accessed by client Sep. 21, 2018.

Whirlpool, "Top-Loading High Efficiency Low-Water Washer Use and Care Guide", 36 pages, 2015.

Machine translation, FR2993166 (B1), published Jan. 9, 2015.

International Searching Authority, in connection with PCT/US2020/016145 filed Jan. 31, 2020, "The International Search Report and the Written Opinion of the International Searching Authority, or the Declaration", 14 pages, mailed Apr. 15, 2020.

WO2009141218A1 Machine Translation 2009.

* cited by examiner

METHODS FOR CONTROLLING A WATER REUSE SYSTEM IN A WASH MACHINE

CROSS REFERENCE TO RELATED APPLICATIONS

This application is a divisional patent application of co-pending U.S. Ser. No. 16/778,630, filed on Jan. 31, 2020, titled CONTROLLER FOR A RINSE WATER REUSE SYSTEM AND METHODS OF USE, which claimed priority under 35 U.S.C. § 119 to U.S. Provisional Application Ser. No. 62/799,440 filed on Jan. 31, 2019, titled CONTROLLER FOR A RINSE WATER REUSE SYSTEM AND METHODS OF USE. The entire contents of these patent applications are herein incorporated by reference including, without limitation, the specification, claims, and abstract, as well as any figures, tables, or drawings thereof.

This application is related to U.S. application Ser. No. 16/778,233, filed Jan. 31, 2020, issued as U.S. Pat. No. 11,459,692 on Oct. 4, 2022, titled LAUNDRY MACHINE KIT TO ENABLE CONTROL OF WATER LEVELS, RECIRCULATION, AND SPRAY OF CHEMISTRY; U.S. application Ser. No. 16/778,345, filed Jan. 31, 2020, titled RINSE WATER REUSE SYSTEM AND METHODS OF USE; and U.S. application Ser. No. 16/778,684, filed Jan. 31, 2020, titled CONTROLLING WATER LEVELS AND DETERGENT CONCENTRATION IN A WASH CYCLE, each of which is herein incorporated by reference including, without limitation, the specification, claims, and abstract, as well as any figures, tables, or drawings thereof.

TECHNICAL FIELD

The application relates generally to a controller for controlling water levels, temperature, and quality in a rinse water reuse system and methods of using the same, in order to optimize water usage. More particularly, the application pertains to a controller and methods of using the controller to regulate water levels and water quality in a water reuse system. As part of detailing the controller and methods of using the same, a water reuse system is also provided.

BACKGROUND

Commercial, institutional and industrial (CII) laundry facilities clean large quantities of textiles made from many materials and used in many different applications. On premises laundries (OPLs) and other industrial laundries thus use vast amounts of water at varying degrees of efficiency. Water and wastewater disposal represent significant costs for many businesses and can account for more than 50% of total operating costs at a typical commercial laundry. Thus, decreasing water usage and reusing wastewater presents an appealing avenue for improving cost efficiency of CII laundries. However, water efficiency and wastewater reuse technologies and methods cannot sacrifice cleaning performance.

CII laundries regularly deal with textiles containing a high quantity great diversity of soils, such as dirt/dust soils, food soils, oily soils, bacterial, viral and other microbial contaminants, industrial and food grease, makeup soils, waxy soils, and others. Both the quantity and diversity of these soils make CII laundry soil removal a challenge. Low water machines, washer-extractor machines, and current water recycle systems often provide inefficient and/or incomplete removal of soils. Currently available machines designed to use less water often do not provide enough free water to solubilize soils and carry them away from textiles. On the other hand, to allow solubilization of these soils, some laundry machines use a lot of water. This negatively impacts the cleaning of chemistry sensitive laundry stains due to the reduced chemistry concentration in a higher volume of water. Overall today's processes not only result in greater water and wastewater costs, but also increase the wear on the textiles, causing them to wear out faster, resulting in an increase in costs related to textile repair and replacement.

In some traditional cleaning systems or methods, the washing process comprises a pre-wash or pre-soak where the textiles are wetted, and a pre-soak composition is added. The wash phase follows the pre-soak phase; a detergent composition is added to the wash tank to facilitate soil removal. In some cases, a bleach phase follows the wash phase in order to remove oxidizable stains and whiten the textiles. Next, the rinsing phase removes all suspended soils. In some cases, a laundry sour is added in a souring or finishing phase to neutralize any residual alkalinity from the detergent composition. In many cases a fabric softener or other finishing chemical like a starch is also added in the finishing step. Finally, the extraction phase removes as much water from the wash tank and textiles as possible. In some cases, a wash cycle may have two rinse and extraction phases, i.e. a rinse cycle, an intermediate-extract cycle, a final rinse cycle, and a final extraction cycle. After the wash cycle is complete, the resulting wastewater is typically removed and discarded.

Traditional CII wash machines and CII wash machines with reuse systems, do not effectively manage and reduce water and wastewater usage. Even for the machines having a water reuse system, the effectiveness of water recycling depends heavily on the scale of the application, the chemical and physical properties of the recycled water (based on the nature of the cleaning chemistry and soils), and the logistical requirements of the operation. Total water recycle systems in practice can reduce water usage by up to 70% by capturing, treating, and reusing all of the wash water and rinse water. However, mere water recapture does not indicate that a water reuse system is effective. Existing water reuse and recirculation systems struggle to make reuse water usable for a variety of reasons. First, total recycle systems often get fouled with heavy soils, thus requiring frequent manual cleaning operations and a large amount of downtime which takes personnel time and effort as well as prevents the operation from using recycled water during the manual cleaning operation. Second, when reuse water is stored in a reservoir tank, it is usually idle for a period of time. This idleness creates ideal conditions for microbial growth. Further, as the water sits idle in a reservoir tank, it cools in temperature to the point where it no longer provides effective soil removal. The cooled water must be reheated or have water temperature maintained through heating components; both heating options are costly.

One solution is to simply add hot tap water into a wash tank together with the cooled reuse water. However, such systems usually add hot water based on the total volume of water required to fill the wash tank. This is not cost effective and it counteracts the purpose of using the maximum amount of reuse water in a wash machine.

Thus, generally, there is a need to develop improved water reuse systems, particularly systems using the rinse water of a wash cycle. More specifically, there is a need to develop means and methods of controlling the water temperature of reuse water such that the cost of new (i.e. hot or cold tap water) water added does not exceed the savings accrued by using reuse water and a reuse water system.

There is also a need to address the issues associated with water reuse systems in space-constrained laundry facilities. For example, there is a need to develop water reuse systems and ways of controlling the same which do not require the use of expensive filtration to clean recirculated water, and which do not redeposit soils onto textiles cleaned with recirculated water. There is a further need to develop water reuse systems and ways of controlling the same which do not take up more space than the footprint of the original wash machine and/or can be retrofitted onto an existing machine.

There is also a need to develop water reuse and recirculation systems which enable effective contact between water and linens with smaller volumes of water in the wash tank.

Existing water reuse systems use a captured water reservoir tank to deliver water to only the wash step of a washing machines cycle. This delivery of water by using a pump is faster than delivering water from the building tap pipes but is only saves a small amount of cycle time because it only speeds up the wash step filling process. There is a pressing need to save as much time and labor as possible in laundry room operations so there is a need to speed up not only the wash step filling process, but to speed up the filling process of all steps in the laundry machines cycle.

BRIEF SUMMARY OF THE DISCLOSURE

Therefore, it is a principal object, feature, and/or advantage of the present application to provide an apparatus, method, and/or system that overcomes the deficiencies in the art.

It is another object, feature, and/or advantage of the present application to provide a method of controlling a water reuse system that optimizes the water quantity, temperature, and quality such that the cost of new (i.e. hot or cold tap water) water added does not exceed the savings accrued by using reuse water and a reuse water system generally.

It is a further object, feature, and/or advantage of the present application to provide a water reuse system that enables the cleaning and capture of water from any phase of the wash process other than the highly soiled wash phase for reuse as wash water in a subsequent wash cycle.

Water Reuse System

The water reuse system to be optimized by the present application generally comprises a water reservoir tank equipped with a pump, which is capable of returning rinse water back into the wash tank. In an embodiment, the reservoir tank is narrow, e.g. tall and not wide, having one dimension that can be set up against a machine or wall without blocking the walking space surrounding the wash machine. In a further embodiment, the width of the reservoir tank is 16 inches or less. The reservoir tank may contain several features to prevent contamination and microbial growth in the reuse water. For example, the reservoir tank may be equipped with an auto-dump feature, a conical base which flushes debris, an antimicrobial cleaning composition, a scum/debris skimming device, a filter/strainer and/or a lint screen, among others. In an embodiment, the reservoir tank is placed to the side of the wash machine, underneath the wash machine, on top of the wash machine, or above the wash machine. Additionally, a support framework or other suitable mounting device may be used to support the reservoir tank on, under or around the tank. The size of the reservoir tank is proportionate to the size of the wash tank of the wash machines incorporated in the system.

The rinse water reuse system generally also comprises tubing and connectors placing the wash tank and reservoir tank in fluid communication. In an embodiment, the tubing and connectors connect one reservoir tank to a plurality of wash machines. In a further embodiment, the tubing and connectors connect a plurality of reservoir tanks to one wash machine. Like the reservoir tank, the tubing and connectors when taken together should not expand the footprint of the original wash machine.

The system may optionally comprise a water recirculation kit which delivers wash water and/or rinse water through the window of the wash door and directly onto the linens in the wash tank via a system of nozzles. In an embodiment, the nozzle system comprises a hollow body having a central bore and a valve positioned in the central bore. The nozzle is in fluid communication with a pump and a wash tank such that the nozzle recirculates water from the pump to the wash tank, propelled by the pump. In an embodiment, the nozzle has a slit or other aperture on the tip of the nozzle through which a fluid may pass. In a further embodiment, the nozzle has a plurality of slits or other apertures allowing the passage of a fluid. In a still further embodiment, the plurality of slits is positioned radially around the center point on the nozzle tip. In a still further embodiment, the radially positioned slits are arranged in a 180° arc on the nozzle tip. In an embodiment, the valve positioned in the central bore is a shut-off valve, and preferably a quarter-turn stop valve.

In addition to the nozzle system, the water recirculation kit may further comprise a replacement window. The replacement window may provide a substitute for the window in the wash door of an original, unmodified wash machine. In an embodiment, the replacement window has an aperture in the center of the window; the aperture may be located anywhere in the window. In a preferred embodiment, the aperture is located generally in the center of the window. The aperture of the replacement window may be used to connect the nozzle system directly to the wash tank. In an embodiment, the space between the replacement window and the nozzle system is sealed by a sealant or is tight such that it does not allowance the passage of fluid between the aperture and nozzle system. In an embodiment, the replacement window is made of polycarbonate with a polyethylene covering.

In addition to the nozzle system and replacement window, the water recirculation kit may further comprise a pump. In an embodiment, the pump is a centrifugal pump. In a preferred embodiment, the pump is Laing Thermotech E5-NSHNNN3 W-14, having a voltage of 100-230 VAC and 1/25 HP a current of 1.1 amps and operating at 60 psi. The flow of the pump should be sufficient to dispense the recirculated water, including a cleaning composition and soil from the wash cycle. The flow of the pump may range between about 2 gpm and about 10 gpm, preferably between about 2 gpm and about 8 gpm, and more preferably between about 4 gpm and 6 gpm.

The recirculation kit may further comprise tubing, and connectors for connecting the tubing to the nozzle system, the tubing to the pump, etc. The tubing and connectors should be configured so as to prevent the buildup of lint inside the tubing and connectors. In an embodiment, the tubing and connectors have smooth inner walls. In a further embodiment, the tubing and connectors are configured such that when applied, i.e. when connecting, for example, the pump to the nozzle system, the tubing and connectors do so at angles less than 90°, preferably 45° or less. In other words, the connectors are not 90° connectors, and the tubing is not oriented such that fluid must pass at a 90° angle. The tubing and connectors may comprise a sump connector kit for connecting the pump to the wash machine sump.

In addition to the aforementioned components, the wash machines having reuse and/or recirculation systems of the present application may further comprise a variety of energy-saving features. It may have heating elements along with thermocouples, thermostats and relays. The aforementioned systems may further comprise insulation which insulates the wash tank and/or the reservoir tank(s) to maintain water temperature, particularly for the water in the reservoir tank which will be returned back to the wash tank.

The wash machines having reuse and/or recirculation systems of the present application may be used to deliver reuse and/or recirculated water to the wash tank. The method of recirculating water from a wash machine tank may comprise introducing a supply of water to a wash machine tank, wherein the wash machine tank contains one or more soiled articles, subsequently adding a cleaning composition to the wash machine tank and washing the one or more soiled articles in the wash machine tank. Next the method may comprise delivering the supply of water from the wash machine sump to at least one filter, delivering the supply of water to a pump, and delivering the supply of water back to the wash machine tank via the spray nozzle. The method of reusing rinse water may comprise the steps of washing one or more soiled articles by running the wash phase as normal, and then running the rinse phase, wherein the rinse water is extracted from the wash tank, transferred to one or more reservoir tanks, and then returned to the wash tank in a subsequent wash phase.

According to this method, the cleaning composition may be added to the wash machine tank through a dispenser that is in fluid communication with the wash machine tank. Further, the cleaning composition may be provided as a solid or liquid concentrate and subsequently diluted to form a use solution that is added to the wash machine tank. In a further embodiment, the use solution is added to the wash machine tank for a predetermined amount of time such that the solution is added at a desired, predetermined concentration.

According to another aspect of the application, a dispensing system for dispensing a cleaning composition is provided in connection with the water reuse system. The cleaning composition may be provided in concentrate or liquid and may be mixed with a diluting product. The cleaning composition may be provided as a solid or a liquid, either of which may be subsequently diluted with a diluent. The dispensing system includes a dispenser including a dispenser outlet, a product container containing the cleaning composition, an unprimed product line connecting the product container and the dispenser, and optionally a diluter line operatively connected to the product line to combine the cleaning composition and the diluent proximate the dispenser outlet.

According to an aspect of the application, the cleaning composition is diluted and added directly to the reservoir tank. The cleaning composition may be provided to the reservoir tank from a dispensing system as described previously.

According to another aspect of the application, the cleaning composition is added directly to the water stream or pipe coming from the reservoir tank and going to the wash tank.

According to another aspect of the application, the water reuse system of the application is built into and sold with a wash machine. In another aspect, the water reuse system of the application is adapted onto an existing machine, e.g. as a kit for retrofitting an existing machine.

The methods, systems, and/or apparatuses of the application may be conducted at low temperature conditions. For example, the entire wash cycle, using the kit of the application, may occur at a temperature of about 30° C. to about 190° C., preferably between about 30° C. to about 90° C. and more preferably between about 40° C. to about 70° C.

The methods, systems, and/or apparatuses of the application can be used with generally any type of cleaning composition in generally any industry. For example, the application may be used with a cleaning composition that is tailored to the washing environment, e.g. low temperature wash conditions, low water wash conditions, and/or the presence of high quantities and diversity of soil. Further, the application may be used with a cleaning composition that is tailored to the type of soils to be removed, e.g. cleaning compositions comprising an enzyme, a bleaching/brightening agent, a chelant, builder, and/or sequestering agent, and/or varying levels of alkalinity. Further, it should be appreciated that the application can be used in generally any type of industry requiring soil removal, for example the restaurant industry, the hotel and service industries, hospitals and other nursing facilities, prisons, universities and any other on premises laundry site.

The present application is not to be limited to or by these objects, features and advantages. No single embodiment need provide each and every object, feature, or advantage.

DETAILED DESCRIPTION OF THE PREFERRED EMBODIMENTS

Figure 1:
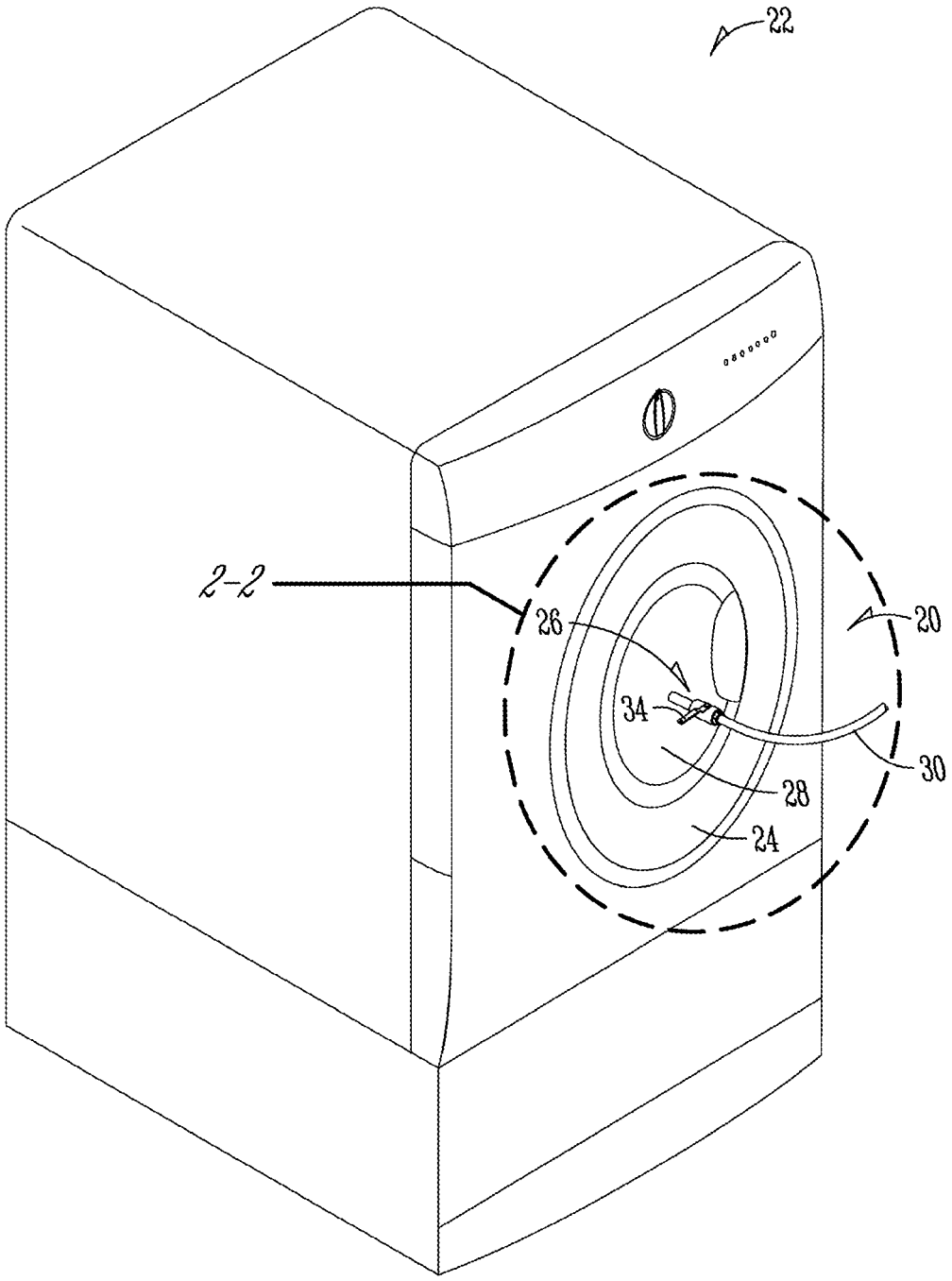
FIG. 1 is a schematic of a preferred embodiment of a wash machine comprising a spray kit as described herein, which comprises a wash door with a replacement window located at the center of the wash door, the nozzle system, and tubing attached to the connectors of the nozzle system, which are in fluid communication with the wash water, allowing the nozzle system to distribute recirculated wash water into the wash machine.

The embodiments described herein are not limited to particular types of CII laundry cleaning methods, apparatuses or systems, which can vary based on particular uses and applications. It is further to be understood that all terminology used herein is for the purpose of describing particular embodiments only and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers defining the range and include each integer within the defined range. Throughout this disclosure, various numeric descriptors are presented in a range format. It should be understood that the description in range format is merely for convenience and brevity and should not be construed as an inflexible limitation on the scope of the disclosure. Accordingly, the description of a range should be considered to have specifically disclosed all the possible sub-ranges, fractions, and individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6, and decimals and fractions, for example, 1.2, 2.75, 3.8, 1½, and 4¾ This applies regardless of the breadth of the range.

So that the disclosure is be more readily understood, certain terms are first defined. Unless defined otherwise, all technical and scientific terms used herein have the same meaning as commonly understood in the art. Many methods and materials similar, modified, or equivalent to those described herein can be used in the practice of the systems, apparatuses and methods described herein without undue experimentation, the preferred materials and methods are described herein. In describing and claiming the systems, methods, and apparatuses, the following terminology will be used in accordance with the definitions set out below.

The term "about," as used herein, refers to variation in the numerical quantity that can occur, for example, through typical measuring techniques and equipment, with respect to any quantifiable variable, including, but not limited to, mass, volume, time, distance, pH, and temperature. Further, given solid and liquid handling procedures used in the real world, there is certain inadvertent error and variation that is likely through differences in the manufacture, source, or purity of the ingredients used to make the compositions or carry out the methods and the like. The term "about" also encompasses amounts that differ due to different equilibrium conditions for a composition resulting from a particular initial mixture. Whether or not modified by the term "about," the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

As used herein, the term "cleaning" refers to a method used to facilitate or aid in soil removal, bleaching, microbial population reduction, and any combination thereof. As used herein, the term "microbial population" refers to any non-cellular or unicellular (including colonial) organism, including all prokaryotes, bacteria (including cyanobacteria), spores, lichens, fungi, protozoa, virinos, viroids, viruses, phages, and some algae.

As used herein, the term "cleaning composition" includes, unless otherwise indicated, detergent compositions, laundry cleaning compositions, and cleaning compositions generally. Cleaning compositions can include both solid, pellet or tablet, paste, gel, and liquid use formulations. The cleaning compositions include laundry detergent cleaning agents, bleaching agents, sanitizing agents, laundry soak or spray treatments, fabric treatment or softening compositions, pH adjusting agents, and other similar cleaning compositions.

As used herein, the term "wash water" "wash water source," "wash liquor," "wash water solution," and the like, as used herein, refer to water sources that have been contaminated with soils from a cleaning application and can be used in circulating and/or recirculating water containing detergents or other cleaning agents used in cleaning applications. Alternatively, wash water can be regularly discarded and replaced with clean water for use as wash water in cleaning applications. For example, certain regulations require wash water to be replaced after a set number of hours to maintain sufficiently clean water sources for cleaning applications. Wash water, according to the application, is not limited according to the source of water. Exemplary water sources suitable for use as a wash water source include, but are not limited to, water from a municipal water source, or private water system, e.g., a public water supply or a well, or any water source containing some hardness ions.

As used herein, the terms "recirculated water" or "recirculated wash water" refer to wash water, i.e. water from the wash cycle, which is recaptured and recirculated back into the wash tank, during the same wash phase. Recirculated water may be recirculated one or more times in a single wash cycle; it may be an intermittent or a continuous recirculation, a short or long duration recirculation; preferably, it is the water in a wash cycle containing a cleaning composition that is recirculated one or more times in a single wash phase and/or cycle. Recapturing and recirculating water allows for lower water use during a given wash cycle.

The terms "rinse water," "rinse water source," "rinse liquor," "rinse water solution," and the like, refer to water sources used during the rinse phase of a washing cycle. Each rinse is usually drained from the machine before the next rinse is applied, although alternative processes are known whereby the first rinse can be added to the machine without draining the wash liquor—draining and subsequent rinses can then follow. Further, as used herein, the term "intermediate rinse" means a rinse which is not the final rinse of the laundry process, and the term "final rinse" means the last rinse in a series of rinses. Rinse water, according to the application, is not limited according to the source of water. Exemplary water sources suitable for use as a wash water source include, but are not limited to, water from a municipal water source, or private water system, e.g., a public water supply or a well, or any water source containing some hardness ions.

As used herein, the term "reuse water" refers to water that has been used in a separate process or process step, such as a phase in a wash cycle, which is recaptured, pumped to a reservoir tank for holding/storage, and transferred back into the wash tank. Reuse water can be transferred back into the wash tank during any phase of the wash cycle, although reuse water is preferably used in the wash phase of a subsequent wash cycle. Reuse water can comprise all, or part of the aqueous stream used in the relevant phase, e.g. the reuse water can comprise at least part of the first feed aqueous stream in the wash phase of a wash cycle. The reuse water is typically treated, such as sanitized, before reuse.

The term "dilutable" or any related terms as used herein, refer to a composition that is intended to be used by being diluted with water or a non-aqueous solvent by a ratio of more than 50:1.

The terms "dimensional stability" and "dimensionally stable" as used herein, refer to a solid product having a growth exponent of less than about 3%. Although not intending to be limited according to a particular theory, the polyepoxysuccinic acid or metal salt thereof is believed to control the rate of water migration for the hydration of sodium carbonate. The polyepoxysuccinic acid or metal salts thereof may stabilize the solid composition by acting as a donor and/or acceptor of free water and controlling the rate of solidification.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardancy. It should be understood that the term "linen" is often used to describe certain types of laundry items including bed sheets, pillow cases, towels, table linen, table cloth, bar mops and uniforms.

"Soil" or "stain" refers to a non-polar oily substance which may or may not contain particulate matter such as mineral clays, sand, natural mineral matter, carbon black, graphite, kaolin, environmental dust, etc. "Restaurant soil" refers to soils that are typically found in the food service industry and include soils animal grease, synthetic greases, and proteinaceous soils.

As used herein, a solid cleaning composition refers to a cleaning composition in the form of a solid such as a powder, a particle, an agglomerate, a flake, a granule, a pellet, a tablet, a lozenge, a puck, a briquette, a brick, a solid block, a unit dose, or another solid form known to those of skill in the art. The term "solid" refers to the state of the cleaning composition under the expected conditions of storage and use of the solid detergent composition. In general, it is expected that the detergent composition will remain in solid form when exposed to temperatures of up to about 100° F. and greater than about 120° F. A cast, pressed, or extruded "solid" may take any form including a block. When referring to a cast, pressed, or extruded solid it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition can range from that of a fused solid block, which is relatively dense and hard, for example, like concrete, to a consistency characterized as being malleable and sponge-like, similar to caulking material. In some embodiments, the solid compositions can be further diluted to prepare a use solution or added directly to a cleaning application, including, for example, a laundry machine.

As used herein the terms "use solution," "ready to use," or variations thereof refer to a composition that is diluted, for example, with water, to form a use composition having the desired components of active ingredients for cleaning. For reasons of economics, a concentrate can be marketed, and an end user can dilute the concentrate with water or an aqueous diluent to a use solution.

Water Reuse System

The water reuse system of the application generally comprises a water reservoir tank, a drain water pump, a drain diverter valve, a tank water transfer pump, a control circuit box, various energy-saving features, and/or various anti-contamination and anti-microbial features.

Reservoir Tank and Reservoir Tank Water Transfer Pump

The water reuse system generally comprises a small water reservoir tank equipped with a drain water pump, which is capable of returning rinse water back into the wash tank. The reservoir tank may be square or rectangular. In a preferred embodiment, the reservoir tank is narrow, e.g. tall and not wide and has one dimension that can be set up against a machine or wall without blocking the walking space surrounding the wash machine. In a further embodiment, the width of the reservoir tank is 16 inches or less. The reservoir tank can support a variety of laundry washers, and the size of the reservoir tank is proportionate to the size of the wash tank of the wash machine or machines. The reservoir tank may comprise between about a 25-gallon tank to about a 60-gallon tank. In a preferred embodiment, the reservoir tank is a 60-gallon tank capable of providing reuse water to a 100-pound wash machine. In an embodiment, a single reservoir tank provides reuse water for a single wash machine. In a further embodiment, a single reservoir tank provides reuse water for several wash machines. In a still further embodiment, multiple reservoir tanks provide reuse water for a single wash machine. In an embodiment, the reservoir tank capacity matches the total capacity of the wash tank(s). In another embodiment, the reservoir tank capacity is less than the total capacity of the wash tank(s). For example, a 25-gallon reservoir tank may provide reuse water for a 35-pound wash machine; a 35-gallon reservoir tank may provide reuse water for a 60-pound wash machine; and/or a 60-gallon reservoir tank may provide reuse water for a 100-pound wash machine.

The reservoir tank may contain several features to prevent contamination and microbial growth in the reuse water. For example, the reservoir tank may be equipped with an auto-dump feature, a conical base which flushes debris, an antimicrobial cleaning composition, a scum/debris skimming device, a filter/strainer and/or a lint screen, among others. In an embodiment, the reservoir tank is placed to the side of the wash machine, underneath the wash machine, on top of the wash machine, or above the wash machine. Additionally, a support framework or other suitable mounting device may be used to support the reservoir tank on, under or around the tank. The size of the reservoir tank is proportionate to the size of the wash tank of the wash machine or machines.

The reservoir tank may be installed to the side of or behind the wash machine. Alternatively, the reservoir tank may be installed on top of, or below the wash machine. Framework, shelving, or any other support system may be used to support the reservoir tank when installed with a wash machine.

Reuse Water Filter

The water reuse system includes a filter located after the outlet or drain valve of the wash machine and before the drain water pump. The reuse water filter removes large debris and other materials from the reuse water, preventing the entry of these debris and materials into the drain water pump and the reservoir tank. Some existing wash machines have such a filter installed along the washer drain outlet. Alternatively, a reuse water filter may be installed into an existing machine, or it may be installed as part of a new wash machine containing the water reuse system of the present application, or as an integral part of the drain water pump.

Fresh Water Valve

A fresh water valve is used to add fresh water from the water tap into the reservoir. The addition of fresh water is needed to ensure that the machine(s) always have reservoir water ready to be pumped into the machine(s). Depending on the timing of when each machine calls for reservoir water, the reservoir may need some supplemental water to feed to the machine. This feature is important to enable the time saving feature of the application: a significant amount of wash cycle time can be saved on each machine for each fill step using water from the water reservoir tank. This time saving feature is true even when water is not recycled or reused from the washing machine. The fresh water fill is also important to enable the addition of chemical to the machine. In the embodiment where the reservoir tank is used to feed chemical to the machine(s), it is essential that the reservoir has water at all times so that the chemical can be fed with the machine filling.

The fresh water valve is also used to flush out the reservoir tank during periods of clean out of the tank. A tank-cleaning spray nozzle is preferably used to add the water into the reservoir.

Reservoir Level Control Floats

The water level in the reservoir tank is controlled by floats or other level sensors which can detect the amount of water in the reservoir. At a minimum there are two floats, a low-level float and a high-level float, but there may be three or four floats depending on additional control needed.

The purpose of the low-level float is two-fold: 1) to prevent the reservoir water transfer pump from running dry, and 2) to trigger an automatic partial refill of the tank if needed. The partial refill of the tank feature is particularly beneficial when the apparatus is connected to several washing machines. In that case, the reservoir can be automatically refilled with fresh water up to a certain level so that each machine is ensured to receive water from the reservoir. That is, each machine can receive reservoir water because the reservoir is not allowed to be empty.

The purpose of the high-level float is two-fold: 1) to prevent the reservoir tank from overflowing, either from the drain pump or from the fresh water flow into the reservoir. 2) to trigger the fresh water top-off to stop flowing water into the reservoir.

A mid-level float can be implemented to fill the reservoir to a middle level between the high and low levels. The mid-level float allows the addition of some fresh water but leaves enough room in the reservoir so that the reservoir can receive more reuse water from a machine, thus preventing an empty situation and also allowing for the maximum amount of water reuse and savings.

Laundry machines can be calling for water fill for the wash, bleach, and rinse steps at different times and sometimes simultaneously with other machines need for water. The astute utilization of level sensors and logic can minimize the occurrence of water shortages and maximize the amount of reuse water and time savings achieved by pumping water rapidly from the reservoir tank.

Tank Configuration and Auto Dump Feature

Reuse water stored in the reservoir tank is pumped into the reservoir tank after being used in at least one wash cycle, or at least one phase of a wash cycle. As such, the reuse water will potentially contain soil, microbial organisms, and/or residual cleaning composition(s). It is important to prevent the growth of microorganisms and prevent other contamination in reservoir tanks. To prevent contamination and microbial growth, the system of the present application may contain a variety of features including, but not limited to, an auto-dump feature, a conical bottom, a dump valve located at the bottom of the tank, a tank scum handler, and treatment with an antimicrobial. The dump valve is preferably a full port valve with a large opening to facilitate rapid draining and flushing of the reservoir. The dump valve also preferably is normally open and has a spring return so that the valve automatically opens when power is removed from the valve. One such valve is BacoEng 1" DN25 2-Port Motorized Valve AC/DC 9-24 Volt.

Moving water is not conducive to microbial growth; rather, idle water provides favorable growth conditions for microorganisms. As a result, the reservoir tank(s) of the present application preferably have an auto-dump feature, wherein any water remaining in the tank at the end of the day is automatically and fully dumped to the sewer. Further, the auto-dump feature may be activated after the reservoir tank water has remained idle for a predetermined amount of time. In an embodiment, the predetermined amount of time is three or more hours. In an alternative embodiment, the auto-dump feature is activated where the temperature of the water in the reservoir tank falls below a pre-set temperature point. In an embodiment, the pre-set temperature is between about 20° C. to about 30° C., meaning the auto-dump feature is activated if the temperature of the water in the reservoir tank reaches between about 20-30° C. or lower.

In addition to an auto-dump feature, the reservoir tank may be equipped with both a conical bottom and scum skimmer. To maximize the positive effects of the auto-dump feature, the reservoir tank should fully drain. In an embodiment, the reservoir tank has a conical bottom with a dump valve located at the bottom of the cone, allowing all the water to drain and periodically flush debris that may settle in the tank. A fresh water valve and spray nozzle system is preferably used to flush debris from the sides and bottom of the tank and out of the dump valve. This is preferably done daily to prevent buildup of debris and bacteria. At the end of the day, the water reuse controller will signal the dump valve to open. After a set period of time (approximately 3 minutes), the tank will have been drained and the controller will then signal the fresh water valve to open, thus spraying fresh water onto the sides of the tank and out of the dump valve. The nozzle is preferably a tank washing nozzle which sweeps the sides of that tank. After a set period of time (approximately 2 minutes), the fresh water valve is closed and then the dump valve is closed. The dump valve and fresh water spray may also be activated manually for manual cleanouts of the reservoir.

In some laundry operations debris materials may also coalesce and rise to the top of the reservoir tank when the tank sits idle and cools. These materials may originate from laundry soils, cleaning compositions, and/or a combination of both. In an embodiment, soils at the top of the reservoir tank may be inexpensively and simply skimmed by a funnel-type overflow system. A funnel system and/or funnel shape may be installed close to the top level of the tank such that the water will periodically and repeatedly rise up to and slightly over the top of the funnel to cause floating materials to naturally flow into the funnel when the brim of the funnel overflows. The funnel is part of an overflow system that prevents the reservoir from filling up to and over the top of the reservoir. When large amounts of floating debris are found to occur, the controller can be programmed to frequently raise the water level up to the level of the funnel by activating the fresh water fill valve. The funnel size can range from 3" to several inches in diameter, depending on the size of the tank and the amount of floating debris encountered. The scum or floating debris then flows down into the funnel by gravity and is automatically flushed to sewer with periodic raising of the reservoir water level.

Water Pumps and Strainer

The reservoir tank is provided with one or more water pumps and optionally a strainer. In a preferred embodiment, a drain water pump sends water from the drain into the reservoir tank. In a further embodiment, the system further comprises one or more pumps to transfer water from one or more reservoirs back to the wash tank. The pump should be sufficient to prevent plugging and fouling of the pump with lint. To that end, the one or more pumps, and particularly the drain water pump, may further comprise a strainer system before the inlet to the pump to prevent large pieces of cloth and debris from entering the pump. In an embodiment, the pump is ½ horse power centrifugal pump that can deliver between 10-70 gallons per minute (gpm). In a preferred embodiment, the drain water pump can transfer water from the wash tank to one or more reservoirs at a rate of about 70 gpm. In a further embodiment, one or more pumps transferring water from the reservoir back to the wash tank may do so at a rate of preferably between about 10 to about 20 gpm, and more preferably about 15 gpm. In an embodiment, the strainer is a basket strainer that can filter out an accumulate large items that pass through the drain towards the pump. In a further embodiment, the basket strainer is preferably about 1 to about 2 liters in size and has approximately quarter-inch open areas in the basket.

Lint Screen

The water reuse system may further comprise a lint screen to remove lint from the rinse water before it enters the water tank. Lint is sticky, causing buildups and plugging in pipes and pumps; it also interferes with moving parts like float switches. In an embodiment, the application may include a lint shaker screen. However, such devices are large, expensive, and noisy. Surprisingly, the present application has found that lint buildup can be prevented by installing a lint screen at the entrance to the reservoir tank such that all the water entering the reservoir tank from the washer drain must pass through the screen. In an embodiment, the screen is tilted toward the edge of the tank such that lint will build up and roll off the screen as it builds up. In a further embodiment, the screen is tilted at an angle of between about 30° to about 60° relative to the plane of the reservoir tank. In a still further embodiment, the screen is tilted at an angle of about 45° relative to the plane of the reservoir tank. A garbage can or waste collection container may be placed at the edge of the screen to catch the lint. In an embodiment, the screen mesh size is 100×100, with an opening size of 0.0055", an open area of 30%, and a wire diameter of 0.0045. The installation of the lint screen in this manner eliminates the problem of lint buildup, with little or no maintenance required, and at a low cost.

Dispenser

A dispenser may be used to provide a cleaning composition which facilitates soil removal and/or antimicrobial efficacy. The dispenser may be any suitable dispenser, for example, a Solid System dispenser, a Navigator dispenser, an Aquanomics dispenser, and/or an SCLS dispenser, among others. In a preferred embodiment, the dispenser is an SCLS dispenser. The dispenser may be in fluid communication with the wash tank of a wash machine via tubing, an inlet valve, and one or more dispensing nozzles. Alternatively, or in addition to this configuration, the dispenser may be in fluid communication with a reservoir tank containing reuse water. In another embodiment, the dispenser may be in fluid communication with the outlet plumbing from the reservoir tank, thus injecting the composition into the fluid stream directly before it enters the wash tank. In still another embodiment, the dispenser delivers a cleaning composition into the reservoir pump which mixes and dissolves the composition before it then enters the wash tank. In another embodiment, the dispenser is a pellet or tablet dispenser that drops a pellet into the pump to be crushed in the pump, mixed and dissolved before then entering the wash tank. In another embodiment, the dispenser delivers a cleaning composition to the reservoir tank; the combination of the water and cleaning composition in the reservoir tank is then transferred back to the wash tank of the wash machine.

Antimicrobial Agent

In some circumstances it may be necessary to use an antimicrobial in the water reservoir to prevent microbial growth, particularly in warm/humid climates/laundry rooms and/or in environments were the reservoir tank would remain idle for longer periods of time. The application may include an ozone system, or UV light antimicrobial system. A preferred, and less expensive option would be to include an antimicrobial composition, either as an independent composition or as part of a cleaning composition used to remove soils from textiles during the normal wash cycle. Laundry bleaches that may be employed as antimicrobials include, but are not limited to, sodium hypochlorite, peroxyacetic acid, hydrogen peroxide, and/or a quaternary ammonium compound. Further, any antimicrobial agent described in this application as suitable for inclusion in a cleaning composition may be used either alone or as part of a cleaning composition. The antimicrobial agent may be administered directly into the reservoir tank. The antimicrobial agent and/or cleaning composition may also be administered into the wash tank and ultimately transferred into the reservoir tank. When administered, the concentration of antimicrobial agent will be dependent upon the agent employed and should be sufficient to prevent microbial growth. In an embodiment, the antimicrobial agent is sodium hypochlorite. In a further embodiment, the antimicrobial agent is preferably present in an amount of from about 5 ppm to about 200 ppm, and more preferably from about 50 ppm to about 150 ppm for microbial growth control.

Drain Diverter Valve

The water reuse system of the application preferably includes a drain diverter valve located upstream of the drain water pump but downstream of the outlet valve of the wash machine. The drain diverter valve directs water from the machine outlet valve through the drain water pump into the reservoir tank rather than out the exit pipe and into the sewer. The drain diverter valve may be controlled manually, or by a programmable controller. The drain diverter valve should be normally open when there is no power supplied to it and should be equipped with a spring return such that the valve automatically re-opens whenever power is removed for whatever reason.

Water Softener

To further facilitate soil removal efficacy, the system of the present application may be used in conjunction with a water softening device. Water softening mechanisms assist in removing ions, particularly calcium and magnesium ions, from hard water. Ions found in hard water can interfere with the detersive efficacy of a cleaning composition. Any suitable water softening device may be used, for example an ion exchange resin, lime dispensing devices, distillation, reverse osmosis, crystallization, and others. In an embodiment, a water softening device is used together with chelating agents, builders, sequestering agents, and/or water conditioning polymers in a cleaning composition. In an embodiment, the water softening device comprises an ion exchange resin. In a preferred embodiment, the ion exchange resin is a L-2000 XP ion exchange resin.

Each of the aforementioned components and features may be included optionally together with the reservoir tank and pump. One feature may be included with the reservoir tank and pump, or multiple features may be included. The number of features included will depend on the particular application and environment.

Water Recirculation Systems

In addition, or in alternative, to the water reuse system, the present application may comprise a spray kit for recirculating wash water. The spray kits described herein can be added to and modify an existing wash machine, i.e. as a retrofit kit. In other embodiments, the spray kits may be provided and sold as part of a new wash machine. Preferably, the kits comprise a replacement window, nozzle system, pump, tubing, and sump connector.

The replacement window is affixed to the door of the wash tank. The window has a hole made in the window; the hole can be located anywhere in the window. In a preferred embodiment the hole is drilled in the center or slightly above the center of the window. A notch is cut into the hole that matches up with a protrusion in the nozzle assembly. The notch helps prevent the nozzle from rotating when the linen rubs up against it during the wash cycle. The replacement window may be made out of any suitable material facilitating easy installation and modification, for example polycarbonate with a polyethylene cover on both faces of the window.

The nozzle system is secured in the replacement window and is in fluid communication with the wash tank and pump. The nozzle system comprises one or more nozzles and one or more nozzle connecters. The one or more nozzles are configured to spray water at an angle such that it sprays on top of the textiles and at a spray angle wide enough to cover 60% of the width of the load. Further, the one or more nozzles have rounded edges, so the textiles do not get abraded, hung-up, or otherwise snared on the nozzle inside the wash tank. The one or more nozzles are in fluid communication with tubing via the one or more nozzle connecters. The one or more nozzle connecters are secured tightly to the replacement window and door, and do not have any sharp edges so as to prevent the textiles from catching or snaring when the textiles are loaded or unloaded from the wash machine.

The pump used in conjunction with the nozzle system may be any suitable pump that has the ability to function in the presence of lint without becoming plugged internally and can effectively recirculate and spray a cleaning composition onto linens in the machine. In an embodiment, the pump used with the nozzle system is the pump provided with the wash machine. In another embodiment, the pump used with the nozzle system is the drain water pump of the water reuse system. In a still other embodiment, the pump used with the nozzle system is provided solely to move water through the nozzle system. In an embodiment, the pump is a centrifugal pump. In a preferred embodiment, the pump Laing Thermotech E5-NSHNNN3 W-14, having a voltage of 100 to 230 VAC, and 1/25 HP. The pump preferably pumps at a rate of from about 2 gpm to about 10 gpm, preferably between about 2 gpm to about 8 gpm, more preferably from about 4 gpm to about 6 gpm. In a preferred embodiment, the pump is configured to provide a flow rate of 3.2 gpm. The pump rate should facilitate a strong, steady flow and even distribution of water, but should not be so fast that the sump would run empty before the water and cleaning composition can return to the sump.

The tubing (and related nozzle connectors) should be configured to avoid lint buildup. In particular, the tubing and connectors preferably have smooth inner walls and are configured around and in the wash machine to have gradual turns. In other words, right-angled connectors and tubing turns should be avoided.

The sump connector parts comprise connection parts required to connect the pump and tubing to the sump. The recirculation kit of the application will apply to many different machines, and as such these different machines will require different connector parts to connect the pump and tubing to the sump. Many machines have a connection area built into the sump; however other machines do not have such connection points on the sump. In such a case, the sump connector kit will provide a way to connect to the drain assembly of the machine; connection parts would be provided to connect to a point in the drain pipe at a location before the machine outlet valve. The kit may be further equipped with a quarter turn valve, or any other type of appropriate valve to control flow through the nozzle.

Control Systems

The present application may comprise one or more control systems for regulating water recirculation, water reuse, and/or water levels in the wash tank during the wash cycle.

In an embodiment, the one or more control systems comprises an industrial control system. Any suitable industrial control system may be used according to the present application, including but not limited to programmable logic controllers (PLCs), distributed control systems (DCS), and/or supervisory control and data acquisition (SCADA).

In a preferred embodiment the industrial control system comprises one or more PLCs. PLCs may comprise a power supply and rack, central processing unit (CPU), memory, and a plurality of input/output ("I/O") modules having I/O connection terminals. PLCs are ordinarily connected to various sensors, switches, or measurement devices that provide inputs to the PLC and to relays or other forms of output to control the controlled elements. The one or more PLCs according to the present application may be modular and/or integrated types. In a preferred embodiment, the PLC receives inputs corresponding to two conditions: a low level/low voltage condition and a high level/high voltage condition. In this embodiment, the low voltage condition is head pressure created by water in the wash wheel and the input device for this condition is a pressure transducer. Further, in this embodiment, the high voltage condition is a plurality of mechanical and/or chemical signals, particularly activation of the cold water fill valve, activation of the hot water fill valve, the beginning of the ULL fill step, or the beginning of the normal fill step. In an embodiment, the output signal comprises one or more mechanisms for controlling water levels as described herein, e.g. a plurality of valves, a peristaltic pump, etc.

In a still further preferred embodiment, the methods and systems of the present application use a PLC and transducer in conjunction with a Unimac IO board and a series of three valves. These components are connected by pressure tubing, preferably in sequence beginning with the wash tank, the PLC and transducer, valve 1, the Unimac IO board, valve 2, and then valve 3. According to a preferred method of artificially suppressing water levels, the aforementioned chemical signals occur, the PLC reads the occurrence of a normal fill signal, and IO board signals valve 2 to open. The washer then stops filling, so the IO board signals the closing of valve 2 to trap pressure. Then, in the next cycle, the PLC reads ULL signal, and so valve 1 is closed. When ULL is achieved, valve 2 is opened to inject pressure. The wash machine washes at ULL for 5 minutes and opens valve 3. The machine then waits for 5 seconds and closes valve 2. The machine then waits for one second, opens valve 1 and closes valve 3. Finally, the machine resumes normal operation.

In a further embodiment, the systems of the present application are alternatively or additionally part of a DCS. In this embodiment, one or more wash machines according to the present application are connected to DCS and maintain continuous communications with operating PCs through, for example, a high speed communication network or bus.

In a still further embodiment, the systems of the present application are additionally controlled via a SCADA system, comprising one or more supervisory computers communicating with, for example, the aforementioned PLCs, remote terminal units (RTUs), a communication infrastructure, and a human-machine interface (HMI).

In an embodiment, the one or more control systems comprises a printed circuit board, including but not limited to a single sided PCB, a double sided PCBs, multilayer PCBs, rigid PCBs, flex PCBs, and/or rigid-flex PCBs. PCBs generally comprise a power source, one or more resistors, one or more transistors, one or more capacitors, one or more inductors, one or more diodes, switches, a quad operational amplifier (op-amp), and/or light emitting diodes (LEDs). In a preferred embodiment a printed circuit board according to the present application comprises a DC/DC converter, a pressure transducer a quad op-amp, two 210 kΩ resistors and two 1.02 kΩ resistors.

Where the one or more control systems comprises memory, the memory includes, in some embodiments, a program storage area and a data storage area. The program storage area and the data storage area can include combinations of different types of memory, such as read-only memory ("ROM", an example of non-volatile memory, meaning it does not lose data when it is not connected to a power source), random access memory ("RAM", an example of volatile memory, meaning it will lose its data when not connected to a power source) Some examples of volatile memory include static RAM ("SRAM"), dynamic RAM ("DRAM"), synchronous DRAM ("SDRAM"), etc. Examples of non-volatile memory include electrically erasable programmable read only memory ("EEPROM"), flash memory, a hard disk, an SD card, etc. In some embodiments, the processing unit, such as a processor, a microprocessor, or a microcontroller, is connected to the memory and executes software instructions that are capable of being stored in a RAM of the memory (e.g., during execution), a ROM of the memory (e.g., on a generally permanent basis), or another non-transitory computer readable medium such as another memory or a disc.

Further, where the one or more control systems include a power supply, it will be generally understood that the power supply outputs a particular voltage to a device or component or components of a device. The power supply could be a DC power supply (e.g., a battery), an AC power supply, a linear regulator, etc. The power supply can be configured with a microcontroller to receive power from other grid-independent power sources, such as a generator or solar panel.

With respect to batteries, a dry cell battery or a wet cell battery may be used. Additionally, the battery may be rechargeable, such as a lead-acid battery, a low self-discharge nickel metal hydride battery (LSD-NiMH) battery, a nickel—cadmium battery (NiCd), a lithium-ion battery, or a lithium-ion polymer (LiPo) battery. Careful attention should be taken if using a lithium-ion battery or a LiPo battery to avoid the risk of unexpected ignition from the heat generated by the battery. While such incidents are rare, they can be minimized via appropriate design, installation, procedures and layers of safeguards such that the risk is acceptable.

The power supply could also be driven by a power generating system, such as a dynamo using a commutator or through electromagnetic induction. Electromagnetic induction eliminates the need for batteries or dynamo systems but requires a magnet to be placed on a moving component of the system.

The power supply may also include an emergency stop feature, also known as a "kill switch," to shut off the machinery in an emergency or any other safety mechanisms known to prevent injury to users of the machine. The emergency stop feature or other safety mechanisms may need user input or may use automatic sensors to detect and determine when to take a specific course of action for safety purposes.

The one or more controllers of the present application may further comprise a control circuit box. The control circuit box is preferably water tight. The control circuit box protects the PLC (or other comparable control system), relays, and wire connectors.

In a further embodiment, the one or more control systems are provided as part of a controller kit comprising one or more controller systems, a transducer, pressure tubing, and one or more mechanisms for controlling water levels as described herein, e.g. a plurality of valves, a peristaltic pump, etc.

Examples of Systems for Recirculating and Reusing Water

FIG. 1 is a schematic of a wash machine 22 having a recirculation kit 20 according to a preferred embodiment with a kit as described herein. In particular, the wash machine 22 comprises a wash door 24 which swings open to allow the loading and removal of articles to be washed or dried. In FIG. 1, the wash door 24 has a replacement window 28 located in the wash door 24, preferably at the center of the wash door 24. The nozzle system 26 has been installed and sealed in an aperture in the center of the replacement window 28. Tubing 30 attached to the connectors of the nozzle system 26 and a valve 34 allow the nozzle system 26 to distribute recirculated wash water into the wash machine 22.

Figure 2:
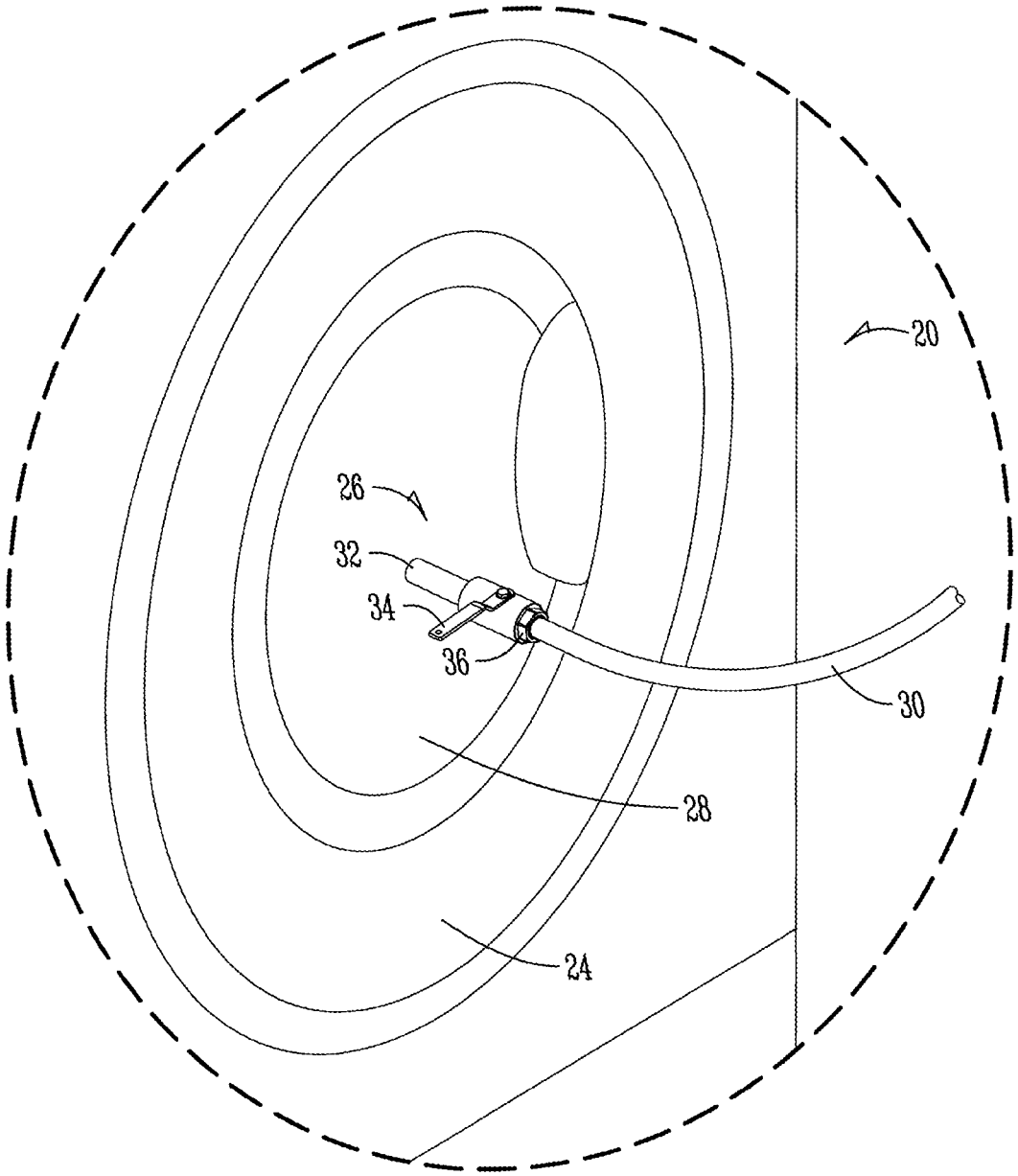
FIG. 2 is a closer view of the nozzle system as described in FIG. 1, as part of a modified wash machine.

FIG. 2 is a closer view of a recirculation kit 20 according to the present application. In particular, recirculation kit 20 has a wash door 24 which swings open to allow the loading and removal of articles to be washed or dried. In FIG. 2, the wash door 24 has a replacement window 28 located in the wash door 24. The nozzle system 26 comprises a hollow body having a central bore 32, a valve 34 which is preferably a shutoff valve, a connector 36 and tubing 30 which puts the hollow body having a central bore 32, valve 34 and connector 36 in fluid communication with the recirculated wash water in order to distribute the recirculated wash water back into the wash machine 22.

Figure 3:
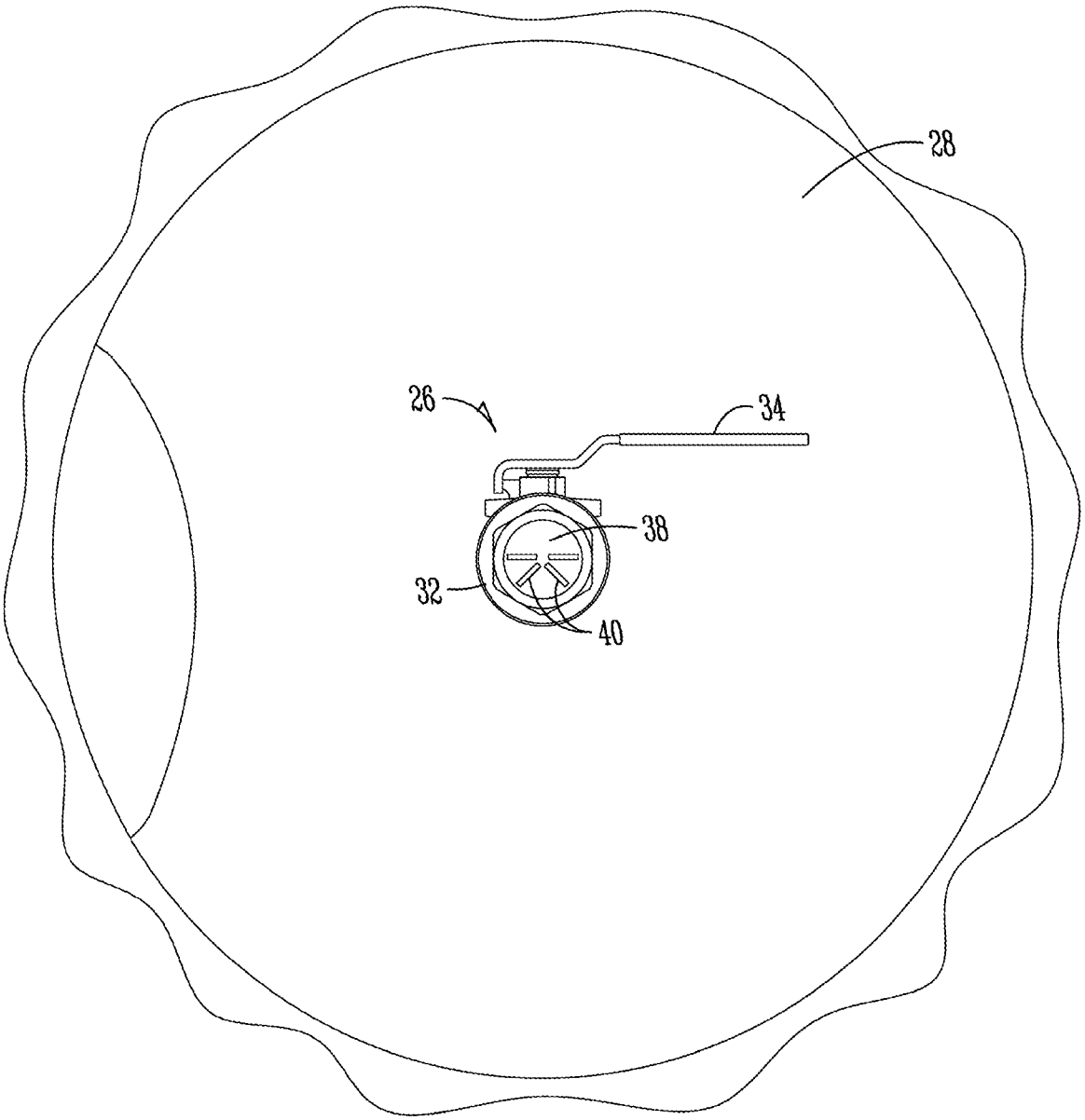
FIG. 3 is a schematic of the nozzle head of the nozzle system, applied as part of a modified wash machine showing a plurality of slits on the tip of the nozzle, which allow the even distribution of wash water and/or cleaning compositions into the wash machine.

FIG. 3 is a schematic of a preferred valve 34 and nozzle head 38 of the hollow body having a central bore 32. The nozzle head 38 and nozzle system 26 as a whole are positioned in an aperture in the center of the replacement window 28. The nozzle head 38 is characterized by a plurality of slits 40. The nozzle head may have from about 2 to about 8 slits. The plurality of slits 40 may be oriented in any suitable manner (e.g. in a linear orientation, in a staggered orientation, etc.), but are preferably oriented radially around the center of the nozzle head 38. In a preferred embodiment, the plurality of slits 40 are positioned radially around the center of the nozzle head 38 at an angle of no more than 180°.

Figure 4:
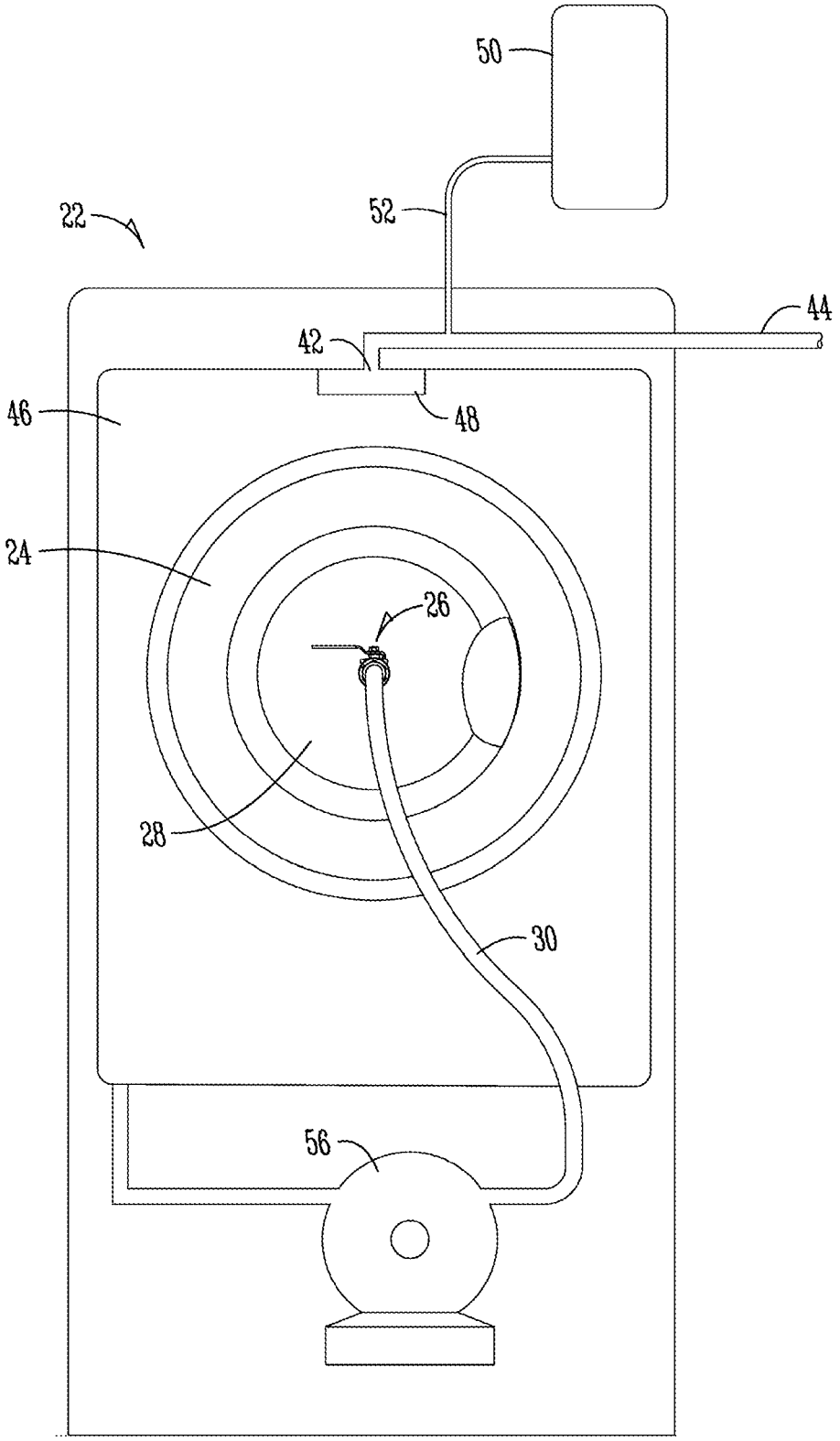
FIG. 4 is a flow diagram of a preferred embodiment of a recirculation kit as part of a modified wash machine where the wash machine does not have a reservoir tank for reusing rinse water.

FIG. 4 is a schematic view of a preferred embodiment of a recirculation kit 20 integrated into a wash machine 22 according to the present application. When a cycle is started, water flows in via the supply line 44 and enters the wash tank 46 through the water input valve 42 and dispenser nozzle 48. The water entering the wash tank 46 is combined with a cleaning composition provided from the dispenser 50. The cleaning composition is in fluid communication with the input valve 42 via dispenser tubing 52, allowing the dispenser nozzle 48 to distribute water and/or a cleaning composition in the wash tank 46. After the cycle is complete, the rinse water exits the wash tank 46 and passes through a recirculation pump 56, where it may be recirculated back into the wash tank 46 through the nozzle system 26 of the recirculation kit 12. In a preferred embodiment, the recirculation kit 12 recirculates the wash water continuously from the wash tank sump (not shown) and back to the wash tank 46 during the wash phase or other phases of the wash cycle. More specifically, wash water is recaptured through tubing 30 in fluid communication with the recirculation pump 56 and nozzle system 26. The nozzle system 26 penetrates through the replacement window 28 in the wash door 24, allowing the nozzle system 26 to recirculate and evenly distribute wash water onto textiles in the wash tank 46 during the wash cycle, improving the water/linen contact and enabling effective cleaning with lower water levels (i.e., less water) in the wash tank.

Figure 5:
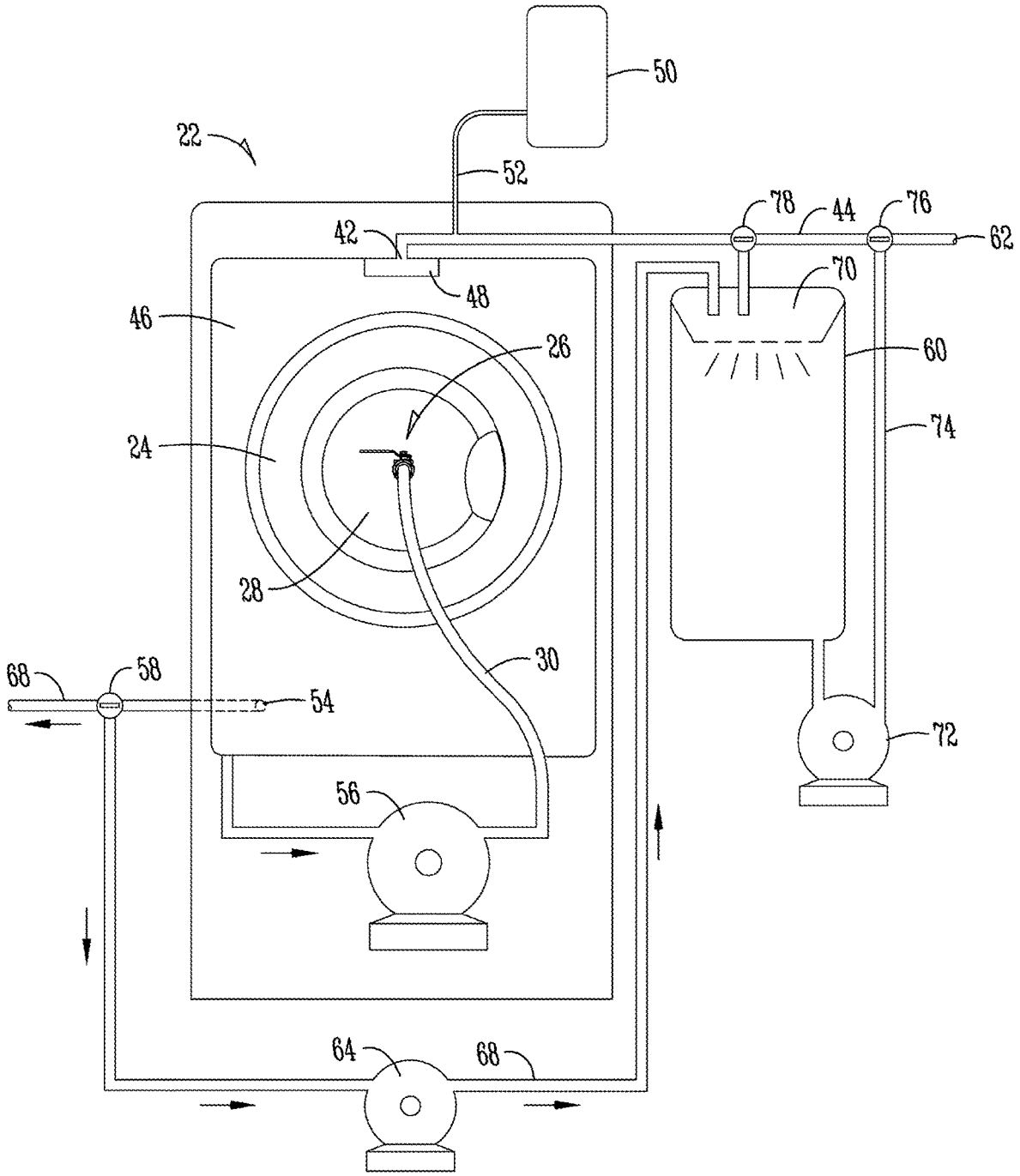
FIG. 5 is a schematic view of an embodiment of the water reuse system and water recirculation system of the present application as part of a wash machine, wherein the water reuse system comprises one reservoir tank located to the side of the wash machine.

FIG. 5 is a schematic view of an embodiment of the water recirculation and rinse water reuse systems of the present application as part of a wash machine 22, where the wash machine 22 has the ability to reuse rinse water via a reservoir tank 60 located to the side of the wash machine 22. In such a case, the water reuse system further improves the efficiency of the water utilization during a wash cycle. When a cycle is first started, water flows in through a water valve 62 for hot and/or cold water to the supply line 44 and enters the wash tank 46 through the input valve 42 and dispenser nozzle 48. The water entering the wash tank 46 may be combined with a cleaning composition provided from the dispenser 50. The cleaning composition is in fluid communication with the input valve 42 and dispenser nozzle 48 via dispenser tubing 52, allowing the dispenser nozzle 48 to distribute water and/or a cleaning composition in the wash tank 46. During a wash phase, bleach phase, or rinse phase of the wash cycle, a recirculation pump 56 can be activated to recirculate the water to and from the wash tank 46. Depending on whether the phase is the wash phase or the rinse phase, the wash water or rinse water, respectively, exits the wash tank 46 through the machine outlet valve 54 and through one of two exit ports of the diverter valve 58. If the water is rinse water to be reused, the water exits the wash tank 46, and is directed out the exit port to a centrifugal pump 64 via tubing 68 optionally through a lint screen 70 and into the reservoir tank 60. The water in the reservoir tank may be returned to the wash tank 46 through a reservoir pump 72 which moves water through tubing 74 and a diverter valve 76 to the supply line 44, which transfers the water through the inlet valve 42 and dispenser nozzle 48 to the wash tank 46. It should be understood that the reservoir tank 60 can be further equipped with tubing, valves, and other equipment as needed to connect the reservoir tank 60 to the drain 66, such that the reservoir tank 60 may be dumped. Further, in some embodiments, fresh water may be added directly to the reservoir tank via a diverter valve 78 in fluid communication with the hot and/or cold water valve 62 and the reservoir tank 60. Where wash water and/or rinse water are not used for recirculation and/or reuse, the water passes through the diverter valve 58 and exit port leading to the drain (not shown). As an alternative to this process, rinse water from the reservoir tank 60 may be used at the beginning of the cycle. When rinse water from the reservoir tank 60 is used at the beginning of the cycle, water from the hot and/or cold water valve 62 may also be selectively directed to the wash tank.

Figure 6:
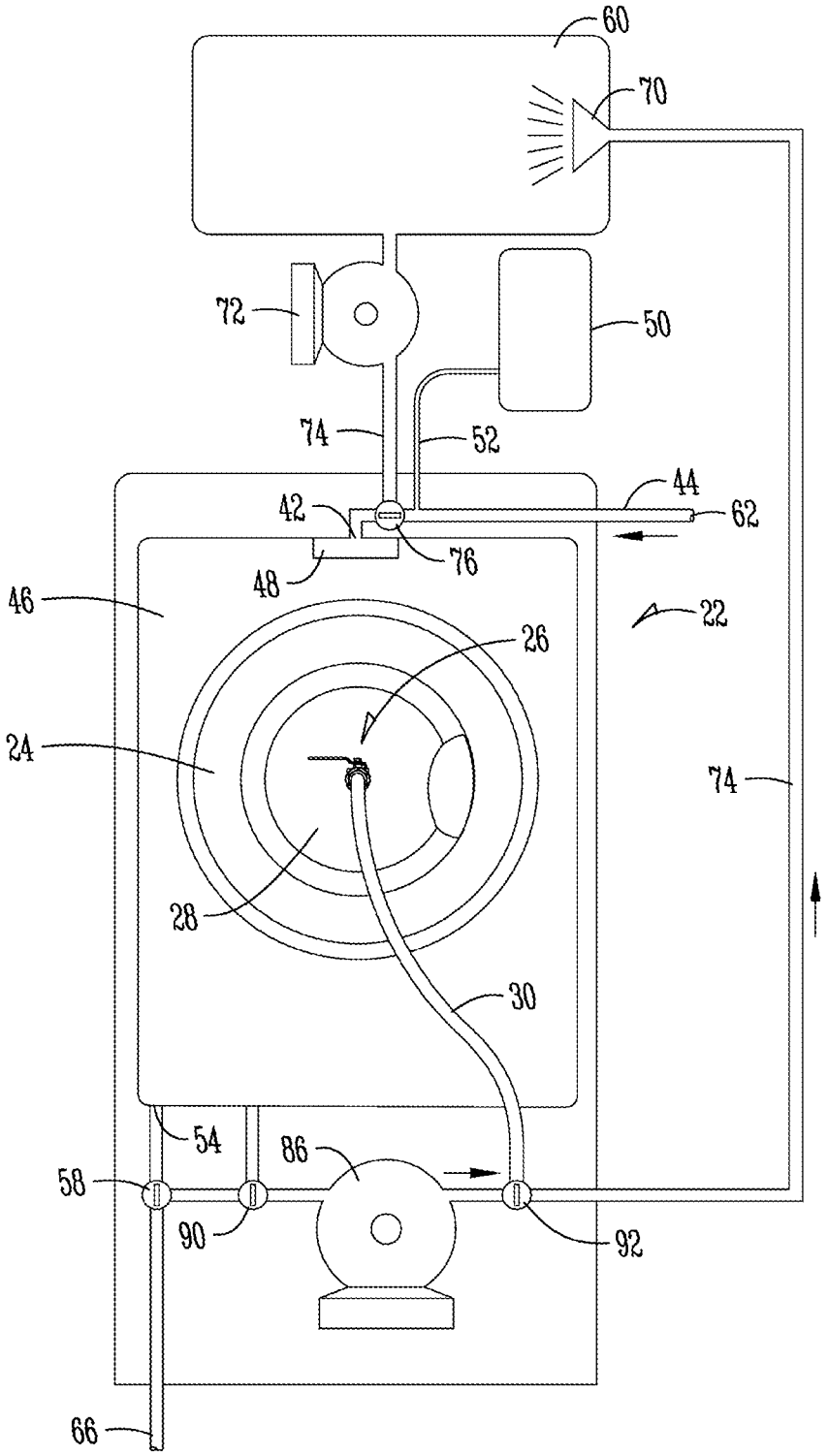
FIG. 6 is a schematic view of an embodiment of the water reuse system and water recirculation system of the present application as part of a wash machine, wherein the water reuse system comprises one reservoir tank located above the wash machine.

FIG. 6 is a schematic view of the water recirculation and reuse systems of the present application as part of a wash machine 22, where the wash machine 22 has the ability to reuse rinse water via a reservoir tank 60 located above the wash machine 22 and has the ability to recirculate wash water while utilizing the drain water pump 86, which is already a feature of standard wash machines. As such, the water recirculation and reuse systems of the present application may optionally be added onto existing wash machines.

When a cycle is first started, water flows in through a hot and/or cold water valve 62 to the supply line 44 and enters the wash tank 46 through the input valve 42 and dispenser nozzle 48. The water entering the wash tank 46 may be combined with a cleaning composition provided from the dispenser 50. The cleaning composition is in fluid communication with the input valve 42 and dispenser nozzle 48 via dispenser tubing 52, allowing the dispenser nozzle 48 to distribute water and/or a cleaning composition in the wash tank 46. If the water is wash water to be recirculated using the recirculation kit 20, the water exits the wash tank 46 via the diverter valve 90, and is moved by the drain water pump 86 to another diverter valve 92 and then back into the wash tank via tubing 30 and the nozzle system 26.

Water may also be recirculated using the reservoir tank 60 or dumped into the drain 66. Accordingly, depending on whether the phase is the wash phase or the rinse phase, the wash water or rinse water, respectively, exits the wash tank 46 through the machine outlet valve 54 and through one of two exit ports of the diverter valves 58 and 90. Specifically, if the water is rinse water to be reused, the water exits the wash tank 46, is directed to the diverter valve 90 and is moved by the drain water pump 86 via tubing 74 into the reservoir tank 60. The rinse water may be optionally passed through a lint screen 70. The water in the reservoir tank may be returned to the wash tank 46 through a reservoir pump 72 which moves water through tubing 74 and a diverter valve 76 to the supply line 44, which transfers the water through the inlet valve 42 and dispenser nozzle 48 to the wash tank 46. It should be understood that the reservoir tank 60 can be further equipped with tubing, valves, and other equipment as to allow the reservoir tank 60 to be dumped into the drain 66 and/or receive fresh water from the hot and/or cold water valve 62. Where wash water and/or rinse water are not used for recirculation and/or reuse, the water passes through the machine outlet valve 54 and diverter valve 58 to the drain 66.

Beneficially, according to the configuration of the reuse system in FIG. 6 (where the reservoir tank 60 is located above the wash tank 46), the reservoir pump 72 is optional. In addition, or in alternative to using the reservoir pump 72, gravity may be used to move water from the reservoir tank 60 into the wash tank 46. Thus, the configuration of the reuse system according to FIG. 6 not only maintains the footprint of the original wash machine, but it also eliminates the need for an additional pump, thus reducing operational costs further.

Figure 7:
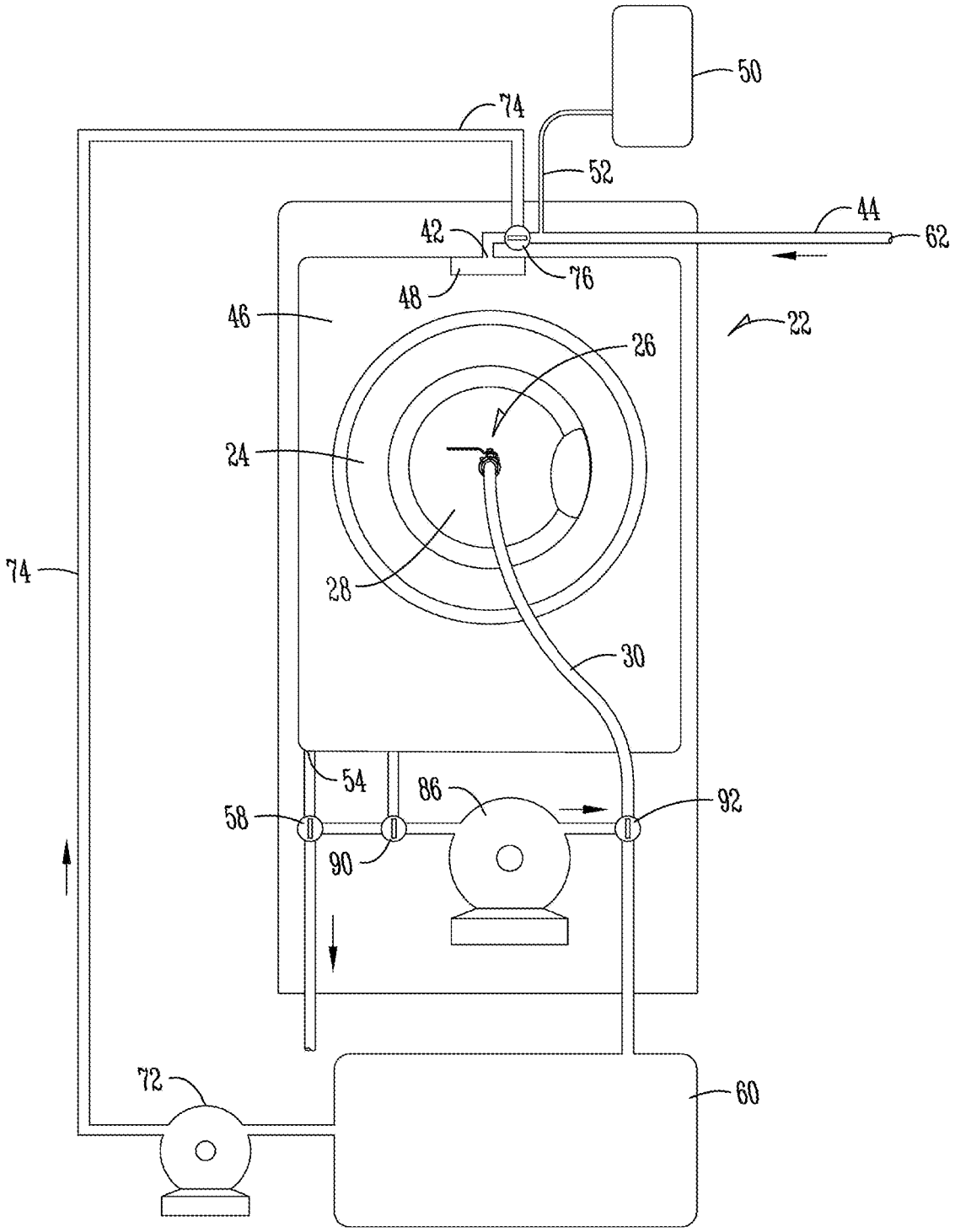
FIG. 7 is a schematic view of an embodiment of the water reuse system and water recirculation system of the present application as part of a wash machine, wherein the water reuse system comprises one reservoir tank located below the wash machine.

FIG. 7 is a schematic view of the water recirculation and rinse water reuse systems of the present application as part of a wash machine 22, where the wash machine 22 has the ability to reuse rinse water via a reservoir tank 60 located below the wash machine 22 and has the ability to recirculate wash water while utilizing the drain water pump 86. When a cycle is first started, water flows in through a hot and/or cold water valve 62 to the supply line 44 and enters the wash tank 46 through the input valve 42 and dispenser nozzle 48. The water entering the wash tank 46 may be combined with a cleaning composition provided from the dispenser 50. The cleaning composition is in fluid communication with the input valve 42 and dispenser nozzle 48 via dispenser tubing 52, allowing the dispenser nozzle 48 to distribute water and/or a cleaning composition in the wash tank 46. If the water is wash water to be recirculated using the recirculation kit 20, the water exits the wash tank 46 via the diverter valve 90, and is moved by the drain water pump 86 to diverter valve 92 and then back into the wash tank via tubing 30 and the nozzle system 26.

Water may also be recirculated using the reservoir tank 60 or dumped into the drain (not shown). Accordingly, depending on whether the phase is the wash phase or the rinse phase, the wash water or rinse water, respectively, exits the wash tank 46 through the machine outlet valve 54 and through one of two exit ports of the diverter valve 58 and 90. If the water is rinse water to be reused, the water exits the wash tank 46 via the diverter valve 90, is moved by the drain water pump 86 through an additional diverter valve 92 and into the reservoir tank 60. The water in the reservoir tank may be returned to the wash tank 46 through a reservoir pump 72 which moves water through tubing 74 and a diverter valve 76 to the supply line 44, which transfers the water through the inlet valve 42 and dispenser nozzle 48 to the wash tank 46. It should be understood that the reservoir tank 60 can be further equipped with tubing, valves, and other equipment so as to allow the reservoir tank 60 to be dumped into the drain and/or receive fresh water from the hot and/or cold water valve 62. Where wash water and/or rinse water are not used for recirculation and/or reuse, the water passes through the diverter valve 58 to the drain.

Figure 8:
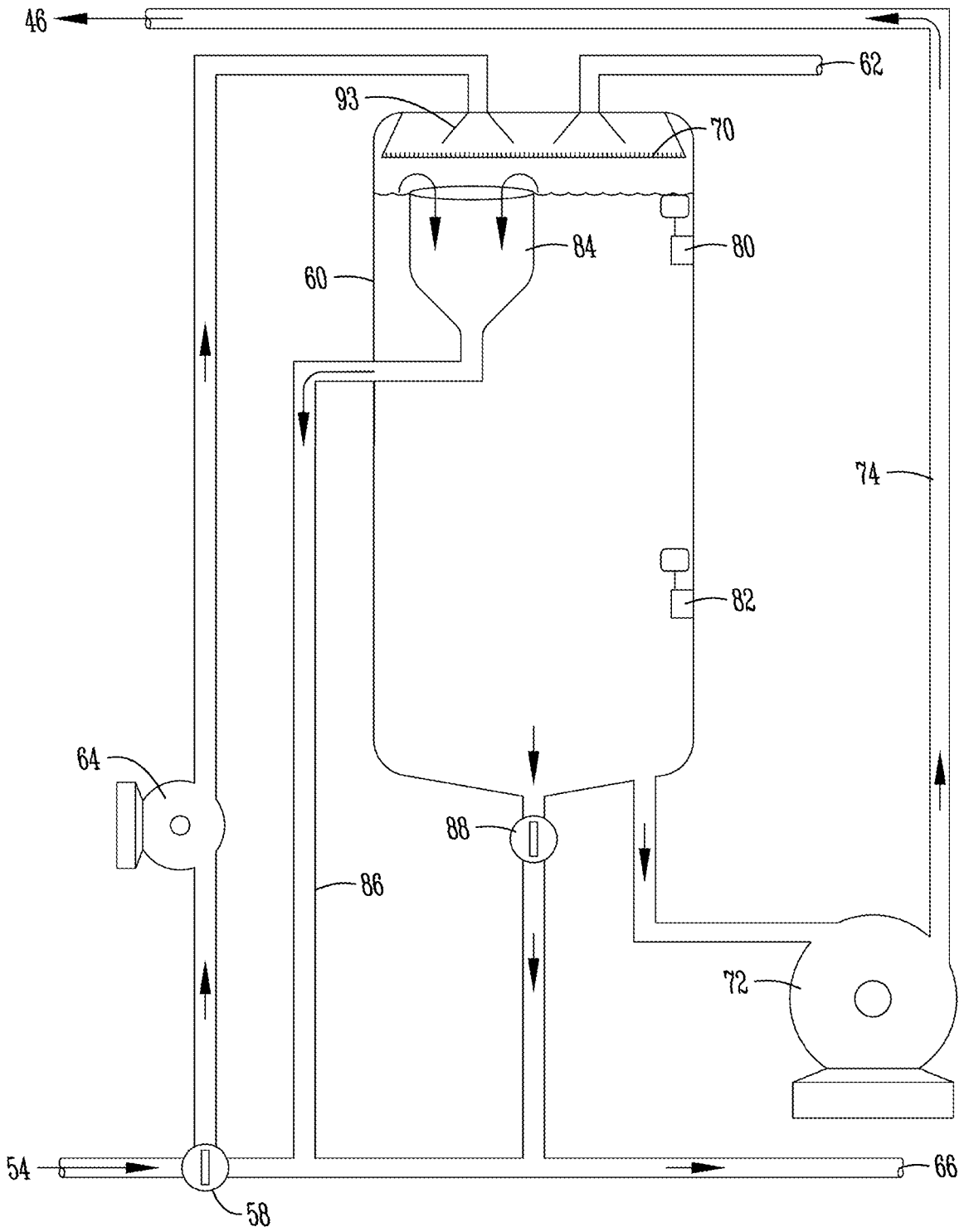
FIG. 8 is a schematic view of a reservoir tank having a skimmer funnel, conical tank, and tank washing nozzle for easy cleaning and draining of the reservoir.
Figure 9:
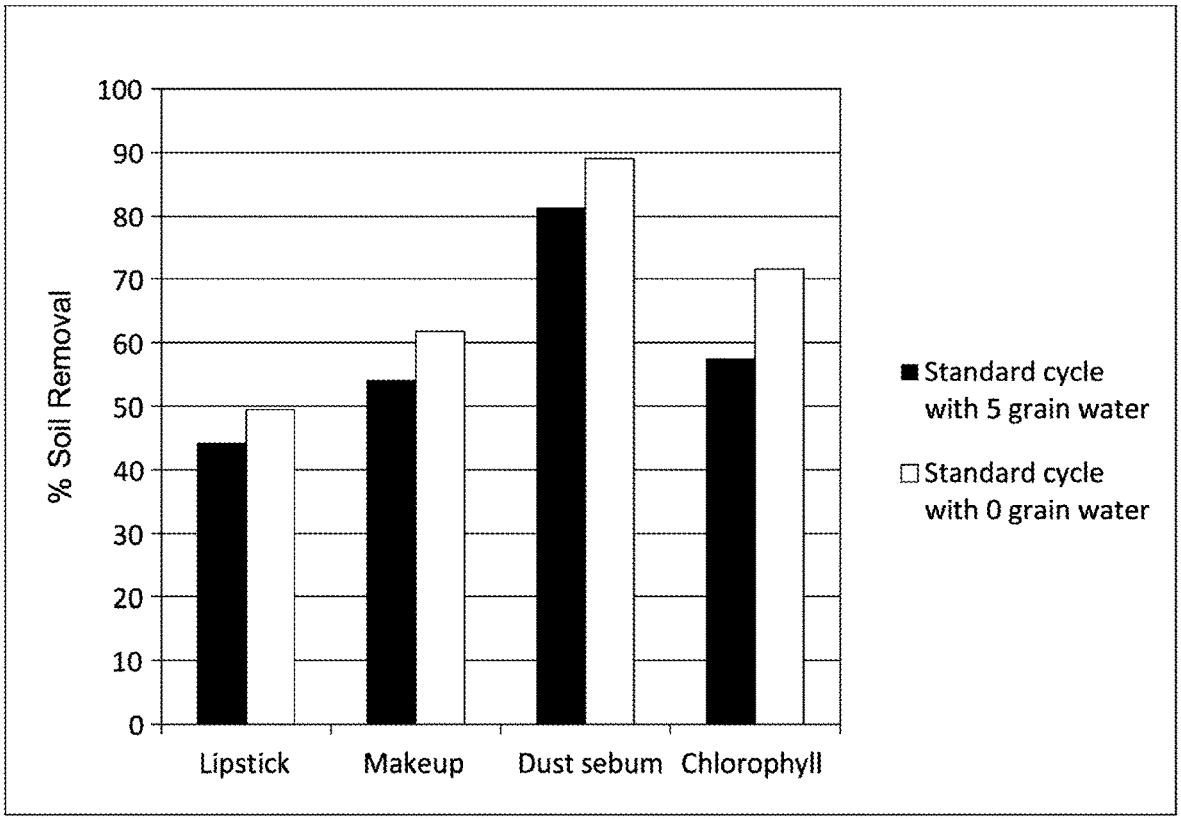
FIG. 9 shows the effect of an ion exchange resin on soil removal efficacy.

FIG. 8 is a schematic of a reservoir tank 60 according to the reuse systems of the present application. According to this system, water approaches the diverter valve 58 from machine outlet valve 54 and is either directed to the reservoir tank 60 or dumped out the drain 66. It should be understood that additional tubing, valves, or other equipment may be positioned between the machine outlet valve 54 or the diverter valve 58 and the reservoir tank 60 based on the relative positioning of the reservoir tank 60 and the wash machine 22 and also the particular application or use of the wash machine 22.

When the water from the diverter valve 58 is directed to the reservoir tank 60, a centrifugal pump 64 may be optionally used to pump the water into the reservoir tank 60. The water may optionally be passed through a lint screen 70 or other filtration device. In some embodiments, the reservoir tank is equipped with a skimmer funnel 84, which beneficially skims the surface of the reuse water as the reservoir tank 60 fills, thus removing materials and/or debris accumulating on top of the water in the reservoir tank 60. The skimmer funnel 84 has an overflow line 94 that removes the collected materials and/or debris to the sewer drain 66. The reservoir tank 60 may be further equipped with floats to monitor the water level in the reservoir tank 60. In particular, the reservoir tank 60 may comprise a low water level float 82 and a high water level float 80. Additionally, the reservoir tank 60 may be equipped to receive fresh water from a hot and/or cold water valve 62. The fresh water preferably enters the reservoir tank through one or more tank washing nozzles 93 that help to wash debris from the sides of the reservoir tank 60 whenever fresh water is added to the tank and/or during periodic tank cleanouts. The reservoir tank 60 is preferably conically shaped and has a dump valve 88 that connects to the drain 66, thus allowing the reservoir tank 60 to be dumped manually and/or automatically. When reuse water is not dumped, the water in the reservoir tank may be returned to the wash tank 46 through a reservoir pump 72 which moves water through tubing 74 to the wash tank 46.

It should be understood that the Figures are mere examples of ways the recirculation and reuse systems can be adapted to an existing wash machine. Thus, the foregoing description has been presented for purposes of illustration and description and is not intended to be an exhaustive list or to limit the application to the precise forms disclosed.

Cleaning Compositions

The methods of cleaning employing the kits described herein can include cleaning compositions which are distributed into the wash tank of a wash machine either through the recirculation of wash water, through the water reuse reservoir or tubing, as provided directly into a wash tank from a dispenser, and/or as diluted by tap water to form a use solution and subsequently provided to a wash tank. The concentrated cleaning composition may comprise a detergent according to Table 1.

TABLE 1

| Raw Material | Composition A (wt. %) | Composition B (wt. %) |
|---|---|---|
| Alkalinity Source | 15-35 | 15-35 |
| Surfactant(s) | 8-20 | 8-20 |
| Anti-Redeposition Agent(s) | 0.5-10 | 1-9 |
| Chelant(s) | 0-20 | 6-15 |
| Water/Inert Solids | 40-65 | 35-65 |
| Additional Functional Ingredients | 0-35 | 0-25 |

When present, the cleaning compositions of Table 1 may be provided in a variety of doses. The compositions may be provided preferably at a concentration of about 4-10 oz/100 lb. textiles, more preferably between about 6-7 oz/100 lb. textiles.

Alkalinity Source

The cleaning compositions employed in the apparatuses and kits described herein can include an alkalinity source. The alkalinity source includes a carbonate-based alkalinity source. Suitable carbonates include alkali metal carbonates (including, for example, sodium carbonate and potassium carbonate), bicarbonate, sesquicarbonate, and mixtures thereof s. Use of a carbonate-based alkalinity source can assist in providing solid compositions, as the carbonate can act as a hydratable salt.

The alkalinity source can be present in amount that provides a pH greater than about 7 and up to about 11; preferably between about 8 and about 10.5, more preferably between about 8.5 and about 10. A pH that is too high can cause negative interactions with other components of the cleaning composition, e.g. enzymes, can damage certain types of laundry and/or require the use of personal protective equipment. However, use of a pH that is too low will not provide the desired cleaning efficacy and damage laundry.

Embodiments of the composition can include a secondary alkalinity source. Suitable secondary alkalinity sources can include alkanol amines, alkali metal hydroxides, alkaline metal hydroxides, silicates, and mixtures thereof. Phosphate-based alkalinity use to be common; however, it is not preferred due to environmental concerns.

Suitable alkanolamines include triethanolamine, monoethanolamine, diethanolamine, and mixtures thereof.

Suitable hydroxides include alkali and/or alkaline earth metal hydroxides. Preferably, a hydroxide-based alkalinity source is sodium hydroxide. The alkali or alkaline earth metals include such components as sodium, potassium, calcium, magnesium, barium and the like. In some embodiments of the application, the entire method of cleaning can be substantially free of hydroxide-based alkalinity sources.

Suitable silicates include metasilicates, sesquisilicates, orthosilicates, and mixtures thereof. Preferably the silicates are alkali metal silicates. Most preferred alkali metal silicates comprise sodium or potassium.

The alkalinity source can be present in the cleaning composition in an amount of from about 10 wt. % to about 40 wt. %; preferably from about 15 wt. % to about 35 wt. %; and most preferably from about 15 wt. % to about 30 wt. %.

Enzyme

The cleaning compositions employed can include an enzyme. Enzymes can aid in the removal of soils, including in particular proteinaceous and starchy soils. Selection of an enzyme is influenced by factors such as pH-activity and/or stability optima, thermostability, and stability with the active ingredients, e.g., alkalinity source and surfactants. Suitable enzymes include, but are not limited to, protease, lipase, mannase, cellulase, amylase, or a combination thereof.

Protease enzymes are particularly advantageous for cleaning soils containing protein, such as blood, cutaneous scales, mucus, grass, food (e.g., egg, milk, spinach, meat residue, tomato sauce), or the like. Additionally, proteases have the ability to retain their activity at elevated temperatures. Protease enzymes are capable of cleaving macromolecular protein links of amino acid residues and convert substrates into small fragments that are readily dissolved or dispersed into the aqueous use solution. Proteases are often referred to as detersive enzymes due to the ability to break soils through the chemical reaction known as hydrolysis. Protease enzymes can be obtained, for example, from *Bacillus subtilis, Bacillus licheniformis* and *Streptomyces griseus*. Protease enzymes are also commercially available as serine endoproteases.

Examples of commercially-available protease enzymes are available under the following trade names: Esperase, Purafect, Purafect L, Purafect Ox, Everlase, Liquanase, Savinase, Prime L, Prosperase and BlaP.

The enzymes employed may be an independent entity and/or may be formulated in combination with the detergent compositions. According to an embodiment, an enzyme composition may be formulated into the detergent compositions in either liquid or solid formulations. In addition, enzyme compositions may be formulated into various delayed or controlled release formulations. For example, a solid molded detergent composition may be prepared without the addition of heat. Enzymes tend to become denatured by the application of heat and therefore use of enzymes within detergent compositions require methods of forming a detergent composition that does not rely upon heat as a step in the formation process, such as solidification. Enzymes can improve cleaning in cold water wash conditions. Further, cold water wash conditions can ensure the enzymes are not thermally denatured.

In an embodiment, two or more enzymes are included in the cleaning composition.

The enzyme composition may further be obtained commercially in a solid (i.e., puck, powder, etc.) or liquid formulation. Commercially available enzymes are generally combined with stabilizers, buffers, cofactors and inert vehicles. The actual active enzyme content depends upon the method of manufacture, such methods of manufacture may not be critical to the methods described herein.

Alternatively, the enzyme composition may be provided separate from the detergent composition, such as added directly to the wash liquor or wash water of a particular application of use, e.g., laundry machine or dishwasher.

Additional description of enzyme compositions suitable for use are disclosed for example in U.S. Pat. Nos. 7,670,549, 7,723,281, 7,670,549, 7,553,806, 7,491,362, 6,638,902, 6,624,132, and 6,197,739 and U.S. Patent Publication Nos. 2012/0046211 and 2004/0072714, each of which are herein incorporated by reference in its entirety. In addition, the reference "Industrial Enzymes," Scott, D., in Kirk-Othmer Encyclopedia of Chemical Technology, 3rd Edition, (editors Grayson, M. and Eckroth, D.) Vol. 9, pp. 173-224, John Wiley & Sons, New York, 1980 is incorporated herein in its entirety.

The enzyme or enzymes can be present in the cleaning composition in an amount of from about 3 wt. % to about 20 wt. %; preferably from about 4 wt. % to about 18 wt. %; and most preferably from about 4 wt. % to about 12 wt. %.

Enzyme Stabilizing Agents

The cleaning compositions used can optionally include enzyme stabilizers (or stabilizing agent(s)) which may be dispensed manually or automatically into a use solution of the solid cleaning composition and/or enzyme composition. In the alternative, a stabilizing agent and enzyme may be formulated directly into the solid cleaning compositions. The formulations of the solid cleaning compositions and/or the enzyme composition may vary based upon the particular enzymes and/or stabilizing agents employed.

In an aspect, the stabilizing agent is a starch, poly sugar, amine, amide, polyamide, or poly amine. In still further aspects, the stabilizing agent may be a combination of any of the aforementioned stabilizing agents. In an embodiment, the stabilizing agent may include a starch and optionally an additional food soil component (e.g., fat and/or protein). In an aspect, the stabilizing agent is a poly sugar. Beneficially, poly sugars are biodegradable and often classified as Generally Recognized as Safe (GRAS). Exemplary poly sugars include, but are not limited to: amylose, amylopectin, pectin, inulin, modified inulin, potato starch, modified potato starch, corn starch, modified corn starch, wheat starch, modified wheat starch, rice starch, modified rice starch, cellulose, modified cellulose, dextrin, dextran, maltodextrin, cyclodextrin, glycogen, oligofructose and other soluble starches. Particularly suitable poly sugars include, but are not limited to inulin, carboxymethyl inulin, potato starch, sodium carboxymethylcellulose, linear sulfonated alpha-(1,4)-linked D-glucose polymers, gamma-cyclodextrin and the like. Combinations of poly sugars may also be used in some embodiments.

The stabilizing agent can be an independent entity and/or may be formulated in combination with the detergent composition and/or enzyme composition. According to an embodiment, a stabilizing agent may be formulated into the detergent composition (with or without the enzyme) in either liquid or solid formulations. In addition, stabilizing agent compositions may be formulated into various delayed or controlled release formulations. For example, a solid molded detergent composition may be prepared without the addition of heat. Alternatively, the stabilizing agent may be provided separate from the detergent and/or enzyme composition, such as added directly to the wash liquor or wash water of a particular application of use, e.g. dishwasher.

Antimicrobial Agent

The cleaning compositions may further comprise one or more antimicrobial agents. Preferred microbial reduction is achieved when the microbial populations are reduced by at least about 50%, or by significantly more than is achieved by a wash with water. Larger reductions in microbial population provide greater levels of protection. Any suitable antimicrobial agent or combination of antimicrobial agents may be used including, but not limited to, a bleaching agent such as sodium hypochlorite; hydrogen peroxide; a peracid such as peracetic acid, performic acid, peroctanoic acid, sulfoperoxyacids, and any peracid generated from a carboxylic acid and oxidants; and/or a quaternary ammonium acid. Additionally, an ozone system, antimicrobial UV light, or other antimicrobial system may be similarly employed separately from or together with an antimicrobial agent.

Chlorine-Based Antimicrobial Agents

Some examples of classes of compounds that can act as sources of chlorine for an antimicrobial agent include a hypochlorite, a chlorinated phosphate, a chlorinated isocyanurate, a chlorinated melamine, a chlorinated amide, and the like, or mixtures of combinations thereof.

Some specific examples of sources of chlorine can include sodium hypochlorite, potassium hypochlorite, calcium hypochlorite, lithium hypochlorite, chlorinated trisodiumphosphate, sodium dichloroisocyanurate, potassium dichloroisocyanurate, pentaisocyanurate, trichloromelamine, sulfondichloro-amide, 1,3-dichloro 5,5-dimethyl hydantoin, N-chlorosuccinimide, N,N'-dichloroazodicarbonimide, N,N'-chloroacetylurea, N,N'-dichlorobiuret, trichlorocyanuric acid and hydrates thereof, or combinations or mixtures thereof.

Peracids

Any suitable peracid or peroxycarboxylic acid may be used in the present in the compositions or methods. A peracid includes any compound of the formula R—(COOOH)n in which R can be hydrogen, alkyl, alkenyl, alkyne, acyclic, alicyclic group, aryl, heteroaryl, or heterocyclic group, and n is 1, 2, or 3, and named by prefixing the parent acid with peroxy. Preferably R includes hydrogen, alkyl, or alkenyl. The terms "alkyl," "alkenyl," "alkyne," "acyclic," "alicyclic group," "aryl," "heteroaryl," and "heterocyclic group" are as defined herein.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups). Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups. In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

The term "alkenyl" includes an unsaturated aliphatic hydrocarbon chain having from 2 to 12 carbon atoms, such as, for example, ethenyl, 1-propenyl, 2-propenyl, 1-butenyl, 2-methyl-1-propenyl, and the like. The alkyl or alkenyl can be terminally substituted with a heteroatom, such as, for example, a nitrogen, sulfur, or oxygen atom, forming an aminoalkyl, oxyalkyl, or thioalkyl, for example, aminomethyl, thioethyl, oxypropyl, and the like. Similarly, the above alkyl or alkenyl can be interrupted in the chain by a heteroatom forming an alkylaminoalkyl, alkylthioalkyl, or alkoxyalkyl, for example, methylaminoethyl, ethylthiopropyl, methoxymethyl, and the like.

Further, as used herein the term "alicyclic" includes any cyclic hydrocarbyl containing from 3 to 8 carbon atoms. Examples of suitable alicyclic groups include cyclopropanyl, cyclobutanyl, cyclopentanyl, etc. The term "heterocyclic" includes any closed ring structures analogous to carbocyclic groups in which one or more of the carbon atoms in the ring is an element other than carbon (heteroatom), for example, a nitrogen, sulfur, or oxygen atom. Heterocyclic groups may be saturated or unsaturated. Examples of suitable heterocyclic groups include for example, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan. Additional examples of suitable heterocyclic groups include groups derived from tetrahydrofurans, furans, thiophenes, pyrrolidines, piperidines, pyridines, pyrroles, picoline, coumaline, etc.

In some embodiments, alkyl, alkenyl, alicyclic groups, and heterocyclic groups can be unsubstituted or substituted by, for example, aryl, heteroaryl, $C_{1-4}$ alkyl, $C_{1-4}$ alkenyl, $C_{1-4}$ alkoxy, amino, carboxy, halo, nitro, cyano, —$SO_3H$, phosphono, or hydroxy. When alkyl, alkenyl, alicyclic group, or heterocyclic group is substituted, preferably the substitution is $C_{1-4}$ alkyl, halo, nitro, amido, hydroxy, carboxy, sulpho, or phosphono. In one embodiment, R includes alkyl substituted with hydroxy. The term "aryl" includes aromatic hydrocarbyl, including fused aromatic rings, such as, for example, phenyl and naphthyl. The term "heteroaryl" includes heterocyclic aromatic derivatives having at least one heteroatom such as, for example, nitrogen, oxygen, phosphorus, or sulfur, and includes, for example, furyl, pyrrolyl, thienyl, oxazolyl, pyridyl, imidazolyl, thiazolyl, isoxazolyl, pyrazolyl, isothiazolyl, etc. The term "heteroaryl" also includes fused rings in which at least one ring is aromatic, such as, for example, indolyl, purinyl, benzofuryl, etc.

In some embodiments, aryl and heteroaryl groups can be unsubstituted or substituted on the ring by, for example, aryl, heteroaryl, alkyl, alkenyl, alkoxy, amino, carboxy, halo, nitro, cyano, —$SO_3H$, phosphono, or hydroxy. When aryl, aralkyl, or heteroaryl is substituted, preferably the substitution is $C_{1-4}$ alkyl, halo, nitro, amido, hydroxy, carboxy, sulpho, or phosphono. In one embodiment, R includes aryl substituted with $C_{1-4}$ alkyl.

The peroxycarboxylic acid compositions suitable for use can include any C1-C22 peroxycarboxylic acid, including mixtures of peroxycarboxylic acids, including for example, peroxyformic acid, peroxyacetic acid, peroxyoctanoic acid and/or peroxysulfonated oleic acid. As used herein, the term "peracid" may also be referred to as a "percarboxylic acid," "peroxycarboxylic acid" or "peroxyacid." Sulfoperoxycarboxylic acids, sulfonated peracids and sulfonated peroxycarboxylic acids are also included within the terms "peroxycarboxylic acid" and "peracid" as used herein. The terms "sulfoperoxycarboxylic acid," "sulfonated peracid," or "sulfonated peroxycarboxylic acid" refers to the peroxycarboxylic acid form of a sulfonated carboxylic acid as disclosed in U.S. Pat. Nos. 8,344,026 and 8,809,392, and U.S. Patent Publication No. 2012/0052134, each of which are incorporated herein by reference in their entirety. As one of skill in the art appreciates, a peracid refers to an acid having the hydrogen of the hydroxyl group in carboxylic acid replaced by a hydroxy group. Oxidizing peracids may also be referred to herein as peroxycarboxylic acids.

Quaternary Ammonium Compounds

The term "quaternary ammonium compound" or "quat" generally refers to any composition with the following formula:

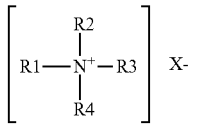

where R1-R4 are alkyl groups that may be alike or different, substituted or unsubstituted, saturated or unsaturated, branched or unbranched, and cyclic or acyclic and may contain ether, ester, or amide linkages; they may be aromatic or substituted aromatic groups. In an aspect, groups R1, R2, R3, and R4 each generally having a C1-C20 chain length. X— is an anionic counterion. The term "anionic counterion" includes any ion that can form a salt with quaternary ammonium. Examples of suitable counterions include halides such as chlorides and bromides, propionates, methosulphates, saccharinates, ethosulphates, hydroxides, acetates, phosphates, carbonates (such as commercially available as Carboquat H, from Lonza), and nitrates. Preferably, the anionic counterion is chloride.

Examples of suitable quaternary ammonium compounds include but are not limited to dialkyldimethylamines and ammonium chlorides like alkyl dimethyl benzyl ammonium chloride, octyl decyl dimethyl ammonium chloride, dioctyl dimethyl ammonium chloride, and didecyl dimethyl ammonium chloride to name a few. A single quaternary ammonium or a combination of more than one quaternary ammonium may be included in embodiments of the solid compositions. Further examples of quaternary ammonium compounds include but are not limited to amidoamine, imidozoline, epichlorohydrin, benzethonium chloride, ethylbenzyl alkonium chloride, myristyl trimethyl ammonium chloride, methyl benzethonium chloride, cetalkonium chloride, cetrimonium bromide (CTAB), carnitine, dofanium chloride, tetraethyl ammonium bromide (TEAB), domiphen bromide, benzododecinium bromide, benzoxonium chloride, choline, cocamidopropyl betaine (CAPB), denatonium, and mixtures thereof.

Silicone Compounds

Examples of silicone compounds include but are not limited to silicones with hydrophilic functionality, including: aminofunctional silicones or silicone quats, hydroxyl modified silicones, or silicones with incorporated hydrophilic groups (i.e. EO/PO or PEG modified silicones.)

Anti-Redeposition Agent

As used herein, the term "anti-redeposition agent" refers to a compound that helps keep suspended in water instead of redepositing onto the object being cleaned. The cleaning compositions may include an anti-redeposition agent for facilitating sustained suspension of soils and preventing the removed soils from being redeposited onto the substrate being cleaned. Examples of suitable anti-redeposition agents include, but are not limited to: polyacrylates, styrene maleic anhydride copolymers, cellulosic derivatives such as hydroxyethyl cellulose, and hydroxypropyl cellulose. When the concentrate includes an anti-redeposition agent, the anti-redeposition agent can be included in an amount of between approximately 0.5 wt. % and approximately 10 wt. %, and more preferably between about 1 wt. % and about 9 wt. %. When the use solution includes an anti-redeposition agent, the anti-redeposition agent may be present in an amount of between about 10 ppm to about 250 ppm, more preferably between about 25 ppm and about 75 ppm.

Surfactants

The solid cleaning compositions can include a surfactant. Surfactants suitable for use with the compositions include, but are not limited to, nonionic surfactants, anionic surfactants, amphoteric surfactants, and cationic surfactants. Surfactants can be added to the cleaning compositions in an amount between about 0.1 wt. % and about 5 wt. %; preferably between about 0.5 wt. % and about 5 wt. %; and most preferably between about 1 wt. % and about 3 wt. %.

In an embodiment, the cleaning compositions for use in the claimed include at least one surfactant. In another embodiment, the cleaning compositions include a surfactant system comprised of two or more surfactants.

Nonionic Surfactants

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available from BASF Corp. One class of compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Another class of compounds are tetra-functional block copolymers derived from the sequential addition of propylene oxide and ethylene oxide to ethylenediamine. The molecular weight of the propylene oxide ranges from about 500 to about 7,000; and, the hydrophile, ethylene oxide, is added to constitute from about 10% by weight to about 80% by weight of the molecule.
2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.
3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Utensil™, Dehydol™ manufactured by BASF, Neodol™ manufactured by Shell Chemical Co. and Alfonic™ manufactured by Vista Chemical Co.
4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Disponil or Agnique manufactured by BASF and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols can be used in some embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty esters or acylated carbohydrates to compositions containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.
6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

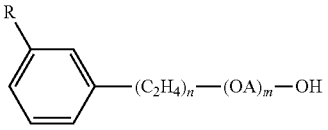

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkylene oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n\ (C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n\ (C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which can be used in the compositions correspond to the formula: $P[(C_3H_6O)_n\ (C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.
9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms, more preferably between 10 and 18 carbon atoms, most preferably between 12 and 16 carbon atoms.
10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.
11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use the present compositions include those having the formula: $R_6CON(R_7)_2$ in which $R_6$ is an alkyl group containing from 7 to 21 carbon atoms and each R7 is independently hydrogen, $C_1$-$C_4$ alkyl, $C_1$-$C_4$ hydroxyalkyl, or —$(C_2H_4O)_xH$, where x is in the range of from 1 to 3.

13. A useful class of non-ionic surfactants include the class defined as alkoxylated amines or, most particularly, alcohol alkoxylated/aminated/alkoxylated surfactants. These non-ionic surfactants may be at least in part represented by the general formulae: $R^{20}$—$(PO)_sN$-$(EO)_tH$, $R^{20}$—$(PO)_sN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions can include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Preferred nonionic surfactants include alcohol ethoxylates and linear alcohol ethoxylates.

Anionic Surfactants

Anionic surface active substances which are categorized as anionics because the charge on the hydrophobe is negative or surfactants in which the hydrophobic section of the molecule carries no charge unless the pH is elevated to neutrality or above (e.g. carboxylic acids) can also be employed in certain embodiments. Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucosamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, sulfonated fatty acids, such as sulfonated oleic acid, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

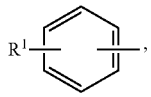

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

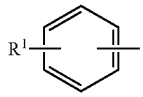

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" Cosmetics & Toiletries, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

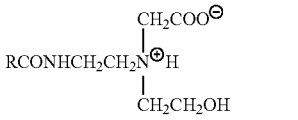

(MONO)ACETATE

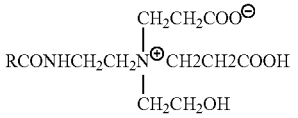

(DI)PROPIONATE

-continued

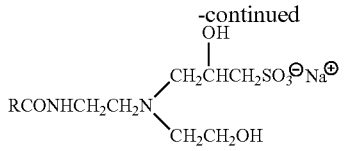

Neutral pH - Zwitterion

AMPHOTERIC SULFONATE wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+$($CH_2$—$CH_2$—$CO_2Na$)$_2$—$CH_2$—$CH_2$—OH or $C_{12}$-alkyl-C(O)—N(H)—$CH_2$—$CH_2$—$N^+$($CH_2$—$CO_2Na$)$_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

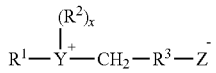

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

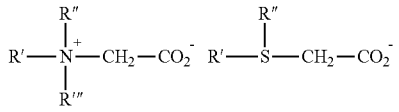

-continued

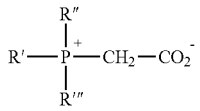

These surfactant betaines typically do not exhibit strong cationic or anionic characters at pH extremes, nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references is herein incorporated in their entirety.

Cationic Surfactants

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced, or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

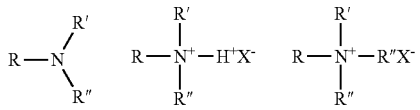

in which, R represents a long alkyl chain, R', R", and R'" may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

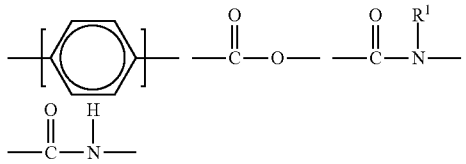

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens. Y is can be a group including, but not limited to:

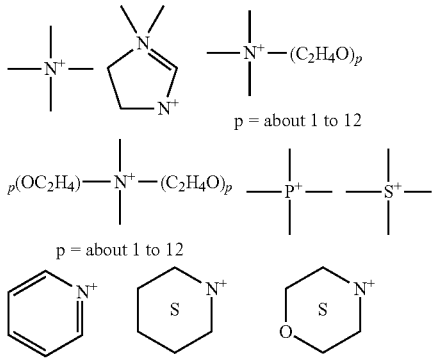

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Water

The cleaning compositions can include water. Water may be independently added to the cleaning composition or may be provided in the solid cleaning composition as a result of its presence in an aqueous material that is added to the solid cleaning composition. For example, materials added to a solid cleaning composition include water or may be prepared in an aqueous pre-mix available for reaction with the solidification agent component(s). Typically, water is introduced into a solid cleaning composition to provide the composition with a desired powder flow characteristic prior to solidification, and to provide a desired rate of solidification.

In general, it is expected that water may be present as a processing aid and may be removed or become water of hydration. Water may be present in the solid cleaning composition in the range of between 0 wt. % and 15 wt. %. The amount of water can be influenced by the ingredients in the particular formulation and by the type of solid the cleaning composition is formulated into. For example, in pressed solids, the water may be between 2 wt. % and about 10 wt. %, preferably between about 4 wt. % and about 8 wt. %. In embodiments, the water may be provided as deionized water or as softened water.

Water may also be present in a liquid cleaning composition, even where the liquid cleaning composition is provided as a concentrate. Where water is provided in a liquid cleaning composition, water may be present in a range of between about 10 wt. % and about 60 wt. %.

Whether the cleaning composition is provided as a solid or a liquid, the aqueous medium will help provide the desired viscosity for processing, distribution, and use. In addition, it is expected that the aqueous medium may help in the solidification process when is desired to form the concentrate as a solid.

Water may be further used in according to the methods as a diluent. For example, the cleaning compositions may be diluted, optionally on-site, for subsequent use in the wash machines modified as described herein. Preferably, the cleaning compositions may be diluted at a dilution ratio of between about 25 ppm and about 500 ppm.

Acidulant

The compositions and methods may further comprise an acidulant. The acidulant may be used for a variety of purposes, for example as a catalyst and/or as a pH modifier or rust/stain remover. Any suitable acid can be included in the compositions as an acidulant. In an embodiment the acidulant is an acid or an aqueous acidic solution. In an embodiment, the acidulant includes an inorganic acid. In some embodiments, the acidulant is a strong mineral acid. Suitable inorganic acids include, but are not limited to, sulfuric acid, sodium bisulfate, phosphoric acid, nitric acid, hydrofluosilicic acid, hydrochloric acid. In some embodiments, the acidulant includes an organic acid. Suitable organic acids include, but are not limited to, methane sulfonic acid, ethane sulfonic acid, propane sulfonic acid, butane sulfonic acid, xylene sulfonic acid, cumene sulfonic acid, benzene sulfonic acid, formic acid, dicarboxylic acids, citric acid, tartaric acid, succinic acid, adipic acid, oxalic acid, acetic acid, mono, di, or tri-halocarboyxlic acids, picolinic acid, dipicolinic acid, and mixtures thereof.

Stabilizing and/or pH Buffering Agents

In a further aspect, the compositions and methods may comprise a stabilizing agent and/or a pH buffering agent. Exemplary stabilizing agents include a phosphonate salt(s) and/or a heterocyclic dicarboxylic acid, e.g., dipicolinic acid. In some embodiments, the stabilizing agent is pyridine carboxylic acid based stabilizers, such as picolinic acid and salts, pyridine-2,6-dicarboxylic acid and salts, and phosphonate based stabilizers, such as phosphoric acid and salts, pyrophosphoric acid and salts and most commonly 1-hydroxyethylidene-1,1-diphosphonic acid (HEDP) and salts. In other embodiments, the compositions and methods can comprise two or more stabilizing agents, e.g., HEDP and 2,6-pyridinedicarboxylic acid (DPA). Further, exemplary pH buffer agents include, but are not limited to, triethanol amine, imidazole, a carbonate salt, a phosphate salt, heterocyclic carboxylic acids, phosphonates, etc.

Water Conditioning Agents, Builders, Chelants, and/or Sequestrants

The compositions and methods can optionally include a water conditioning agent, builder, chelant, and/or sequestering agent, or a combination thereof. A chelating or sequestering agent is a compound capable of coordinating (i.e. binding) metal ions commonly found in hard or natural water to prevent the metal ions from interfering with the action of the other detersive ingredients of a cleaning composition. Similarly, builders and water conditioning agents also aid in removing metal compounds and in reducing harmful effects of hardness components in service water. Exemplary water conditioning agents include anti-redeposition agents, chelating agents, sequestering agents and inhibitors. Polyvalent metal cations or compounds such as a calcium, a magnesium, an iron, a manganese, a molybdenum, etc. cation or compound, or mixtures thereof, can be present in service water and in complex soils. Such compounds or cations can interfere with the effectiveness of a washing or rinsing compositions during a cleaning application. A water conditioning agent can effectively complex and remove such compounds or cations from soiled surfaces and can reduce or eliminate the inappropriate interaction with active ingredients including the nonionic surfactants and anionic surfactants as described herein. Both organic and inorganic water conditioning agents can be used in the cleaning compositions.

Suitable organic water conditioning agents can include both polymeric and small molecule water conditioning agents. Organic small molecule water conditioning agents are typically organocarboxylate compounds or organophosphate water conditioning agents. Polymeric inhibitors commonly comprise polyanionic compositions such as polyacrylic acid compounds. More recently the use of sodium carboxymethyl cellulose as an antiredeposition agent was discovered. This is discussed more extensively in U.S. Pat. No. 8,729,006 to Miralles et al., which is incorporated herein in its entirety.

Small molecule organic water conditioning agents include, but are not limited to: sodium gluconate, sodium glucoheptonate, N-hydroxyethylenediaminetriacetic acid (HEDTA), ethylenediaminetetraacetic acid (EDTA), nitrilotriacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). All of these are known and commercially available.

Suitable inorganic water conditioning agents include, but are not limited to, sodium tripolyphosphate and other higher linear and cyclic polyphosphates species. Suitable condensed phosphates include sodium and potassium orthophosphate, sodium and potassium pyrophosphate, sodium tripolyphosphate, and sodium hexametaphosphate. A condensed phosphate may also assist, to a limited extent, in solidification of the solid detergent composition by fixing the free water present in the composition as water of hydration. Examples of phosphonates included, but are not limited to: 1-hydroxyethane-1,1-diphosphonic acid, $CH_3C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{28-x}N_3Na_xO_{15}P_5$(x=7); hexamethylenediamine(tetramethylenephosphonate), potassium salt, $C_{10}H_{28-x}N_2K_xO_{12}P_4$ (x=6); bis(hexamethylene)triamine (pentamethylenephosphonic acid), $(HO_2)POCH_2N[(CH_2)_6N[CH_2PO(OH)_2]_2]_2$; and phosphorus acid, $H_3PO_3$. A preferred phosphonate combination is ATMP and DTPMP. A neutralized or alkaline phosphonate, or a combination of the phosphonate with an alkali source before being added into the mixture such that there is little, or no heat or gas generated by a neutralization reaction when the phosphonate is added is preferred.

In an embodiment, the cleaning compositions can be substantially free of phosphates and/or phosphonates.

In addition to aminocarboxylates, which contain little or no NTA, water conditioning polymers can be used as non-phosphorous containing builders. Exemplary water conditioning polymers include but are not limited to: polycarboxylates. Exemplary polycarboxylates that can be used as builders and/or water conditioning polymers include, but are not limited to: those having pendant carboxylate ($—CO_2^-$) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers conditioning agents can be in an amount from about 0.05 wt. % to about 7 wt. %; preferably from about 0.1 wt. % to about 5 wt. %; and more preferably from about 0.5 wt. % to about 3 wt. %.

Whitening Agent/Bleaching Agent

The cleaning compositions and methods can optionally include a whitening or bleaching agent. Suitable whitening agents include halogen-based bleaching agents and oxygen-based bleaching agents. The whitening agent can be added to the solid cleaning compositions; however, in some embodiments, the whitening agent can be used in the pre-soak or pre-treatment step so that the later laundering step may be free of bleaching agents. This can be beneficial in formulating solid detergent compositions as there can be difficulties in formulating solid compositions with bleaching agents.

If no enzyme material is present in the compositions, a halogen-based bleach may be effectively used as ingredient of the first component. In that case, said bleach is desirably present at a concentration (as active halogen) in the range of from 0.1 to 10%, preferably from 0.5 to 8%, more preferably from 1 to 6%, by weight. As halogen bleach, alkali metal hypochlorite may be used. Other suitable halogen bleaches are alkali metal salts of di- and tri-chloro and di- and tri-bromo cyanuric acids. Preferred halogen-based bleaches comprise chlorine.

Some examples of classes of compounds that can act as sources of chlorine include a hypochlorite, a chlorinated phosphate, a chlorinated isocyanurate, a chlorinated melamine, a chlorinated amide, and the like, or mixtures of combinations thereof.

Some specific examples of sources of chlorine can include sodium hypochlorite, potassium hypochlorite, calcium hypochlorite, lithium hypochlorite, chlorinated trisodium-phosphate, sodium dichloroisocyanurate, potassium dichloroisocyanurate, pentaisocyanurate, trichloromelamine, sulfondichloro-amide, 1,3-dichloro 5,5-dimethyl hydantoin, N-chlorosuccinimide, N,N'-dichloroazodicarbonimide, N,N'-chloroacetylurea, N,N'-dichlorobiuret, trichlorocyanuric acid and hydrates thereof, or combinations or mixtures thereof.

Suitable oxygen-based bleaches include peroxygen bleaches, such as sodium perborate (tetra- or monohydrate), sodium percarbonate or hydrogen peroxide. These are preferably used in conjunction with a bleach activator which allows the liberation of active oxygen species at a lower temperature. Numerous examples of activators of this type, often also referred to as bleach precursors, are known in the art and amply described in the literature such as U.S. Pat. Nos. 3,332,882 and 4,128,494 herein incorporated by reference. Preferred bleach activators are tetraacetyl ethylene diamine (TAED), sodium nonanoyloxybenzene sulphonate (SNOBS), glucose pentaacetate (GPA), tetraacetylmethylene diamine (TAMD), triacetyl cyanurate, sodium sulphonyl ethyl carbonic acid ester, sodium acetyloxybenzene and the mono long-chain acyl tetraacetyl glucoses as disclosed in WO-91/10719, but other activators, such as choline sulphophenyl carbonate (CSPC), as disclosed in U.S. Pat. Nos. 4,751,015 and 4,818,426 can also be used.

Peroxybenzoic acid precursors are known in the art as described in GB-A-836,988, herein incorporated by reference. Examples of suitable precursors are phenylbenzoate, phenyl p-nitrobenzoate, o-nitrophenyl benzoate, o-carboxyphenyl benzoate, p-bromophenyl benzoate, sodium or potassium benzoyloxy benzene sulfonate and benzoic anhydride.

Preferred peroxygen bleach precursors are sodium p-benzoyloxy-benzene sulfonate, N,N,N,N-tetraacetyl ethylene diamine (TEAD), sodium nonanoyloxybenzene sulfonate (SNOBS) and choline sulfophenyl carbonate (CSPC).

When a whitening agent is employed, which is optional, it is preferably present in an amount of from about 1% by weight to about 10% by weight, more preferably 5% by weight to about 10% by weight, and most preferably from about 5% by weight to about 8% by weight.

Additional Functional Ingredients

The solid cleaning compositions and methods can optionally include additional functional ingredients to impart desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. Functional ingredients that can be added to the solid cleaning compositions can include, but are not limited to, dyes and fragrances. When added to the cleaning compositions, dyes and/or fragrances can be added in an amount between about 0.005 and about 0.5 wt. %. In embodiments including a dye, it is preferable that the solid cleaning compositions retain the color, i.e., that the color does not change or fade.

Embodiments of the Cleaning Compositions

The compositions of the application can be formulated and prepared any type of solid or liquid, including concentrates or use solutions. When prepared as a solid, the cleaning compositions may be any type of solid, e.g., extruded, cast, pressed, or granulated. A solid may be in various forms such as a powder, a flake, a granule, a pellet, a tablet, a lozenge, a puck, a briquette, a brick, a solid block, a unit dose, or another solid form known to those of skill in the art. A liquid may be in various forms such as a concentrate or use solution.

The cleaning compositions of the application can be used as concentrated solid or liquid compositions or may be diluted to form use compositions. In general, a concentrate refers to a composition that is intended to be diluted with water to provide a use solution that contacts an object to provide the desired cleaning, rinsing, or the like. The detergent composition that contacts the articles to be washed can be referred to as a concentrate or a use composition (or use solution) dependent upon the formulation employed in methods according to the application. It should be understood that the concentration of the ingredients in the detergent composition will vary depending on whether the detergent composition is provided as a concentrate or as a use solution.

A use solution may be prepared from the concentrate by diluting the concentrate with water at a dilution ratio that provides a use solution having desired detersive properties. The water that is used to dilute the concentrate to form the use composition can be referred to as water of dilution or a diluent and can vary from one location to another. The typical dilution factor is between approximately 1 and approximately 10,000 but will depend on factors including water hardness, the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:250 and about 1:2,000 concentrate to water.

In an aspect of the application, the cleaning composition preferably provides efficacious cleaning at low use dilutions, i.e., require less volume to clean effectively. In an aspect, a concentrated liquid detergent composition may be diluted in water prior to use at dilutions ranging from about 1/16 oz./gal. to about 6 oz./gal. or more. A detergent concentrate that requires less volume to achieve the same or better cleaning efficacy and provides other benefits at low use dilutions is desirable.

In a use solution, the cleaning compositions of the application may be provided in concentrations according to Table 2.

TABLE 2

| Raw Material | Composition A (ppm) | Composition B (ppm) |
|---|---|---|
| Alkalinity Source | 200-600 | 250-450 |
| Surfactant(s) | 50-500 | 100-350 |
| Anti-Redeposition Agent(s) | 10-250 | 25-75 |
| Chelant(s) | 5-50 | 10-35 |
| Additional Functional Ingredients | 1-50 | 2-25 |

Methods of Recirculating Water

According to an aspect of the application, a method of recirculating wash water from a wash tank is provided. The method includes moving wash water from a wash tank via a sump or drain connection, wherein the water is then pumped back into the wash tank. The recirculated water may be delivered back to the wash tank through the nozzle of the spray kit of the application, such that the recirculated water is distributed on the top of textiles in the wash tank. The nozzle of the spray kit preferably penetrates through the window of the wash tank door. In an embodiment, the recirculation spray kit of the present application may be used to deliver recirculated water comprising a cleaning composition to the wash tank. The recirculated water may further comprise residual soil from the same, or a previous wash cycle. The method of recirculating water from a wash machine tank may comprise introducing a supply of water to a wash machine tank, wherein the wash machine tank contains one or more soiled articles, subsequently adding a cleaning composition to the wash machine tank and washing the one or more soiled articles in the wash machine tank as part of the wash phase. As water exits the wash tank via a sump connection the wash water is recaptured and pumped back into the wash tank during the same or a subsequent wash phase. Recirculated water may be recirculated one or more times in a single wash phase and/or cycle.

In an embodiment, the present methods further comprise the step of adding a cleaning composition to the wash tank through a dispenser that is in fluid communication with the wash tank. The cleaning composition may be added to the wash machine tank directly onto the articles to be cleaned by spraying or other such application. It is a particularly effective use of the cleaning composition to add the composition in a concentrated form to the recirculation stream immediately before the recirculation water is sprayed onto the articles, before being diluted in the wash tank. Further, the cleaning composition may be provided as a solid or liquid concentrate and subsequently diluted to form a use solution that is added to the wash machine tank. In an embodiment, the cleaning compositions is provided as an automatic concentrated pre-soak, wherein during the initial part of the wash phase when the cleaning composition is dispensed, the water level is suppressed to only 60% of the normal fill level by using one or more of the mechanisms of the application for water pressure control, and during the latter part of the wash phase the water levels are filled to 100% of the normal fill level. According to this embodiment, when the method comprises the step of adding a cleaning composition, the recirculated water will typically contain the cleaning composition.

In an aspect, the present methods of recirculating are used on a wash machine without other methods of wash water recirculation. In another embodiment, the present methods of recirculating are used on a wash machine using alternative or additional methods of wash water recirculation.

In a further aspect, the present methods of recirculation are used on a wash machine without a rinse water reuse system. In another embodiment, the present methods of recirculating are used on a wash machine using a rinse water reuse system.

In an aspect, the present methods of recirculation are used on a wash machine with or without additional recirculating methods, and/or with or without methods of reusing rinse water.

In a further aspect, the methods of the application are used on a low water wash machine, e.g. a wash machine that uses low quantities of water per cycle relative to traditional and other wash machines. In such a case, the methods of reusing and recirculating water according to the application provide for decreased water usage and water waste, as well as improved wash efficiency and further contributes to improved soil removal (overcoming the problem of poor soil removal efficacy in low water machines).

In a still further aspect, the methods of the application are used on a machine comprising any combination of the aforementioned traits and/or cycle conditions, e.g. a wash machine which has low water cycles and captures water for recirculation or reuse.

Methods of Reusing Rinse Water

The present application may comprise methods of reusing rinse water in addition or in alternative to the methods of recirculating water. In an embodiment, the method of reusing water includes the steps of optionally pre-soaking one or more soiled articles in a pre-soak phase, washing the same articles as part of the wash phase, then rinsing the articles in the wash tank, recapturing the rinse water and transferring the rinse water to at least one reservoir tank. After collection in the one or more reservoir tanks, the rinse water may be reused by delivering the reuse water back to the wash tank in the same or subsequent phase(s). In an embodiment, the rinse water is delivered to the one or more reservoir tanks via a drain water pump. In a further embodiment, after collection in the one or more reservoir tanks, the reuse water may be transferred to the one or more reservoir tanks via a reservoir tank water transfer pump.

In an embodiment, the method of reusing rinse water further comprises the step of delivering the rinse water to at least one filter before the rinse water enters the reservoir tank. In a further embodiment, the method of reusing rinse water further comprising the step of optionally passing the reuse water through a lint screen located at the entry point of one or more reservoir tanks.

The reuse water may comprise part or all of the water used in the particular rinse phase. The reuse water may further comprise residual cleaning composition and/or soil from the wash phase. The reuse water may further be treated with an antimicrobial composition while in the one or more reservoir tanks.

In an aspect, the present methods of reusing rinse water are used on a wash machine without other methods of water reuse. In another embodiment, the present methods of reusing rinse water are used on a wash machine using alternative or additional methods of water reuse.

In a further aspect, the present methods of recirculation are used on a wash machine without a wash water recirculation system. In another embodiment, the present methods of recirculating are used on a wash machine using a wash water recirculation system.

In an aspect, the present methods of reusing rinse water are used on a wash machine with or without additional water reuse methods, and/or with or without methods of recirculating wash water.

In a further aspect, the present methods of reusing rinse water are used with a low water wash machine, e.g. a wash machine that uses low quantities of water per cycle relative to traditional and other wash machines. In such a case, the methods of reusing and recirculating water according to the application provide for decreased water usage and water waste, as well as improved wash efficiency and further contributes to improved soil removal (overcoming the problem of poor soil removal efficacy in low water machines).

In a still further aspect, the methods of the application are used on a machine comprising any combination of the aforementioned traits and/or cycle conditions, e.g. a wash machine which has low water cycles and captures water for recirculation or reuse.

The methods of the application, applied to a wash machine, result in a surprising improvement in soil removal relative to other commercially available wash machines. Thus, the methods of the application provide not only for decreased costs (with respect to water usage, energy usage, and wastewater generation), environmentally sustainable washing cycles, and improved textile longevity, but also enhanced soil removal efficacy.

Methods of Controlling the Machine Water-Filling Operation

In order to control the water that is fed into the wash machine during its fill step, four control features are provided. These features may be used individually or in combination. The control features may be implemented manually or through a programmable controller. Independent of the level of programmability of a particular wash machine, all machines have water fill valves. The wash machines inherently fill to a level inside the machine using a level sensor to indicate when the proper water level is reached. When the level sensor indicates that the level has been reached, the machine controller board will then stop sending the "Fill" signal to the "Hot" and/or "cold" water valves. To circumvent costly installation and modification of existing machines, rather than accessing the machine controller board, preferably the "Fill" signals at the valves are utilized, either passively or actively. Alternatively, or in addition to these methods, the wash temperature may be adjusted, and/or the rinse water reuse may be selected based on the type of wash cycle, linen type, or water quality.

1. Strategic Utilization of Machine Fill Valves

In the described rinse water reuse system, laundry machine drain water from the rinse phase is captured in a reservoir tank to be returned to the wash tank for a subsequent wash cycle, either in the same machine or a plurality of wash machines. However, reuse water frequently cools, meaning its soil removal efficacy is diminished, particularly for difficult soils and stain. The wash machine fill valves may be strategically utilized such that the hot water valve and/or cold water valve add a proportional amount of hot and/or cold water to the wash tank together with water from the reservoir tank. The hot and/or cold water modulates overall water temperature and boosts the water quality of water returned to the wash tank. Further, by modulating temperature using the hot and/or cold water valves, temperature (and the cleaning composition used) can be customized to enhance soil removal of particular soils. Thus, strategically modulating water temperature according to the present disclosure not only provides for decreased cost and increased efficiency through the use of reuse water, but also provides for improved soil removal through the customization of water temperature for particular types of soils and linen types.

To achieve these improvements, the use of the hot and/or cold water valves must not be indiscriminate; rather, the hot and/or cold water valves should not be activated to an extent that the costs involved in adding hot water exceed the savings accrued by using reuse water from the reservoir tank. Hot water is purposefully used only when needed. Also important to the strategic utilization of the fill valves is that water always simultaneously fills from the tap and from the reservoir tank. As a result, the machine will still fill with water in the event of an empty reservoir tank or a breakdown of the reservoir tank pumping system. Thus, the machine fill valves are strategically used as a fail-safe feature, preventing the shutdown of the laundry washing operation.

Figure 10:
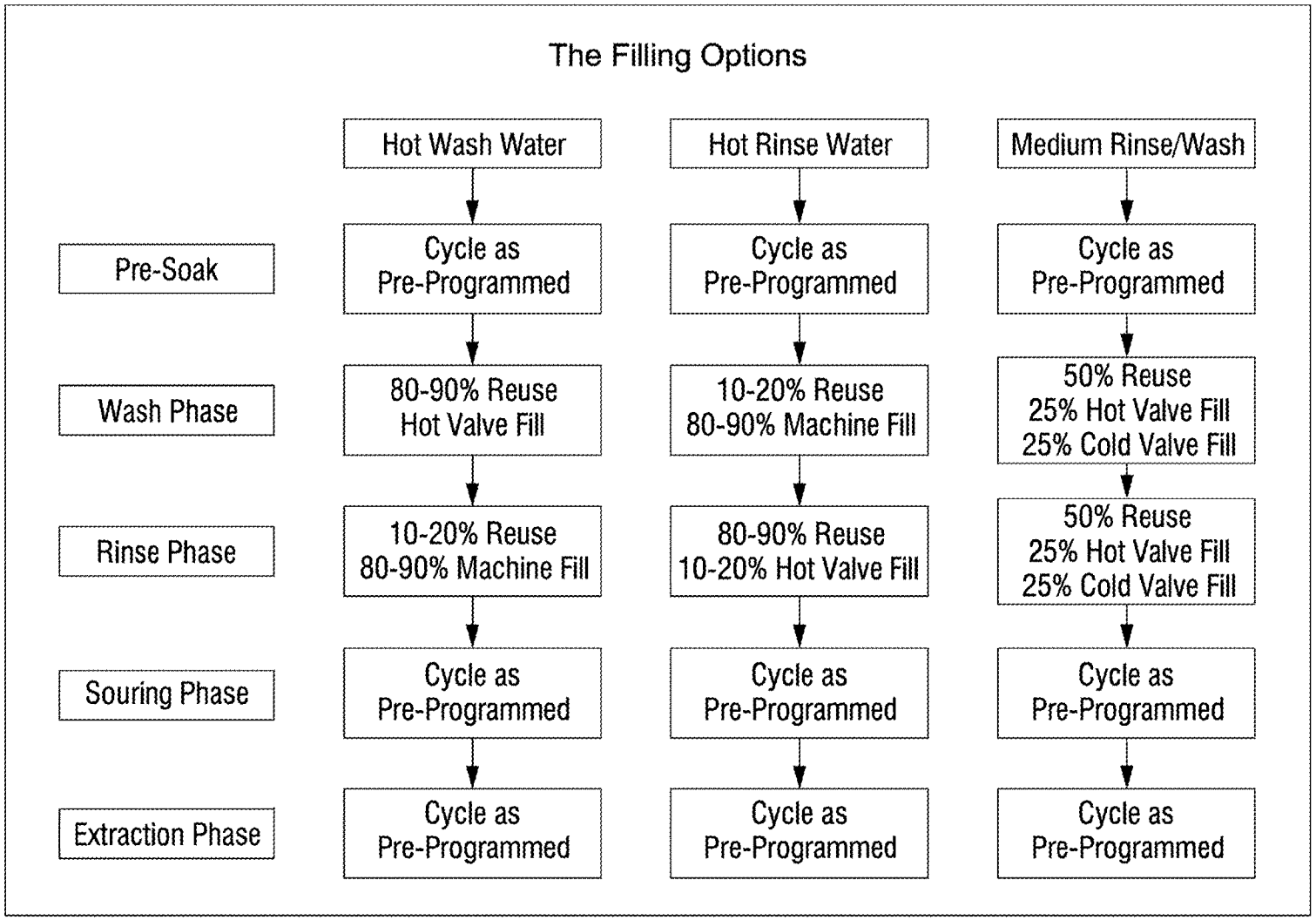
FIG. 10 shows the options for filling the wash tank using water from the reservoir tank and the hot and/or cold water taps.

There are a variety of ways to customize the temperature and water levels to improve soil removal; however, for each customization the same electrical circuit and logic is applied. The reservoir tank water transfer pump is programmed to turn on whenever two conditions apply. First, the reservoir tank water transfer pump is activated when the "hot" and/or "cold" valve receives a signal from the wash machine calling for a water fill. To achieve this effect, connections are made directly to both the "hot" and "cold" water valves, going to a relay which powers the reservoir tank water transfer pump when the water valves receive the fill signal. Second, the reservoir tank water transfer pump is activated simply when the reservoir tank is not empty. A float switch in the reservoir tank will interrupt the signal wire if the float is in the down (or "open") position. Relatedly, this effect could also be achieved with a head-pressure switch that could be used to determine when the tank is empty or near empty. A flow chart of these conditions is shown in FIG. 10.

1a. Hot Wash and Bleach Water

In an embodiment, from about 80% to about 90% water from the reservoir tank is used to fill the wash tank during the wash phase and bleach phase of the wash cycle, and about 60% to about 80% of the water from the reservoir tank is used to fill the wash tank during the rinse phase of the wash cycle. According to this embodiment, a programmable controller is programmed such that the "wash" step of the wash cycle will fill with "hot" water only. This programming step surprisingly results in the wash tank comprising 80-90% reservoir water and 10-20% hot water primarily because based on the pump rate of the reservoir tank water transfer pump (as described according to the water reuse system of the present application) provides a flow rate higher than the single "hot" tap flow rate. Surprisingly, a balance of 80-90% reservoir water and 10-20% hot water during the wash phase leads to warm wash water (i.e. between about 30° C. and 45° C.) ideal for improving soil removal on a broad spectrum of soils, without the need of an additional heater to boost the reservoir temperature.

The 80-90% proportion of reservoir water delivered to the machine is composed of mostly reuse water captured from a previous cycle. Depending on the conditions of the previous machine cycles ran as well as the current cycle being run, approximately 70% to 85% of the captured reuse water ends up in the machine wash phase. As 70-85% of the reuse water is used with hot water during the wash phase, the remaining 15-30% of reuse water is used during the subsequent bleach phase and rinse phase(s), meaning the bleach phase and rinse phase(s) comprises mostly clean non-recycled water. The reservoir tank is automatically filled with fresh water after pumping most of the reuse water to the wash phase. This proportioned balance of reuse water advantageously causes most of the reuse water to be used in the wash phase and importantly mostly clean water used in the bleach and rinse phases. This method of filling is shown in FIG. 10.

1b. Hot Rinse Water

In an embodiment, from about 60% to about 80% reservoir water from the reservoir tank is used during the wash phase, and about 80% to about 90% of the reservoir water from the reservoir tank is used during the rinse phase of the wash cycle. According to this embodiment, a programmable controller is programmed such that the "rinse" step of the wash cycle will fill with "hot" water only. This programming step surprisingly results in an ideal hot rinse water temperature (i.e. between about 30° C. and 45° C.) based on 80-90% reservoir water and 10-20% hot water used in the rinse phase; this temperature beneficially requires less energy and time to dry the textiles in a dryer. Surprisingly, a balance of 80-90% reservoir water and 10-20% hot water during the rinse phase leads to increased savings with respect to energy requirements and time involved in drying the textiles.

According to this embodiment, since only 60-80% of the wash phase comprises reservoir water, the amount of reuse water used in the wash phase is less than in the previous embodiment. It is estimated that approximately 50-70% of the captured reuse water is used in the wash phase. The remaining 30-50% of the reuse water is used in the bleach phase and rinse phase(s) of the wash cycle. This method of filling is also shown in FIG. 10.

1c. Lukewarm Wash, Warm Bleach, and Hot Rinse Water

In an embodiment, it may be desirable to wash in tepid or lukewarm water, either to save additional energy or to optimize soil removal. In this case, only cold water is added in conjunction with the warm reservoir tank water. The activation of the hot and cold valves can be customized to achieve wash and rinse temperatures which result in improved soil removal of particular types of soils. This method of filling is also shown in FIG. 10.

In a first embodiment, a programmable controller is programmed such that the "wash" steps fill with "cold" water. According to this embodiment, the resulting temperature of the "wash" steps is approximately 30° C. This embodiment results in improved soil removal for textiles containing blood, such as medical uniforms.

According to another embodiment, a programmable controller is programmed such that all the "wash" and "rinse" steps fill with "hot" water. According to this embodiment, the resulting temperature of the "wash" and "rinse" steps is approximately 60° C. This embodiment results in improved soil removal for textiles soiled with stubborn food or restaurant soils, such as greasy soils. Such textiles include, for example, napkins, tablecloths, and chef uniforms.

According to a third embodiment, a programmable controller is programmed such that the "wash" and "rinse" steps fill with both "hot" and "cold" water. According to this embodiment, the resulting temperature of the "wash" and "rinse" steps is approximately 45° C. This embodiment results in improved soil removal for cotton textiles, for example hotel wash cloths, hand towels and bath towels.

As can be seen by these embodiments, the temperature of the wash, bleach, and rinse phases can be adjusted by selectively using hot and/or cold valve water in conjunction with the reservoir water. This results in providing the maximum energy savings along with the optimum water temperatures for each linen type and soil type.

The above embodiments show a preferred set up; in general, it is preferable to use most of the reuse water in the wash step. However, the amounts of reuse water and the amount of reservoir tank water used in each phase of the wash cycle can purposely be adjusted up or down by two methods: 1) a smaller transfer pump, or restricted transfer pump can be used to provide a slower flow rate thus delivering proportionally less reservoir water and more tap water during each fill step. 2) Flow restrictors can be applied to the hot and/or cold tap water lines, resulting in the delivering of more reservoir water and less tap water proportionally. Thus, for example, the amount of reuse and/or reservoir tank water could be readily adjusted downward to 50% or up-ward to as high as 99% rather than the 80-90% shown in the embodiments. Furthermore, the proportions of water from each source can be further adjusted by dynamically adjusting a flow control or restrictor device to change flow rates on demand by the controller.

2. Active Control of the Machine Fill Valves

Figure 11:
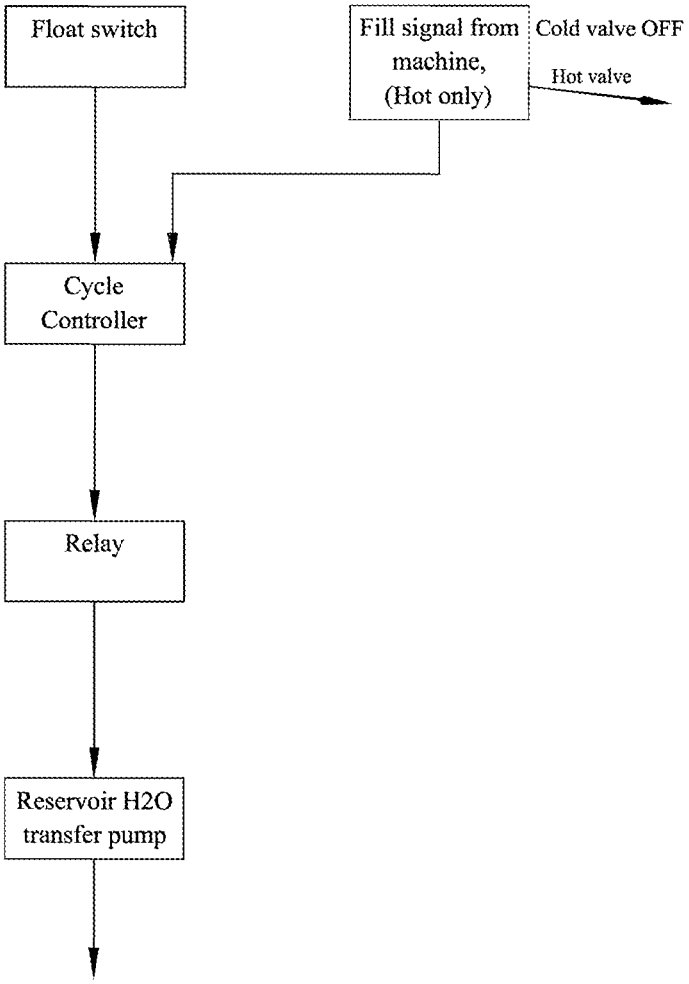
FIG. 11 depicts a flow chart illustrating a system delivering water to a wash machine via both the transfer pump and the hot water valve.
Figure 12:
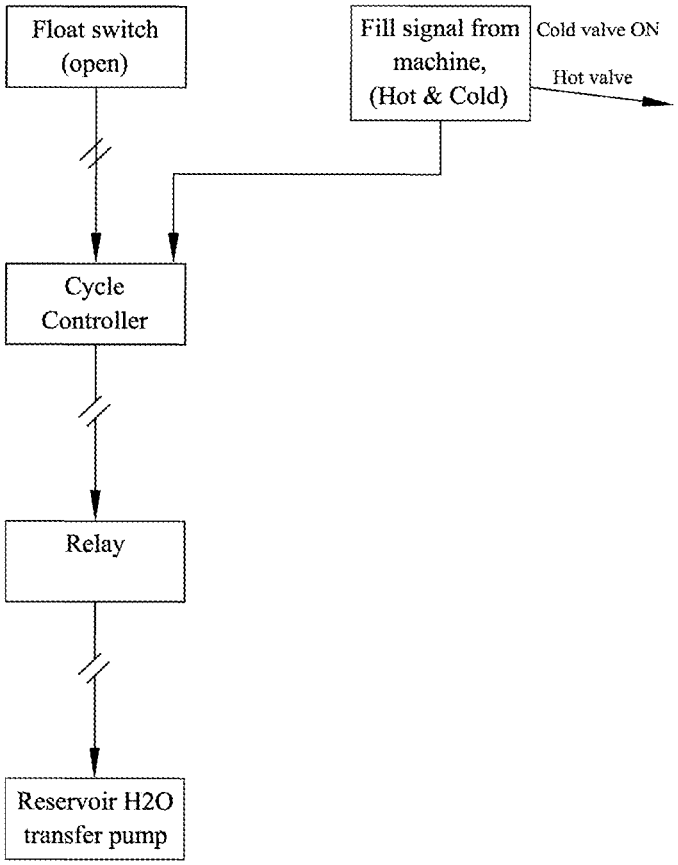
FIG. 12 depicts a flow chart illustrating a system delivering water to a wash machine via both the hot and cold water valves. The float is "open" indicating a low reservoir level condition.

Alternatively, or in addition to the first option, it is possible to more directly control the filling operation of the machine by taking direct control of the machine fill valves electrically. To achieve this effect, a relay is installed to selectively interrupt the "fill" signals of the wash machine when it is desirable to fill only from the reservoir tank. The relays should be electrically positioned between the machine controller and each of the "hot" and "cold" fill valves. The relay is then selectively opened or closed depending on whether it is desired to fill from the tank or fill from the valves, respectively. The "fill" signal from the wash machine will then send an electrical signal to the relay. If the relay is open (i.e. not connected to the valves), the "fill" signal will instead be used to power the reservoir tank water transfer pump from the reservoir tank instead of the valves. Conversely, if the relay is in the closed position (i.e. connected to the valves), the "fill" signal will power the "hot" and/or "cold" valves to open and fill from the respective taps(s). Flow charts of these conditions are shown in FIGS. 11-12.

In an embodiment, the controller can selectively and dynamically alternate between the fill-from-tap operation and the transfer-from-tank operation depending on cycle and reservoir conditions.

In an embodiment, the relay inserted between the wash machine controller and the "hot"/"cold" valves be a Normally Closed (NC) relay. With an NC relay, in the event of a power failure or logic failure, the wash machine valves will automatically get power as the connection will default to the closed (i.e. connected) configuration. This allows the filling operation to proceed as normal.

In an embodiment, the controller is a PLC controller used to control the relay. The PLC can accept programmable signals from the wash machine to instruct the relay when to fill from the tank and when to fill from the valve(s). The PLC can also be used to check the state of the reservoir tank via a float switch. If/when the reservoir tank is empty, the float switch and PLC can be used to trigger the relay to close and fill from the tap(s) so as to avoid a shut-down of the laundry operation.

Figure 13A:
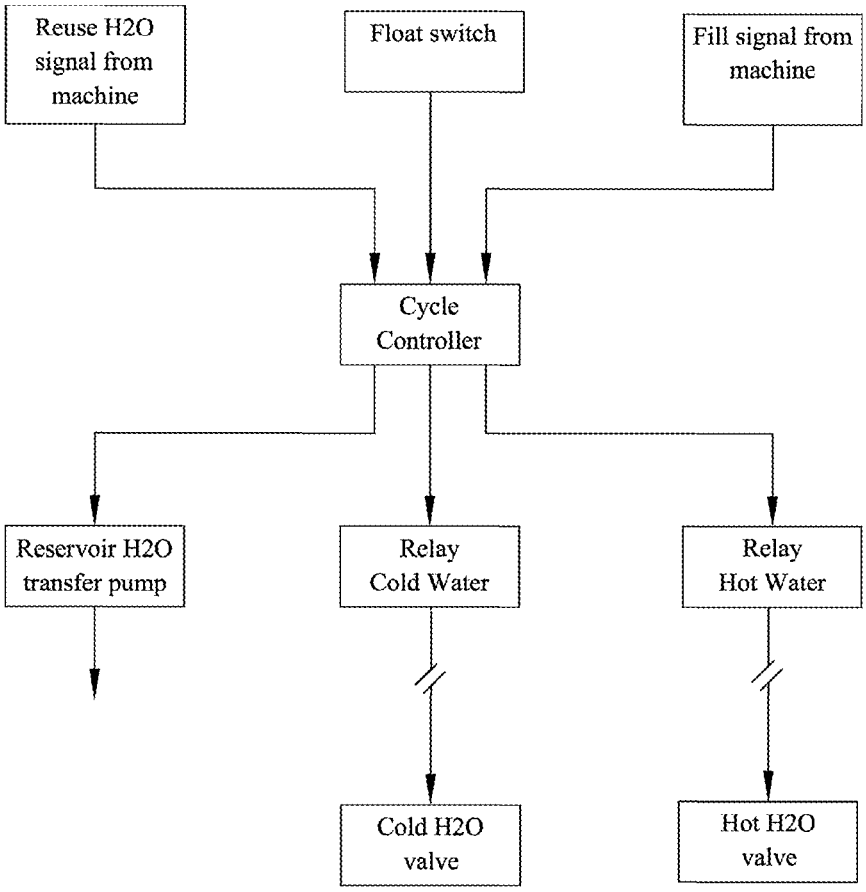
FIG. 13A depicts a flow chart illustrating a system delivering water to a wash machine via the transfer pump only.
Figure 13B:
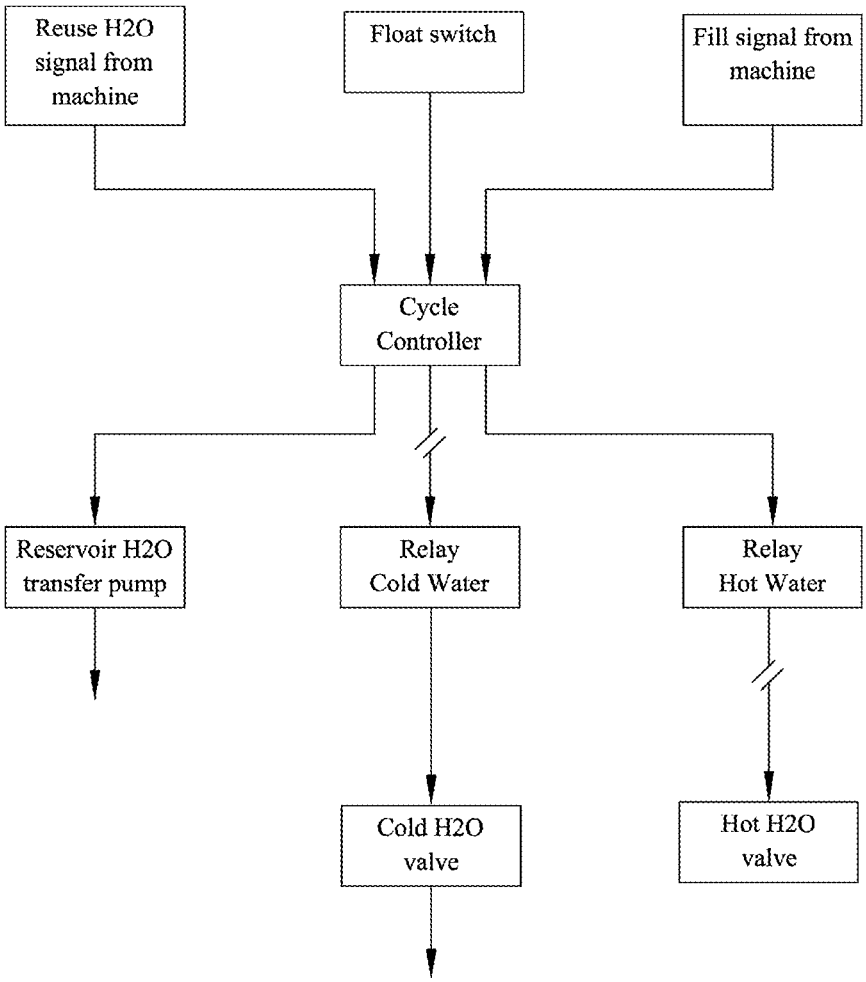
FIG. 13B depicts a flow chart illustrating a system delivering water to a wash machine via both the transfer pump and the water valve.

Active control of the valves is achieved through the use of electric circuit logic, where the PLC (or other controller) initiates an operation to fill from the reservoir tank whenever three conditions apply. First, the reservoir tank water transfer pump is activated when the wash machine sends the "Reuse H2O" signal (e.g. "S8") that is programmed for the water reuse system operate. The controller then opens the relay so that a "fill" signal from the machine will not connect the valves, allowing the wash tank to be filled from the reservoir tank. Second, the reservoir tank water transfer pump is activated when the "hot" and/or "cold" valve receives a signal from the wash machine calling for a water fill. The controller will then turn on the reservoir tank water transfer pump to deliver water from the reservoir tank as long as there is a "fill" signal and as long as the reservoir tank is not empty. Third, the reservoir tank water transfer pump is activated simply when the reservoir tank is not empty. A float switch in the reservoir tank will cause the controller to close the reservoir fill valve relay if the float is in the down (i.e. open) position. The operation to fill from the reservoir tank would then continue as is normal for the machine. FIG. 13A-13B depict flow charts for these conditions.

3. Wash Temperature Adjustment Based on Reservoir Tank Temperature and Cycle Conditions A common problem with water recycle and reuse systems is that the recaptured water in the reservoir tank cools to room temperature between wash cycles, which can impact soil removal efficacy. One solution is to place heaters in the reservoir tank to maintain temperature. Another solution is to pump the reuse water through a separate heater before it returns to the wash tank. However, both of these options are expensive and use significant amounts of energy. Additionally, although hot water could simply be added to the reuse water, this is generally done indiscriminately. In other words, a fixed quantity of hot water is generally added to the reuse water, and/or hot tap water is added until the reuse water reaches a set temperature. However, such methods are unrefined and often mitigate the savings accrued by a water reuse system. These methods do not account for the differing temperature requirements for removal of various soils and thus cannot result in improved soil removal. Additionally, without precisely calculating an acceptable level of hot water, existing methods of adding hot water to a reuse system incur energy and hot water costs that equal or exceed the savings of the reuse system itself. Strategically operating the water valves in conjunction with the reservoir tank water fill operation according to the present application obviates the need for a heater system, saves costs related to energy and water use, and utilizes reuse water as intended by the water reuse system.

The first and second systems described regarding active and passive control of the wash machine valves control the washing conditions by opening or closing the hot and/or cold valves. Controlling washing conditions through these methods provides a broader temperature range, e.g. "warm" or "hot" washing conditions. This is because, as shown by the filling proportions of FIG. 10, controlling the valves still allows for the regular machine filling function using whatever temperature is pre-programmed. The method/system can be further modified where necessary to have greater flexibility and control over the water temperature. Thus, wash conditions can be dynamically adjusted based on the type of linen and/or type of soils. In particular, since the controller mentioned in option (2) can control the hot and cold water valves, as well as the water reservoir transfer pump, based on inputs received the controller can also be used to selectively add hot water as needed to modulate the wash tank temperature further.

A temperature sensor in the reservoir tank can be installed to provide a temperature signal to the controller. With the proportional temperature signal, the controller can then open the hot water valve for a pre-programmed period of time. In an embodiment, where the temperature of the reservoir tank is 100° F., the temperature sensor communicates the temperature to the controller, which then sends a signal to the hot water valve to open the hot water fill valve for 20 seconds during the fill operation. In another embodiment, where the temperature of the reservoir tank is 80° F., the controller signals the hot water valve to open for 30 seconds. The amount of time that the hot water valve is on can be adjusted based on the desired final temperature of the laundry machine.

Further, most wash machines have or are manufactured with specific wash programs for each type of linen, as bath towels are ideally washed in a different wash environment than restaurant napkins, etc. The cycle type is generally selected by the wash machine operator, who selects a button on the user interface corresponding to the type of cycle (e.g. towels, sheets, napkins, etc.), which then commences the specific cycle. The machine controller also communicates to the dispenser which program is being used so the correct type and quantity of cleaning composition can be dispensed. This same communication signal can be used as an input to the controller of the present application to dictate the desired temperature, therefore allowing an adjustment of the sequence of operation for the fill valves and reservoir tank water transfer pump. Based on the type of linen and desired temperature range, the controller is activated according to the table below:

TABLE 3

| Reservoir tank temperature | Water Valve Activated | Time valve open (s) | Final temperature of the wash tank | Type of linen/cycle |
|---|---|---|---|---|
| 100° F. | HOT | 20 | 140° F. | Restaurant linens |
| 80° F. | HOT | 30 | 140° F. | Restaurant linens |
| 130° F. | COLD | 40 | 80° F. | Medical linens |

Figure 14:
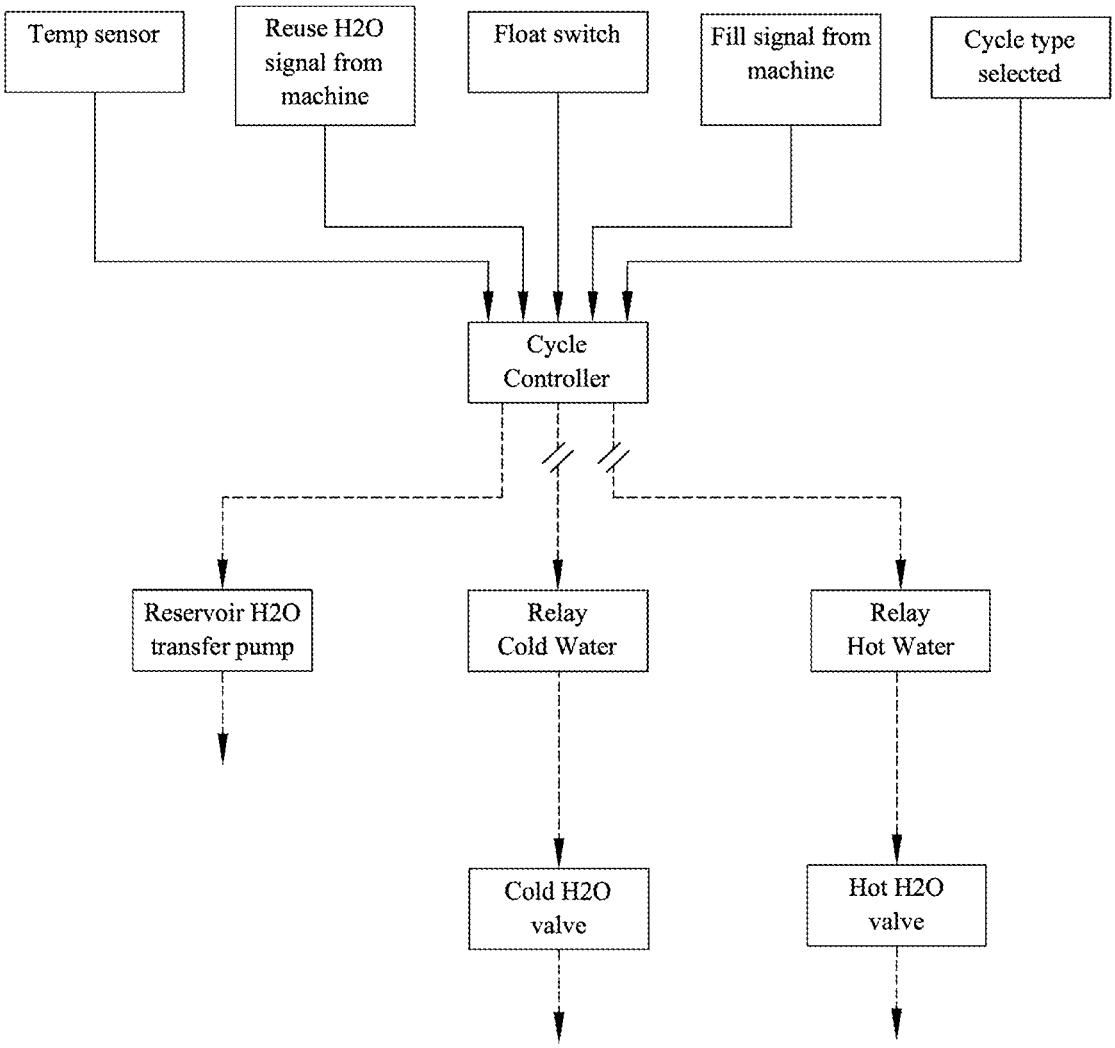
FIG. 14 shows a flow chart illustrating a system delivering water to the machine via the transfer pump and both the hot and cold water valves selectively, based on temperatures and cycle type.

The conditions for activating the water valves in conjunction with the reservoir water transfer pump according to desired temperature level are shown in FIG. 14. Use of the water valves is based on particular temperature ranges customized to particular types of soils and linens surprisingly provides improved soil removal efficacy and also maximizes the savings accrued by using a water reuse system.

4. Selection of Rinse Water Reuse Based on Cycle Conditions

In a water reuse system, the rinse water should not always be captured and stored for the next cycle. In some instances, the water should be drained because it is too dirty and would thus contaminate the next load if reused. For example, water from colored linens should not be reused if the following cycle will comprise solely white linens; in such a circumstance the rinse water should not be recaptured (and provided to a reservoir tank) at all. Likewise, even water already captured and stored in the reservoir tank should not always be used to refill the next wash cycle. For example, reuse water should not be used to wash delicate whites or colors that are bleach sensitive (as there may be residual bleach in reuse water). Additionally, reuse water is not always desirable for heavily greasy soils that would require extremely hot water to remove. Existing water reuse systems do not effectively distinguish conditions for when reuse water should be used in a subsequent wash cycle. The costs of such indiscriminate use of reuse water significantly undercut the savings of the water reuse system as a whole. For example, if reuse water is used in a cycle containing heavily greasy soils, the soils are not fully removed after the wash cycle is completed, meaning the linens are returned to a wash pile and washed a second time. As a result, an additional cycle must be run, increasing the energy and water costs, and decreasing the longevity of the linens. As another example, if colored linens are run in a wash cycle where the reuse water contains residual bleach, the colored linens may have significant bleach stains, destroying the linens, and adding the cost of replacement linens. On the other hand, if reuse water is never or rarely used, then no savings are accrued by having a reuse water system.

In comparison, the present methods/systems selectively dump laundry machine wash water, while also capturing and using the reuse water when possible, in order to improve savings related to the costs of water, energy, and linen longevity. The logic and hardware required to select when to capture and when to reuse rinse water is similar to the temperature adjustment protocol described previously. The controller of the present application can receive an input from the machine controller, which identifies the type of linen being washed. The controller of the present application can then cause the rinse water to be sent to drain, or conversely to the reuse tank. The controller of the reuse system can also prohibit the reuse tank water from being used in a particular wash cycle of a particular wash program selected. If use of the reuse water is prohibited, the wash machine will be instructed via the controller of the present application to fill from the tap and not from the reservoir.

Figure 15:
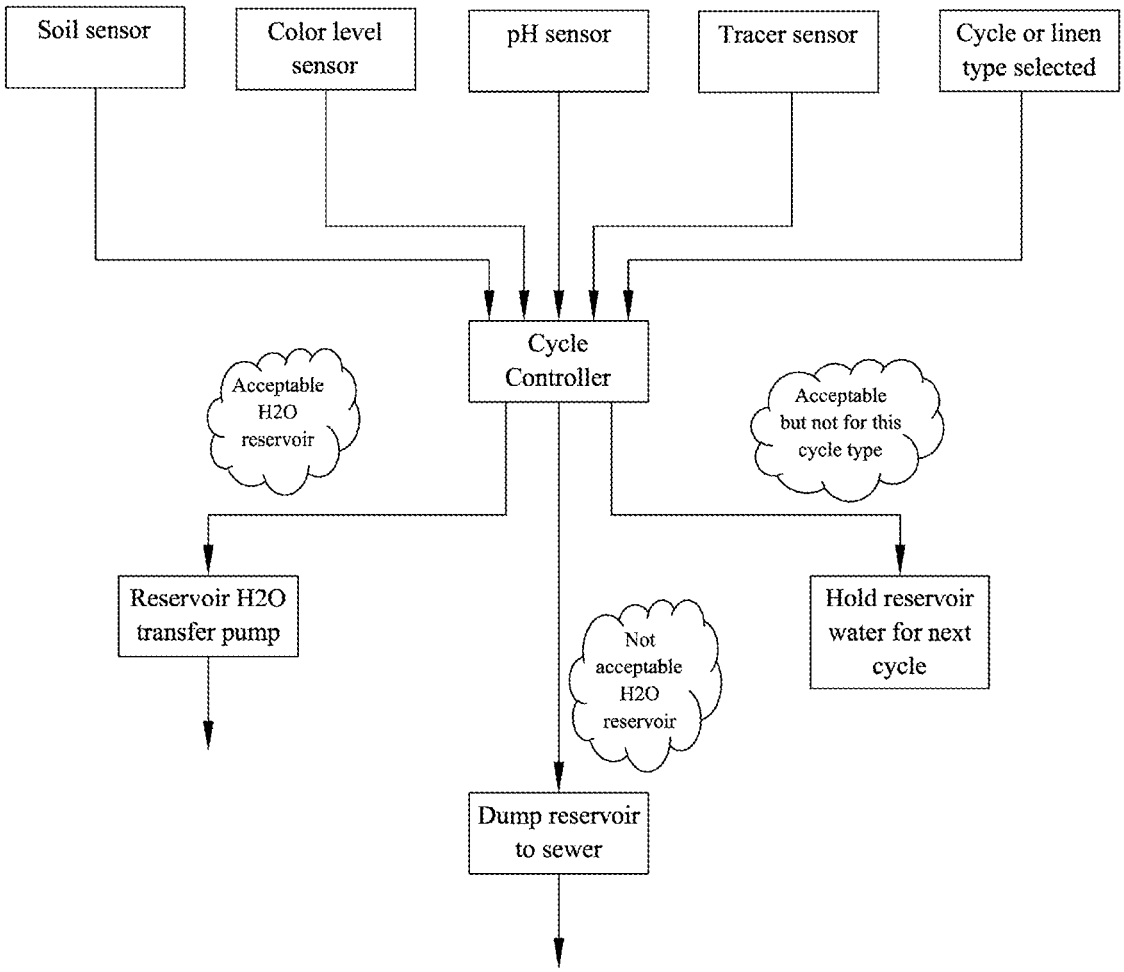
FIG. 15 shows a flow chart illustrating a system selectively transferring water depending on sensor conditions.

This system will automatically select temperatures and the use or non-use of reuse water based on the wash program selected by the laundry operator. This system further accounts for user error, where the laundry operator mistakenly selects the wrong linen type cycle, or when a particular load of laundry is not as clean as it normally should be. For example, rinse water from load that would be considered very clean and a good candidate for reusing could actually be contaminated, whether due to user error, or the unexpected presence of heavy soiling. Such a contaminated or mis-programmed load would not be handled differently than normal, meaning it would be reused in the next wash cycle. To avoid this problem, a supplemental feature of the system involves using sensors to detect the level of soil and discern the nature of the linens being washed. In an embodiment, the sensor is a soil level sensor and/or a color level sensor. Such a sensor detects the amount of soil and/or color in the tank and prevents cross-contamination. The sensor output is translated as an input to the controller of the present application; the controller then overrides the reuse of that particular batch of rinse water. In a further embodiment, alternatively, or in addition to soil and/or color sensors, a turbidity meter/sensor may be located in the drain of the wash machine or in the sump of the wash machine. This sensor/meter detects particulates in the water and provides a soil level estimation. In a still further embodiment, the sensor is a spectrophotometric sensor that detects water soluble color. In still another embodiment, the sensor may be a pH sensor or may be a detector that senses the presence of a certain tracer that is included in the chemical products for the purpose of tracking the reuse amounts. For example, when the amount of reused water gets too high in a reservoir, the tracer amount will build up and the sensor will detect the high level of tracer. Whenever such sensor(s) indicates an unacceptable condition, the water would selectively be sent to the sewer via the reservoir dump valve. The role of additional sensors in preventing contamination of the reuse water is shown in FIG. 15.

Methods and Systems of Controlling Water Levels Through Controlling Water Pressure Washing machines can be modified or newly manufactured as described to reduce water volume, spray water, spray cleaning compositions, and/or recirculate wash water. These systems and methods can include the use of retrofit kits or pieces to modify existing wash machines. These systems and methods can also be originally manufactured in a new wash machine.

Washers typically control water levels by sensing pressure created in tubing by the water height in the machine. Typically, three levels are preset within a washer controller: low, medium, and high. The water levels provided may be modified by directly altering the pressure transducer in the motherboard of a given wash machine. However, to avoid the increased cost and effort involved in altering the pressure transducer, the methods, kits, and systems of the present application provide a variety of ways of controlling water levels in a wash cycle by altering the tubing pathways which provide water to the wash machine. These options can be retrofitted to an existing machine or built into a new machine. The options intervene with the pressure tubing to create a false sense of pressure satisfaction, which allows a washer to have dynamically adjustable water levels. A key benefit of dynamically adjustable water levels is that a machine can have multiple water levels within the same cycle, including ultra-low water levels that would not otherwise be possible.

1. Dead End Manipulation

Figure 16:
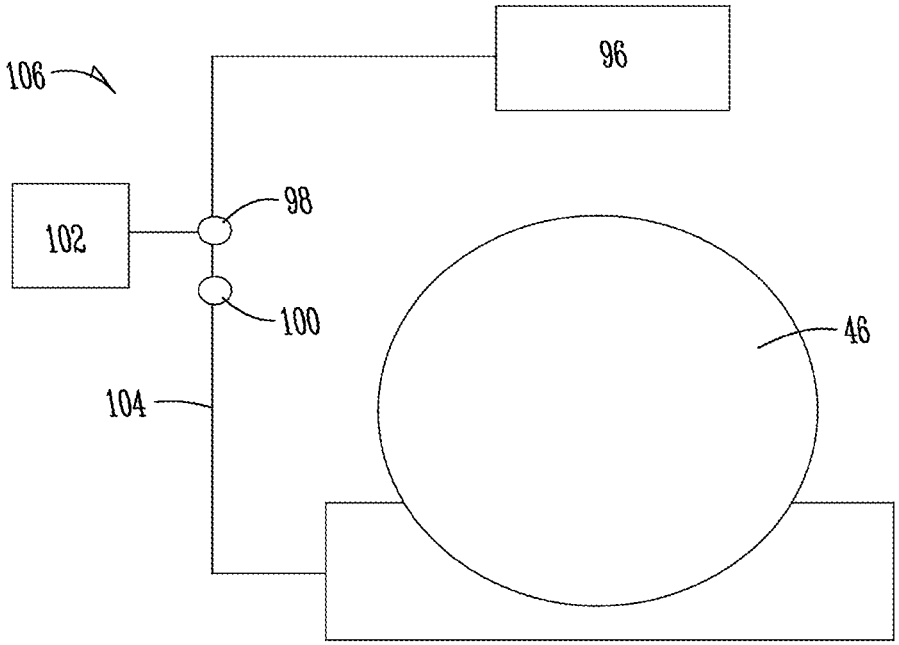
FIG. 16 shows a schematic for manipulation of water levels in a wash tank using a dead end by installing additional tubing, a dead end valve, and a water flow valve.

According to an embodiment of the present application, the mechanism of manipulating water levels may comprise a valve 98, particularly a valve 98 leading to a dead end 102. The pressure in the wash tank 46 is modified through the use of a dead end 102 by inserting a kit 106 comprising pressure tubing 104, a control system (not shown) and one or more valves 98, 100, between the wash tank 46 and the wash machine's pressure transducer 96, wherein at least one valve 98 leads to a dead end 102, and wherein the pressure tubing 104 connects the one or more valves 98, 100 (and by extension the dead end 102) as an intermediary between the wash tank 46 and the pressure transducer 96. A schematic of this type of dead end manipulation is shown in FIG. 16.

In an embodiment, dead end manipulation occurs by modifying the pressure tubing connecting the pressure transducer and wash tank to add one or more new valves. In particular, a valve to a dead end and a valve to the sump are added and are each connected to the existing pressure tubing via new pressure tubing. During a high fill phase, i.e. whenever the machine signals to fill the wash tank at the preset "high" water level setting, the valve leading to a dead end is open. After the high fill condition is met, the valve leading to a dead end is closed. During a low fill setting, when the desired low or ultra-low level of water is attained, the valve leading to the sump is closed and then the valve leading to a dead end is opened. After washing for a desired time, the valve leading to a dead end is closed and the valve leading to the sump is opened. Finally, after the wash phase of the wash cycle, both valves are opened and normal machine operation resumes.

In an alternative embodiment, the kit comprises three valves, a control system and pressure tubing. The kit components are inserted into the pressure tubing connecting the transducer and wash tank using the new pressure tubing. The three valves may be positioned in sequence such that they can convey and/or inject pressure for the transducer to read. For example, the pressure tubing from the wash tank may lead to the first valve, then after the first valve there is a juncture in the tubing with one tubing pathway leading to the transducer and one tubing pathway leading to a second valve. A third valve leading to a dead end is positioned after the second valve. Achieving low or ultra-low water levels using the three-valve dead end system occurs over the course of two wash cycles. In the first cycle, after normal filling is initiated, the second valve is opened. After the machine stops filling the second valve and third valve are closed. This traps pressure between the second and third valves. In the second cycle, the first valve is closed, and the second valve is opened, releasing high pressure to the pressure transducer. The high pressure reading causes the transducer to artificially signal a full tank to the motherboard; the motherboard ends the filling operation, resulting in low or ultra-low water levels in the wash tank. After the phase or cycle utilizing low or ultra-low water levels, the third valve is opened and after a pause (e.g. 1-20 seconds) the second valve is closed. After another pause, the first valve is opened, and the third valve is closed. Normal machine operation may then resume.

2. Piston Manipulation

Figure 17:
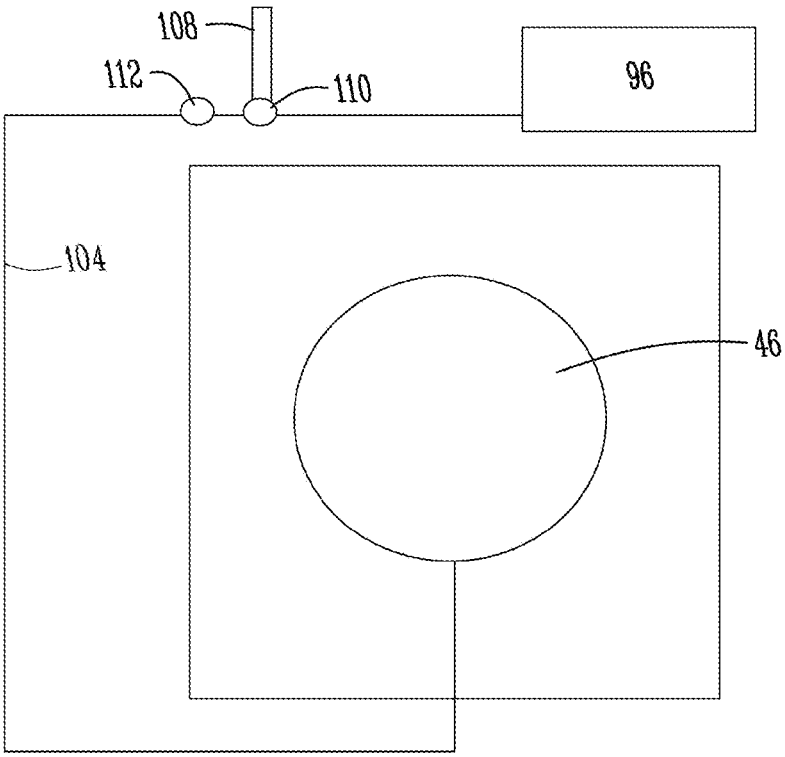
FIG. 17 shows a diagram for manipulation of water levels in a wash tank using a piston by installing additional tubing, a piston, a piston valve, and a water flow valve.

Water levels may be further or alternatively controlled by adding a piston 108 and two valves 110, 112 to the pressure tubing 104. Piston manipulation occurs by installing additional pressure tubing 104, as well as a piston 108, a valve for the piston, or "piston valve" 110, and a water flow valve 112. The piston valve 110 is a valve wherein one direction moves water to the wash tank 46 and one direction moves water to a piston 108. The water flow valve 112 is installed after the piston valve 110; it may be already in place in the machine or subsequently installed. Alternatively, in place of a piston an air pump (not shown) may be used which can be turned on to induce pressure in the pressure tubing. However, a piston beneficially has the capability to be retracted and return the system to the original pressure. A schematic of piston manipulation of water pressure is shown in FIG. 17. Piston manipulation may occur as follows. The tubing 104 and both valves 110, 112 are opened. During a low fill setting, when an ultra-low water level is desired and achieved, the water flow valve 112 is closed, and the piston valve 110 is opened. The piston 108 then moves downward, creating pressure to temporarily satisfy the pressure transducer 96. After the desired wash time, the piston 108 returns to normal position and the water flow valve 112 closes while the piston valve 110 opens.

3. Shrink Sump

Figure 18:
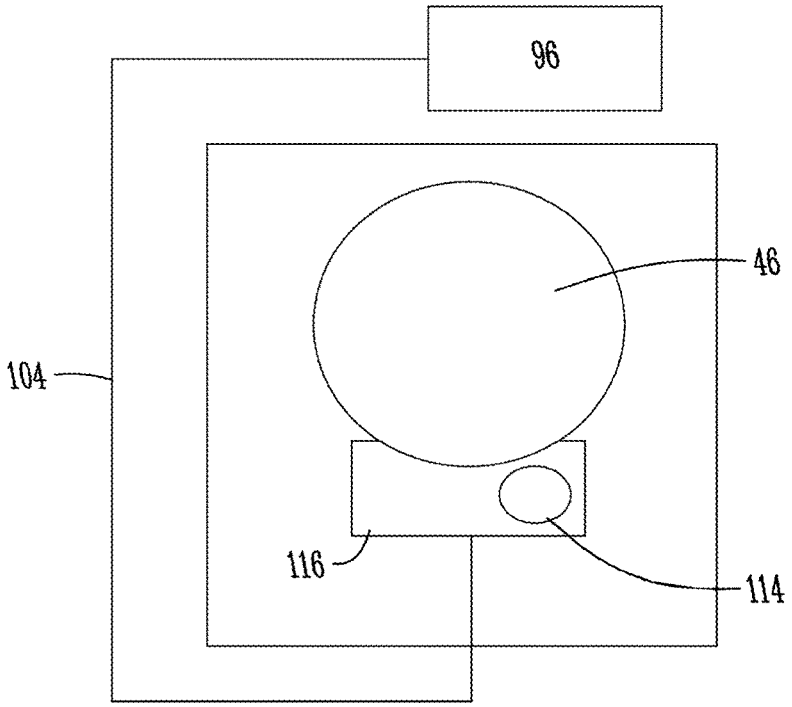
FIG. 18 shows a diagram for using a diaphragm as part of the wash machine wash tank to fill with air, allowing pressure in the wash tank to be maintained under lower water levels.

Water levels may be further or alternatively controlled by adding a diaphragm 114 to the bottom of the wash wheel 116 to occupy volume, thereby decreasing the water level but not affecting the pressure. A schematic of the shrink sump is provided in FIG. 18. Using a diaphragm 114, when a wash cycle is selected, the diaphragm 114 fills with air and the wash tank 46 fills with lower water levels while pressure is maintained. After washing for the relevant amount of time the diaphragm 114 deflates.

4. Water Fall

Figure 19:
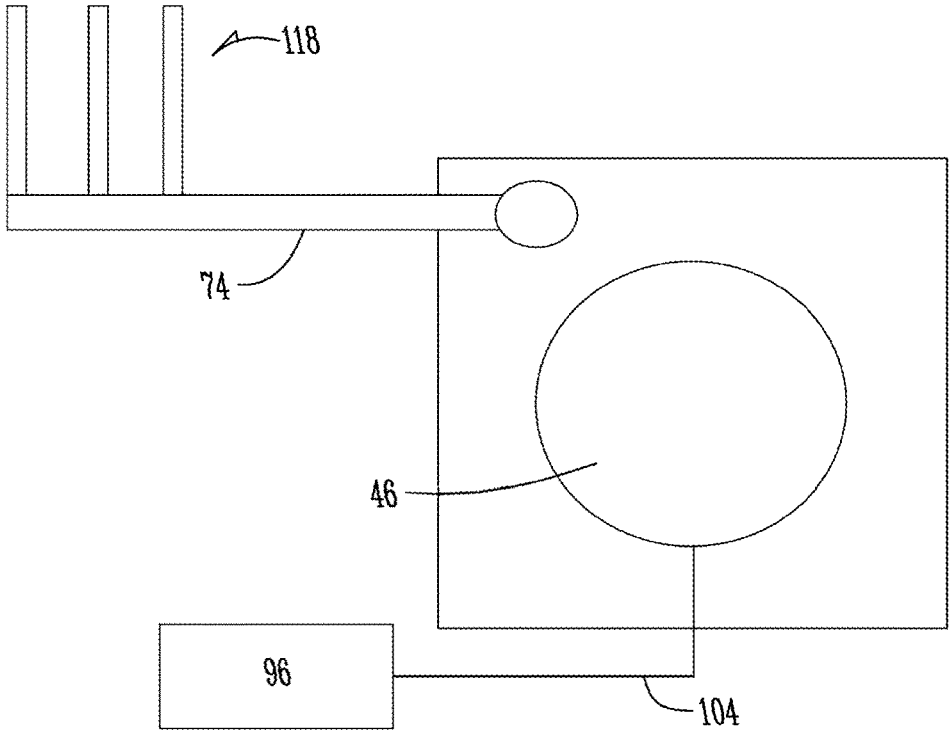
FIG. 19 shows a diagram of a water fall device added as part of a wash machine which has water or air levels and is connected to both a PLC controller and the pressure transducer.

Water pressure may be further or alternatively controlled inserting a waterfall device 118 in the pressure tubing 104 between the wash tank 46 and pressure transducer 96. The waterfall device 118 has one or more, and preferably three, channels or compartments 120 capable holding a pre-set amount of water or air which is released to modulate the readings received by the transducer 96. Specifically, the waterfall device 118 is connected to the pressure transducer 96 and a control system (not shown), wherein the control system may comprise the wash machine's existing control system (e.g. motherboard) or may comprise an additional control system. The control system communicates the preferred water level to the waterfall device 118, and the waterfall device 118 releases the pre-set amount of water or air to the transducer. The transducer 96 then communicates this information to the motherboard, and the motherboard initiates or ceases the filling function accordingly. A design of the device is shown in FIG. 19.

5. External Tank

Figure 20:
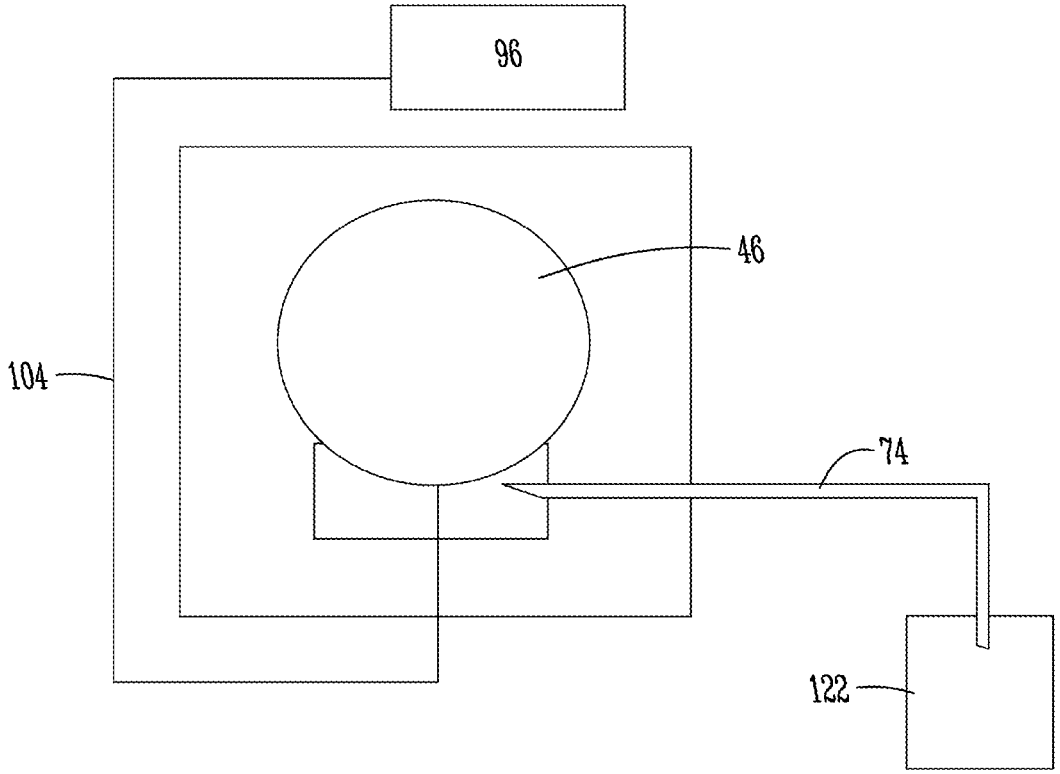
FIG. 20 shows a diagram of a wash machine utilizing an external tank to control water levels in the wash tank, while maintaining ideal pressure.

Water levels may be further or alternatively controlled by using an external tank 122 connected to the washer system via tubing 74. Using such a tank 122, the wash tank 46 fills to the normal level, preferably at the pre-set low water level. The wash tank 46 is then drained to the external tank 122 to create the desired ultra-low levels of water. A schematic of the wash tank and external tank is shown in FIG. 20.

6. Pinch Valve

Figure 21:
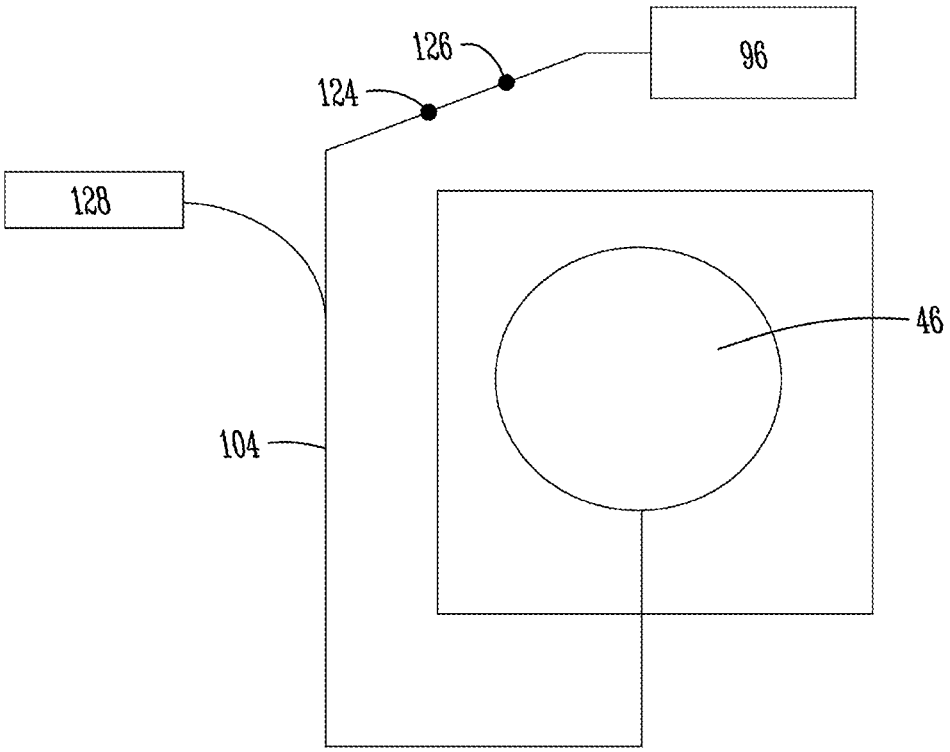
FIG. 21 depicts a diagram of one or more pinch valves installed to modulate the wash machine's pressure and water levels.

Water levels may be further or alternatively controlled by using two pinch valves 124, 126. Preferably, the pinch valves 124, 126 are installed before the machine's pressure transducer 96 and artificially communicates with the transducer 96 at a lower water pressure. The first pinch valve 124 is configured so as to close the tubing 104 to the pressure transducer 96 and controller 128 preventing the transducer's pressure sensor from operating as normal. The second pinch valve 126 is configured to create higher pressure and signal to the controller 128 that the wash tank 46 is full when the desired, lower, water level is reached. For example, after filling is initiated, the second pinch valve 126 may close, and then after a period of time the first pinch valve 124 may be closed. This traps air pressure between the two valves 124, 126. The second valve 126 may then be opened, injecting pressure into the transducer 96. The cycle can then be performed for the desired time for the cycle and then both pinch valves 124, 126 can be released. The use of pinch valves is shown in FIG. 21.

7. Peristaltic Pump

Figure 22:
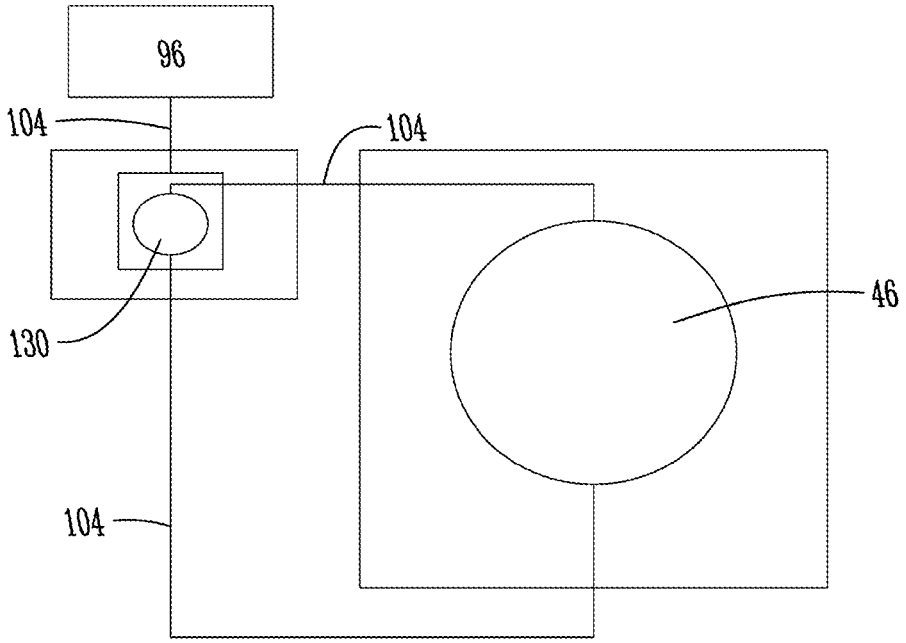
FIG. 22 shows a diagram of a peristaltic pump which rotates to artificially add pressure to the washing system.

Water levels may be further or alternatively controlled by using a peristaltic pump 130. The peristaltic pump 130 is configured so as to rotated and pinch the pressure tubing 104 to pressurize the system and signal the wash tank 46 is full when the desired, lower, water level is reached. The wash can then be performed for the desired time for the cycle and then the peristaltic pump 130 can return to neutral and restore normal pressure. The use of a peristaltic pump is shown in FIG. 22.

EXAMPLES

Embodiments of the present application are further defined in the following non-limiting Examples. It should be understood that these Examples, while indicating certain embodiments of the application, are given by way of illustration only. From the above discussion and these Examples, the essential characteristics of this application can be ascertained without departing from the spirit and scope thereof, allowing various changes and modifications to the embodiments of the application based on various usages and conditions. Such modifications are also intended to fall within the scope of the appended claims.

Example 1

An experiment was conducted to measure the amounts of water used and temperatures in each step of a laboratory washing machine cycle. The machine used was Milnor brand, model EP-Plus 35 lb. machine. The machine was programmed, and the water reuse controller was programmed according to the embodiment in 1*a* above which provided hot wash water, hot bleach water, and warm rinse water.

Several water meters were installed to measure actual amounts of water flowing in each process of the apparatus. The machine was filled with 28 lbs. of cotton towels and two warm-up cycles were ran before measurements began, so as to reach a steady state of the operation. Several experiments were then run, and the average results are shown in Table 4 below.

TABLE 4

Water Measurements on Milnor EP-Plus 35 lb. Washer (gallons)

| | Wash Phase | Bleach Phase | Rinse Phase | Total |
|---|---|---|---|---|
| Water pumped from reservoir | 18.5 | 9 | 21 | 48.5 |
| Fresh water from tap to machine | 2.5 | 1 | 5 | 8.5 |
| Total water to machine | 21 | 10 | 26 | 57 |
| Drain water captured from machine to reservoir | 0 | 0 | 20 | 20 |
| Fresh water from tap to refill reservoir | — | — | — | 28.5 |
| Fresh water from tap to machine, and from tap to reservoir | — | — | — | 37 |
| Temperature in wash tank | 57-65° C. | 58-66° C. | 42-50° C. | |

The results show that 20 gallons of reuse water was reused on average, and the proportions of reservoir water to tap water fill to the machine were as desired to achieve the ideal range of soil levels and temperatures.

Example 2

Another experiment was conducted to measure the amount of time that could be saved by filling the washing machine from both the reuse reservoir and the tap compared to the traditional method of filling from only the tap. The machine was set up similarly to Example 1 except that only hot water was used to fill the washer in conjunction with the reservoir water. For the traditional fill, both hot and cold water tap valves were used to fill the machine.

Figure 23:
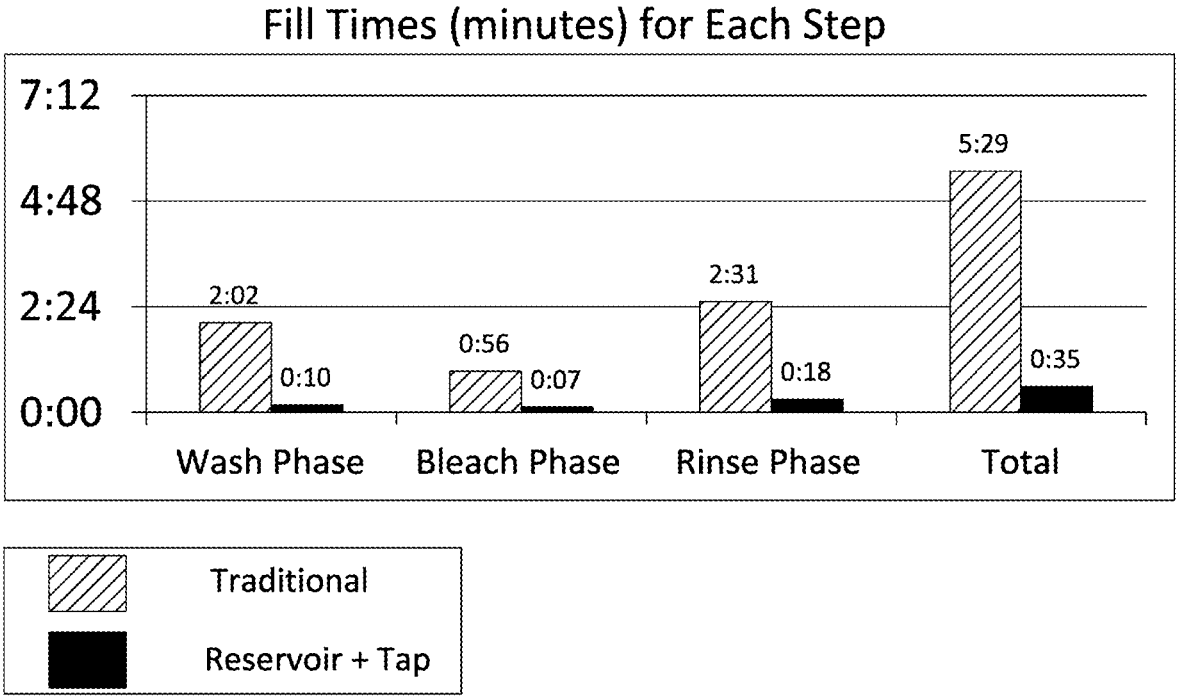
FIG. 23 illustrates the time saved using the wash cycle of the present application as compared to a traditional wash cycle.

The results of this experiment are shown in FIG. 23. As demonstrated by this figure, it was remarkably found that the apparatus saved almost 5 minutes of total wash cycle time. That is a 10% time reduction compared to the traditional 47 minute total cycle length including all fills and all agitation and extraction steps.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

The technology being thus described, it will be obvious that the same may be varied in many ways. Such variations are not to be regarded as a departure from the spirit and scope of the inventions and all such modifications are intended to be included within the scope of the following claims. Since many embodiments can be made without departing from the spirit and scope of the invention, the invention resides in the claims.

What is claimed is:

1. A method for controlling and monitoring a water reuse system in a wash machine comprising:

providing a wash machine comprising a wash tank, a dispenser, a hot water fill valve, a cold water fill valve, and an outlet valve;

providing a water reuse system comprising a controller, a reservoir tank, a drain water diverter valve, a drain water pump, and a reservoir water transfer pump, wherein the water reuse system is in fluid communication with the wash tank of the wash machine;

dispensing a cleaning composition from the dispenser; wherein the dispenser includes an outlet for dispensing a cleaning and/or sanitizing composition into the wash tank, the reservoir tank, the reservoir pump, and/or a water stream supplied to the wash tank;

running the wash machine for at least one wash cycle comprising a wash phase, a bleach phase, a rinse phase, and/or an extraction phase;

pumping water from the at least one wash cycle into the reservoir tank; and transferring water into the wash tank from the hot water fill valve, the cold water fill valve, and/or the reservoir tank;

wherein during the wash phase the wash tank is filled with from about 50% to about 85% captured reuse water from the reservoir tank, and from about 15% to about 50% water from the hot water fill valve; and wherein during the bleach and rinse phases the wash tank is filled with from about 15% to about 50% captured reuse water from the reservoir tank, and from about 50% to about 85% from the hot water fill valve and/or the cold water fill valve; and wherein any time during the wash cycle the wash machine sends a fill signal, the controller activates the hot water fill valve and the cold water fill valve to flow tap water into the wash tank, and activates the reservoir water transfer pump to pump water from the reservoir tank into the wash tank.

2. The method of claim 1, further comprising emptying the reservoir tank.

3. The method of claim 1, further comprising the step of monitoring the quality of the water in the reservoir tank.

4. The method of claim 1, wherein:

the water reuse system further comprises a level sensor located in the reservoir tank;

the level sensor communicates to the controller the water levels of the reservoir tank;

any time the level sensor communicates the water levels are sufficient in the reservoir tank and the wash machine is sending a fill signal, the controller activates a relay which allows the reservoir water transfer pump to pump water from the reservoir tank to the wash tank; and any time a float switch communicates the water levels are low in the reservoir tank, and the wash machine is sending a fill signal, the controller allows the relay to activate the hot water fill valve and/or the cold water fill valve to flow tap water to the wash tank.

5. The method of claim 1, wherein the water reuse system further comprises a temperature sensor located in the reservoir tank; and wherein the temperature sensor communicates the temperature of the water in the reservoir tank to the controller.

6. The method of claim 5, further comprising:

instructing, with the temperature sensor, the controller to activate the hot water fill valve and/or the cold water fill valve to flow tap water into the wash tank, and activating the reservoir water transfer pump to pump water from the reservoir tank into the wash tank to alter the temperature of the water in the wash tank.

7. The method of claim 1, wherein the dispenser comprises a dispenser outlet, a product container containing the cleaning composition, and an unprimed product line connecting the product container and the dispenser.

8. The method of claim 7, wherein the dispenser further comprises a diluter line operatively connected to the product line.

9. The method of claim 8, further comprising combining the cleaning composition and a diluent proximate the dispenser outlet.

10. A method for controlling and monitoring a water reuse system in a wash machine comprising:

providing a wash machine comprising a wash tank, a dispenser, a hot water fill valve, a cold water fill valve, and an outlet valve;

providing a water reuse system comprising a controller, a reservoir tank, a drain water diverter valve, a drain water pump, and a reservoir water transfer pump, wherein the water reuse system is in fluid communication with the wash tank of the wash machine;

dispensing a cleaning composition from the dispenser; wherein the dispenser includes an outlet for dispensing a cleaning and/or sanitizing composition into the wash tank, the reservoir tank, the reservoir pump, and/or a water stream supplied to the wash tank;

running the wash machine for at least one wash cycle comprising a wash phase, a bleach phase, a rinse phase, and/or an extraction phase;

pumping water from the at least one wash cycle into the reservoir tank; and transferring water into the wash tank from the hot water fill valve, the cold water fill valve, and/or the reservoir tank;

wherein during the wash phase the wash tank is filled with from about 50% to about 85% captured reuse water from the reservoir tank, and from about 15% to about 50% water from the hot water fill valve; and wherein during the bleach and rinse phases the wash tank is filled with from about 15% to about 50% captured reuse water from the reservoir tank, and from about 50% to about 85% from the hot water fill valve and/or the cold water fill valve; and wherein the water reuse system further comprises a relay electrically positioned between the controller and the water fill valves; and wherein any time during the wash cycle the wash machine sends a fill signal, the controller activates the relay, causing the reservoir water transfer pump to pump reuse water from the reservoir tank to the wash tank.

* * * * *